US010182685B2

(12) United States Patent
Ophardt et al.

(10) Patent No.: US 10,182,685 B2
(45) Date of Patent: Jan. 22, 2019

(54) COVER LIFT MECHANISM FOR FLUID DISPENSER

(71) Applicant: OP-Hygiene IP GmbH, Niederbipp (CH)

(72) Inventors: Heiner Ophardt, Arisdorf (CH); John Garry, St. Catharines (CA); Padraig McDonagh, Ballymote (IE)

(73) Assignee: OP-Hygiene IP GmbH, Niederbipp (CH)

( * ) Notice: Subject to any disclaimer, the term of this patent is extended or adjusted under 35 U.S.C. 154(b) by 0 days.

(21) Appl. No.: 15/808,067

(22) Filed: Nov. 9, 2017

(65) Prior Publication Data

US 2018/0132669 A1 May 17, 2018

Related U.S. Application Data

(60) Provisional application No. 62/421,025, filed on Nov. 11, 2016.

(51) Int. Cl.
*A47K 5/12* (2006.01)

(52) U.S. Cl.
CPC ..... *A47K 5/12* (2013.01); *A47K 5/1205* (2013.01)

(58) Field of Classification Search
CPC ..... A47K 5/12; A47K 5/1205; A47K 5/06; A47K 5/00; A47K 5/1211; B65D 88/56; B05B 11/3009
USPC ..... 222/181.3, 165, 321.8, 173
See application file for complete search history.

(56) References Cited

U.S. PATENT DOCUMENTS

| | | | | |
|---|---|---|---|---|
| 4,164,306 | A * | 8/1979 | Perrin | A47K 5/12 141/375 |
| 5,992,698 | A * | 11/1999 | Copeland | A47K 5/12 222/180 |
| 6,755,325 | B2 * | 6/2004 | Haase | B67D 1/0406 222/105 |
| 8,464,912 | B2 | 6/2013 | Ophardt et al. | |
| 2005/0077385 | A1 * | 4/2005 | Chen | A47K 5/12 239/302 |
| 2007/0210110 | A1 * | 9/2007 | Anhuf | A47K 5/12 222/180 |
| 2008/0121664 | A1 | 5/2008 | Ophardt et al. | |
| 2012/0085780 | A1 | 4/2012 | Landauer | |
| 2015/0144660 | A1 * | 5/2015 | Wertheim | B05B 11/0037 222/181.3 |
| 2015/0190827 | A1 * | 7/2015 | Ophardt | B05B 11/0037 222/153.09 |
| 2016/0288151 | A1 * | 10/2016 | Schultz | F16M 11/105 |
| 2017/0105584 | A1 * | 4/2017 | Ophardt | B05B 15/62 |

* cited by examiner

*Primary Examiner* — Benjamin R Shaw
(74) *Attorney, Agent, or Firm* — Thorpe North and Western

(57) ABSTRACT

A fluid dispenser having a housing with a cover coupled to the housing for movement between a closed position and an open position and a lifting member coupled to the housing between the housing and the cover whereby movement of the lifting member as guided by the housing moves the cover between the open position and the closed position.

20 Claims, 55 Drawing Sheets

COVER LIFT MECHANISM FOR FLUID DISPENSER

SCOPE OF THE INVENTION

This invention relates to coupling arrangements by which a cover for a fluid dispenser can be moved between open and closed positions.

BACKGROUND OF THE INVENTION

Manually operated fluid dispensers are known for dispensing hand cleaning fluid onto a person's hand. Such dispensers typically have a cover to enclose the operational mechanisms of the dispensers. Previously known dispensers suffer the further disadvantage that covers for the dispensers are difficult for a user to move between open and closed positions and to remove the cover from the dispenser. Previously known dispensers suffer the further disadvantages that bottles within an interior of the dispenser are either difficult to insert and remove or are too readily accessible for tampering removal. Previously known dispensers suffer the further disadvantages that pump mechanisms within an interior of the dispenser are either difficult to insert and remove or are too readily accessible for tampering removal. Previously known dispensers suffer the further disadvantage that both hands of a user are required to insert and remove move a bottles within an interior of the dispenser. Previously known dispensers suffer the further disadvantage that numerous components are required for mechanisms to removably support and couple pump mechanisms to housings of the dispenser resulting in increased costs for manufacture and assembly.

SUMMARY OF THE INVENTION

To at least partially overcome some of these disadvantages of previously known dispensers, the present invention provides a fluid dispenser having a housing with a cover coupled to the housing for movement between a closed position and an open position and a lifting member coupled to the housing between the housing and the cover whereby movement of the lifting member as guided by the housing moves the cover between the open position and the closed position.

To at least partially overcome some of these disadvantages of previously known dispensers, the present invention provides a fluid dispenser comprising a housing with a support flange with a support surface to support a support plate of a the piston pump mechanism and a pump holding member carried on the housing presenting a holding surface of the pump holding member in opposition to the support surface of the support flange with the upper pump holding member mounted to the housing for movement between a proximate position and a distant position relative the support flange, in which the upper pump holding member comprises a cantilevered arm secured to the housing at one end and with another distal end biased to the proximate position, preferably by an inherent bias of a resilient portion of the cantilevered arm.

To at least partially overcome some of these disadvantages of previously known dispensers, the present invention provides a fluid dispenser having a housing with a horizontal support flange with an upwardly directed support surface to support a support plate of a the piston pump mechanism and an upper pump holding member carried on the housing above the support flange presenting a downwardly directed holding surface of the upper pump holding member in opposition to the upwardly directed support surface of the support flange with the upper pump holding member mounted to the housing for movement between a lower position and an upper position relative the support flange, and in the lower position engaging the support plate of a the piston pump mechanism to removably secure the piston pump mechanism to the housing.

To at least partially overcome some of these disadvantages of previously known dispensers, the present invention provides a dispenser having a housing the housing having an interior defined between a right side wall, a left side wall with a support ledge member removably coupled to the housing spanning between the right side wall and the left side wall for supporting a bottle located thereon in the interior of the housing, preferably with the support ledge member when coupled to the housing and optionally engaging a rear wall of the housing increasing the structural integrity of the housing.

In one aspect, the present invention provides a fluid dispenser having: a housing, a cover coupled to the housing for vertical movement between a closed position in which the dispenser is operative for dispensing fluid and an open position in which access is provided to an interior of the housing, a cover actuator member coupled to the housing for guided movement between a closed position and an open position guided by the housing including pivoting of the cover actuator member about at least one horizontal pivot axis relative the housing, with the cover actuator member in the guided movement relative the housing engaging the cover to move the cover to the open position relative the housing. In one version with the cover engaged on an upper portion of the housing, the closed position of the cover may be a lower closed position with the open position being an upper open position with cover actuator member coupled to a lower portion of the housing and engaging a lower portion of the cover. In another version with the cover engaged on a lower portion of the housing, the closed position of the cover may be an upper closed position with the open position being a lower open position with cover actuator member coupled to an upper portion of the housing and engaging an upper portion of the cover to lift the cover to the upper open position. The dispenser preferably includes a bottle and a fluid pump within the interior of the housing with insertion into and removal of the bottle and a fluid pump permitted when the cover is in the open position and prevented when the cover is in the closed position. Preferably the cover actuator member in the closed position covers one of an upper portion and a lower portion of a forward access opening into the interior of the housing to prevent removal of the bottle and/or the pump mechanism from the interior of the housing. Preferably the cover in the closed position covers the other of the upper portion and the lower portion of the forward access opening into the interior of the housing that is not covered by the cover actuator member to prevent removal of the bottle and/or the pump mechanism from the interior of the housing.

In another aspect, the present invention provides a fluid dispenser having: a housing, the housing providing an interior with a forward access opening into the interior, a cover coupled to the housing for vertical movement between a cover closed position in which the dispenser is operative for dispensing fluid and a cover open position in which access is provided to an interior of the housing, a cover actuator member coupled to the housing for guided movement between an actuator closed position and a actuator open position guided by the housing including pivoting of the cover actuator member about at least one horizontal pivot axis relative the housing, with the cover actuator member in the guided movement relative the housing engaging the cover to move the cover between the cover open position and the cover closed position relative the housing, a bottle and/or a pump mechanism within the interior of the housing with insertion into and removal of the bottle and/or the pump mechanism permitted through the forward access opening into when the cover is in the cover open position and prevented when the cover is in the cover closed position, the cover actuator member in the actuator closed position covering one of an upper portion and a lower portion of the forward access opening to prevent removal of the bottle and/or the pump mechanism from the interior of the housing and the cover in the cover closed position covering the other of the upper portion and the lower portion of the forward access opening into the interior of the housing that is not covered by the cover actuator member.

In another aspect, the present invention provides a fluid dispenser having: a housing, a cover coupled to the housing for movement between a closed lower position in which the dispenser is operative for dispensing fluid and an open upper position in which access is provided to an interior of the housing, a lifting member coupled to a lower portion of the housing for guided movement between a closed position and an open position guided by the housing including pivoting of the lifting member about at least one horizontal pivot axis relative the housing, with the lifting member in the guided movement relative the housing engaging a lower portion of the cover to move the cover to the open upper position relative the housing. Preferably, the guided movement includes guided sliding of the lifting member forwardly and rearwardly relative the housing. Preferably, the housing includes a pair of spaced side walls, the lifting member including a pair of spaced arms, with one arm adjacent each of the side walls of the housing, a stub axle member is carried by each arm extending horizontally into an opening in an adjacent side wall, the opening selected from a circular opening within which the stub axle is rotatable about a first horizontal axis, and a front to rear extending slotway in which the axle member is slidable between forward and rear positions with the stub axle is rotatable within the slotway at each of a plurality of different positions within the slotway about a respective horizontal axis at each of the positions. Preferably, the cover has a right cover side wall and a left cover side wall secured together spaced laterally from each other, and top wall bridging between an upper portion of the right cover side wall and an upper portion of left cover side wall, the housing has a forward opening providing access to the interior of the housing, and the lifting member when in the closed position covers a lower portion of the forward opening of the housing and when in the closed position moves downwardly relative the housing to uncover the lower portion of the forward opening of the housing. Preferably, the cover covers an upper portion of the forward opening of the housing in the closed upper position. Preferably, the dispenser includes an removable member selected from the group consisting of a fluid reservoir and a pump mechanism within the interior of the housing, and when the lifting member when in the closed position covering the lower portion of the forward opening of the housing, the lifting mechanism prevents removal of the removable member from the interior of the housing. The guided movement preferably includes guided sliding of the lifting member forwardly and rearwardly relative the housing, with in movement from the closed position to the open position, a front portion of lifting member moving downwardly and rearwardly relative to the housing and a rear portion of the lifting member in engagement with the cover moving upwardly relative the housing. The cover has a right cover side wall and a left cover side wall secured together spaced laterally from each other, and top wall bridging between an upper portion of the right cover side wall and an upper portion of left cover side wall. The housing has a forward opening providing access to the interior of the housing. When the lifting member is in the closed position the front portion of lifting member covers a lower portion of the forward opening of the housing and when the lifting member is in the open position the front portion of lifting member is moved downwardly relative the housing to uncover the lower portion of the forward opening of the housing.

In another aspect the present invention provides a fluid dispenser having a housing having an interior with a forward opening providing access to the interior of the housing, a removable member selected from the group consisting of a fluid reservoir and a pump mechanism, a cover coupled to the housing for movement upwardly and downwardly between a closed position of the cover in which the dispenser is operative for dispensing fluid and an open position of the cover, a cover actuator member coupled to the housing for guided movement between a closed position of the cover actuator member and an open position of the cover actuator member guided by the housing including pivoting of the cover actuator member about at least one horizontal pivot axis relative the housing, the cover actuator member in the guided movement relative the housing engaging the cover to move the cover to between the open position of the cover and the closed position of the cover relative the housing such that with the cover actuator member in the closed position of the cover actuator member the cover is in the closed position of the cover and with the cover actuator member in the open position of the cover actuator member the cover is in the open position of the cover, with the cover actuator member in the closed position of the cover actuator member and the cover in the closed position of the cover, the cover covers a first portion of the forward opening of the housing and insertion and removal of the removable member from within the interior of the housing through the forward opening is prevented.

As a $1^{st}$ feature, the present invention provides a fluid dispenser having:

a housing, a cover coupled to the housing for movement between a closed lower position in which the dispenser is operative for dispensing fluid and an open upper position in which access is provided to an interior of the housing, a lifting member coupled to a lower portion of the housing for guided movement between a closed position and an open position guided by the housing including pivoting of the lifting member about at least one horizontal pivot axis relative the housing, the lifting member in the guided movement relative the housing engaging a lower portion of the cover to move the cover to the open upper position relative the housing.

As a $2^{nd}$ feature, the present invention provides a fluid dispenser as in the $1^{st}$ feature wherein the guided movement includes guided sliding of the lifting member forwardly and rearwardly relative the housing.

As a $3^{rd}$ feature, the present invention provides a fluid dispenser as in any one of the $1^{st}$ or $2^{nd}$ features wherein the housing includes a pair of spaced side walls, the lifting member including a pair of spaced arms, with one arm adjacent each of the side walls of the housing, a stub axle member carried by each arm extending horizontally into an opening in an adjacent side wall, the opening selected from a circular opening within which the stub axle is rotatable about a first horizontal axis, and a front to rear extending slotway in which the axle member is slidable between forward and rear positions with the stub axle is rotatable within the slotway at each of a plurality of different positions within the slotway about a respective horizontal axis at each of the positions.

As a $4^{th}$ feature, the present invention provides a fluid dispenser as in any one of the $1^{st}$ to $3^{rd}$ features wherein:

the housing has a forward opening providing access to the interior of the housing, the lifting member when in the closed position covers a lower portion of the forward opening of the housing and from the closed position moves downwardly relative the housing to the open position in which the lower portion of the forward opening of the housing is not covered by the lifting member.

As a $5^{th}$ feature, the present invention provides a fluid dispenser as in the $4^{th}$ feature wherein the cover when in the closed lower position covers an upper portion of the forward opening of the housing and from the closed lower position moves upwardly relative the housing to the open upper position in which the upper portion of the forward opening of the housing is not covered by the cover.

As a $6^{th}$ feature, the present invention provides a fluid dispenser as in the $4^{th}$ feature including a removable member selected from the group consisting of a fluid reservoir and a pump mechanism within the interior of the housing, the removable member in insertable into and removable from the interior of the housing via the forward opening of the housing, wherein when the lifting member is in the closed position covering the lower portion of the forward opening of the housing, the lifting mechanism prevents removal of the removable member from the interior of the housing.

As a $7^{th}$ feature, the present invention provides a fluid dispenser as in the $5^{th}$ feature including a removable member selected from the group consisting of a fluid reservoir and a pump mechanism within the interior of the housing.

As an $8^{th}$ feature, the present invention provides a fluid dispenser as in the $7^{th}$ feature wherein with the lifting member in the closed position and the cover in the closed lower position, the lifting mechanism and the cover together prevent removal of the removable member from the interior of the housing.

As a $9^{th}$ feature, the present invention provides a fluid dispenser as in the $7^{th}$ or $8^{th}$ feature wherein with the lifting member in the open position and the cover in the open upper position, the removable member in insertable into and removable from the interior of the housing via the forward opening of the housing.

As a $10^{th}$ feature, the present invention provides a fluid dispenser as in the $7^{th}$, $8^{th}$ or $9^{th}$ feature wherein when the lifting member is in the closed position covering the lower portion of the forward opening of the housing and the cover is in the closed lower position covering an upper portion of the forward opening of the housing a viewing opening is provided into the interior of the housing between the lifting member and the cover intermediate the lower portion of the forward opening of the housing and the an upper portion of the forward opening of the housing.

As an $11^{th}$ feature, the present invention provides a fluid dispenser as in the $5^{th}$ feature wherein the bottle 101 and the pump mechanism 100 are provided within the interior of the housing in the closed upper position the cover covers the upper portion of the forward opening of the housing preventing removal of the bottle 101 and the pump mechanism 100 from within the interior of the housing through the forwardly open upper portion.

As a $12^{th}$ feature, the present invention provides a fluid dispenser as in any one of the $1^{st}$ to $11^{th}$ features wherein the cover having a right cover side wall and a left cover side wall secured together spaced laterally from each other, and top wall bridging between an upper portion of the right cover side wall and an upper portion of left cover side wall.

As a $13^{th}$ feature, the present invention provides a fluid dispenser as in any one of the $1^{st}$ to $12^{th}$ features wherein the guided movement includes guided sliding of the lifting member forwardly and rearwardly relative the housing, with in movement from the closed position to the open position, a front portion of lifting member moving downwardly and rearwardly relative to the housing and a rear portion of the lifting member in engagement with the cover moving upwardly relative the housing.

As a $14^{th}$ feature, the present invention provides a fluid dispenser comprising:

a housing 70, a fluid containing bottle 101, a piston pump mechanism 100, an upper pump holding member 508, the piston pump mechanism 100 having a piston-chamber forming body 110 and a piston forming element 111, the piston-forming element 111 the coaxially slidable along an axis relative the piston-chamber forming body 110 to draw fluid from the bottle 101 and discharge fluid from a discharge outlet 113, the piston-chamber forming body 110 carrying a support plate 117 extending radially relative the axis outwardly from the piston-chamber forming body 110, the housing 70 having a horizontal support flange 204 with an upwardly directed support surface, a slot 205 in the support flange 204 extending from a slot opening in a front edge 206 of the support flange 204 to a blind rear end 207, the upper pump holding member 508 carried on the housing 70 above the support flange 204 to present a downwardly directed holding surface of the upper pump holding member 508 in opposition to the upwardly directed support surface of the support flange 204, the piston pump mechanism 100 removably coupled to the housing 70, when the piston pump mechanism 100 is coupled to the housing, the piston-chamber forming body 110 extends through the slot 205 of the support flange 204 with the support plate 117 located in between the upwardly directed support surface of the support flange 204 and the downwardly directed holding surface of the upper pump holding member 508, the upper pump holding member 508 mounted to the housing 70 for movement between a lower position and an upper position relative the support flange 204.

As a $15^{th}$ feature, the present invention provides a fluid dispenser as in the $14^{th}$ feature wherein the support plate 117 having a forwardly directed stopping surface.

As a $16^{th}$ feature, the present invention provides a fluid dispenser as in the $15^{th}$ feature wherein forward of the downwardly directed holding surface of the upper pump holding member 508, a holding stop member is provided with a rearwardly directed stop surface for engagement with the forwardly directed stopping surface of the support plate 117 when the downwardly directed holding surface of the upper pump holding member 508 is in engagement with the support plate 117 to prevent forward sliding of the support plate 117 relative the upper pump holding member 508.

As a 17$^{th}$ feature, the present invention provides a fluid dispenser as in the 15$^{th}$ or 16$^{th}$ feature wherein forward of the upwardly directed support surface of the support flange 204, a support stop member is provided with a rearwardly directed stop surface for engagement with the forwardly directed stopping surface of the support plate 117 when the upwardly directed support surface of the support flange 204 is in engagement with the support plate 117 to prevent forward sliding of the support plate 117 relative the support flange 204.

As an 18$^{th}$ feature, the present invention provides a fluid dispenser as in the 14$^{th}$ feature wherein, in the upper position, the downwardly directed holding surface of the upper pump holding member 508 is directed downwardly and, in the upper position, the downwardly directed holding surface of the upper pump holding member 508 is directed downwardly and forwardly.

As a 19$^{th}$ feature, the present invention provides a fluid dispenser as in the 18$^{th}$ feature wherein, in the upper position, the downwardly directed holding surface of the upper pump holding member 508 is spaced from the upwardly directed support surface of the support flange 204 a distance greater than a distance the downwardly directed holding surface of the upper pump holding member 508 is spaced from the upwardly directed support surface of the support flange 204 in the lower position.

As a 20$^{th}$ feature, the present invention provides a fluid dispenser as in any one of the 18$^{th}$ or 19$^{th}$ features wherein when the upper pump holding member 508 is in the upper position, the piston pump mechanism 100 can be coupled to and uncoupled from the housing 70.

As a 21$^{st}$ feature, the present invention provides a fluid dispenser as in the 20$^{th}$ feature wherein when the piston pump mechanism 100 is coupled to the housing with the upper pump holding member 508 in the upper position, a forward entrance opening is defined between a forward end of the upper pump holding member 508 and the front edge 206 of the support flange 204, the piston pump mechanism 100 can be coupled to and uncoupled from the housing 70 with: (a) the piston-chamber forming body 110 moving through the slot 205 of the support flange 204 via the slot opening in the front edge 206 of the support flange 204, and (b) the support plate 117 moving from between the upper pump holding member 508 and the support flange 204 through a forward entrance opening between the upper pump holding member 508 and the support flange 204.

As a 22$^{nd}$ feature, the present invention provides a fluid dispenser as in the 21$^{st}$ feature wherein:

with the upper pump holding member 508 in the lower position, the forward entrance opening is closed by engagement between the forward end of the upper pump holding member 508 and the front edge 206 of the support flange and a forwardly opening horizontally extending entrance guideway slot is defined forward of the closed forward entrance opening between an upper guideway surface on the forward end of the upper pump holding member 508 directed at least partially downwardly and a lower guideway surface on the front edge 206 of the support flange directed at least partially upwardly, at least one of the upper guideway surface and the lower guideway surface also being directed at least partially forwardly so that the forwardly opening horizontally extending entrance guideway slot having a vertical height that reduces rearwardly toward the closed forward entrance opening, the support plate 117 having a rearwardly directed cam surface, wherein on rearward movement of the piston pump mechanism 100 relative to the housing 70 with the rearwardly directed cam surface of the support plate 117 disposed horizontally in the forwardly opening horizontally extending entrance guideway slot, engagement between the camming surface and the upper guideway surface alone or between the camming surface and the upper guideway surface and the lower guideway surface applies upwardly directed forces to the upper guideway surface which move the upper pump holding member 508 toward the upper position opening the forward entrance opening.

As a 23$^{rd}$ feature, the present invention provides a fluid dispenser as in the 22$^{nd}$ feature wherein the opening of the forward entrance opening permits subsequent rearward movement of the piston-chamber forming body 110 through the slot 205 of the support flange 204 via the slot opening in the front edge 206 of the support flange 204 and subsequent rearward movement of the support plate 117 from between the upper pump holding member 508 and the support flange 204.

As a 24$^{th}$ feature, the present invention provides a fluid dispenser as in the 22$^{nd}$ or 23$^{rd}$ feature wherein the upper guideway surface is directed forwardly and downwardly.

As a 25$^{th}$ feature, the present invention provides a fluid dispenser as in the 22$^{nd}$, 23$^{rd}$ or 24$^{th}$ feature wherein the lower guideway surface is directed forwardly and upwardly.

As a 26$^{th}$ feature, the present invention provides a fluid dispenser as in any one of the 18$^{th}$ to 25$^{th}$ features wherein the downwardly directed holding surface of the upper pump holding member 508 is biased downwardly toward the upwardly directed support surface of the support flange 204.

As a 27$^{th}$ feature, the present invention provides a fluid dispenser as in any one of the 18$^{th}$ to 26$^{th}$ features wherein the upper pump holding member 508 is biased downwardly toward the lower position.

As a 28$^{th}$ feature, the present invention provides a fluid dispenser as in any one of the 18$^{th}$ to 27$^{th}$ features wherein the upper pump holding member 508 has a rear portion engaged on the housing 70 with the upper pump holding member 508 extending forwardly to a distal forward portion as a cantilevered arm, and the distal forward portion carrying the downwardly directed holding surface.

As a 29$^{th}$ feature, the present invention provides a fluid dispenser as in the 28$^{th}$ feature wherein the rear portion of the upper pump holding member 508 is fixed to the housing 70, the upper pump holding member 508 includes a resilient intermediate portion between the rear portion and the distal forward portion, the resilient portion being resiliently deflectable for movement of the distal forward portion between the lower position and the upper position.

As a 30$^{th}$ feature, the present invention provides a fluid dispenser as in the 29$^{th}$ feature wherein the resilient portion has an inherent bias to assume an inherent condition and is deflectable to deflected conditions against the inherent bias, when the resilient portion is deflected from the inherent conditions, the inherent bias urges the resilient portion toward the inherent condition, wherein when the rear portion of the upper pump holding member 508 is fixed to the housing 70, the inherent bias of the resilient portion biases the distal forward portion to the lower position and movement of the distal forward portion toward the upper position results in the resilient portion being deflected to deflected conditions in which the inherent bias urges the distal forward portion to the lower position.

As a 31st feature, the present invention provides a fluid dispenser as in any one of the 28th to 30th features wherein the rear portion of the upper pump holding member 508 engaged on the housing 70 is in a frictional snap-fit relation.

As a 32nd feature, the present invention provides a fluid dispenser as in any one of the 18th to 31st features wherein the upper pump holding member 508 is injection molded from a plastic material as a unitary element.

As a 33rd feature, the present invention provides a fluid dispenser as in any one of the 18th to 32nd features wherein when the piston pump mechanism 100 is coupled to the housing with the upper pump holding member 508 in the lower position, the support plate 117 is captured between the upper pump holding member 508 and the support flange 204 against vertical movement.

As a 34th feature, the present invention provides a fluid dispenser as in any one of the 18th to 33rd features wherein, when the piston pump mechanism 100 is coupled to the housing with the upper pump holding member 508 in the lower position, the support plate 117 is captured between the upper pump holding member 508 and the support flange 204 against removal.

As a 35th feature, the present invention provides a fluid dispenser as in any one of the 18th to 34th features wherein the dispenser 10 including an actuator mechanism 19 operative to slide the piston-forming element 111 relative the piston-chamber forming body 110 to draw fluid from the bottle 101 and discharge fluid from the discharge outlet 113, when the piston pump mechanism 100 is coupled to the housing with the upper pump holding member 508 in the lower position the support plate 117 is captured between the upper pump holding member 508 and the support flange 204 against movement in an operative position for engagement of the piston-forming element by the actuator mechanism 19.

As a 36th feature, the present invention provides a fluid dispenser as in any one of the 18th to 35th features wherein the support plate 117 has an upwardly directed plate surface and a downwardly directed plate surface, when the piston pump mechanism 100 is coupled to the housing with the upper pump holding member 508 in the lower position, the support plate 117 is captured between the upwardly directed support surface of the support flange 204 and the downwardly directed surfaces of the upper pump holding member 508, with the upwardly directed support surface of the support flange 204 engaging the downwardly directed plate surface and the downwardly directed surfaces of the upper pump holding member 508 engaging the upwardly directed plate surface.

As a 37th feature, the present invention provides a fluid dispenser as in the 36th feature wherein the support plate 117 having a forwardly directed stopping surface.

As a 38th feature, the present invention provides a fluid dispenser as in the 37th feature wherein forward of the downwardly directed holding surface of the upper pump holding member 508, a holding stop member is provided with a rearwardly directed stop surface for engagement with the forwardly directed stopping surface of the support plate 117 when the downwardly directed holding surface of the upper pump holding member 508 is in engagement with the upwardly directed plate surface of the support plate 117 to prevent forward sliding of the support plate 117 relative the upper pump holding member 508.

As a 39th feature, the present invention provides a fluid dispenser as in the 37th or 38th feature wherein forward of the upwardly directed support surface of the support flange 204, a support stop member is provided with a rearwardly directed stop surface for engagement with the forwardly directed stopping surface of the support plate 117 when the upwardly directed support surface of the support flange 204 is in engagement with the downwardly directed plate surface of the support plate 117 to prevent forward sliding of the support plate 117 relative the support flange 204.

As a 40th feature, the present invention provides a fluid dispenser as in the 38th feature wherein:

in the upper position, the downwardly directed holding surface of the upper pump holding member 508 is directed downwardly and, in the upper position, the downwardly directed holding surface of the upper pump holding member 508 is directed downwardly and forwardly, when the piston pump mechanism 100 is coupled to the housing with the upper pump holding member 508 in the lower position and the support plate 117 located in between the upwardly directed support surface of the support flange 204 and the downwardly directed holding surface of the upper pump holding member 508: (a) with the downwardly directed holding surface of the upper pump holding member 508 in engagement with the upwardly directed plate surface of the support plate 117 and (b) with the rearwardly directed stop surface of the holding stop member engaged with the forwardly directed stopping surface of the support plate 117, applying upwardly directed forces to the piston-chamber forming body 110 moves the upper pump holding member 508 to the upper position maintaining the upwardly directed plate surface of the support plate 117 engaged with the downwardly directed holding surface of the upper pump holding member 508 and the rearwardly directed stop surface of the holding stop member engaged with the forwardly directed stopping surface of the support plate 117, tilts the piston-chamber forming body 110 to a lower end of the piston-chamber forming body 110 forwardly while maintaining the piston-chamber forming body 110 to extends through the slot 205 of the support flange 204.

As a 41st feature, the present invention provides a fluid dispenser as in any one of the 18th to 36th features wherein the support plate 117 having a forwardly directed stopping surface.

As a 42nd feature, the present invention provides a fluid dispenser as in the 41st feature wherein forward of the downwardly directed holding surface of the upper pump holding member 508, a holding stop member is provided with a rearwardly directed stop surface for engagement with the forwardly directed stopping surface of the support plate 117 when the downwardly directed holding surface of the upper pump holding member 508 is in engagement with the support plate 117 to prevent forward sliding of the support plate 117 relative the upper pump holding member 508.

As a 43rd feature, the present invention provides a fluid dispenser as in the 41st or 42nd feature wherein forward of the upwardly directed support surface of the support flange 204, a support stop member is provided with a rearwardly directed stop surface for engagement with the forwardly directed stopping surface of the support plate 117 when the upwardly directed support surface of the support flange 204 is in engagement with the support plate 117 to prevent forward sliding of the support plate 117 relative the support flange 204.

As a 44th feature, the present invention provides a fluid dispenser as in the 38th to 42nd features wherein, when the piston pump mechanism 100 is coupled to the housing with the upper pump holding member 508 in the lower position and the support plate 117 located in between the upwardly directed support surface of the support flange 204 and the downwardly directed holding surface of the upper pump holding member 508, applying upwardly directed forces to the upper pump holding member 508 moves the upper pump holding member 508 to the upper position.

As a 45$^{th}$ feature, the present invention provides a fluid dispenser as in the 18$^{th}$ feature wherein, in the upper position, the downwardly directed holding surface of the upper pump holding member 508 is directed downwardly and, in the upper position, the downwardly directed holding surface of the upper pump holding member 508 is directed downwardly and forwardly.

As a 46$^{th}$ feature, the present invention provides a fluid dispenser as in any one of the 18$^{th}$ to 45$^{th}$ features wherein:

the piston chamber-forming body 110 defining a fluid chamber coaxially about an axis therein open at an open upper end and with a lower open end in communication with fluid in the bottle 101, the piston-forming element 111 having a piston portion received in the fluid chamber with the piston-forming element 111 extending out of the open upper end of fluid chamber to the discharge outlet 113 which is carried on the a piston forming element 111.

As a 47$^{th}$ feature, the present invention provides a fluid dispenser as in the 46$^{th}$ feature wherein the bottle 101 has an open upper end, the piston-chamber forming body 110 carrying a dip tube 112 that extends downwardly to a fluid inlet opening open to the fluid in the bottle 101.

As a 48$^{th}$ feature, the present invention provides a fluid dispenser as in the 18$^{th}$ to 47$^{th}$ features including:

a cover 18 coupled to the housing 70 for movement between a closed lower position in which the dispenser 10 is operative for dispensing fluid and an open upper position, wherein when the cover 18 is in the closed lower position the cover 18 engages the upper pump holding member 508 to maintain the upper pump holding member 508 in the lower position.

As a 49$^{th}$ feature, the present invention provides a fluid dispenser as in the 48$^{th}$ feature wherein the cover 18 includes a downwardly directed surface to engage an upwardly directed surface 720 of the upper pump holding member 508 to maintain the upper pump holding member 508 in the lower position when the cover 18 is in the closed lower position.

As a 50$^{th}$ feature, the present invention provides a fluid dispenser as in any one of the 48$^{th}$ and 49$^{th}$ features wherein the housing having a forwardly open upper portion via which access is provided to an interior of the housing, the pump mechanism 100 is provided within the interior of the housing, in the closed upper position the cover covers the upper portion of the forward opening of the housing preventing removal of the pump mechanism 100 from within the interior of the housing through the forwardly open upper portion.

As a 51$^{st}$ feature, the present invention provides a fluid dispenser as in any one of the 48$^{th}$ to 50$^{th}$ features wherein the cover includes a top wall 21 that overlies the upper pump holding member 508, the downwardly directed surface is carried on an underside of the top wall 21.

As a 52$^{nd}$ feature, the present invention provides a fluid dispenser as in the 50$^{th}$ feature wherein the cover having a right cover side wall and a left cover side wall secured together spaced laterally from each other, the top wall bridging between an upper portion of the right cover side wall and an upper portion of left cover side wall.

As a 53$^{rd}$ feature, the present invention provides a fluid dispenser having:

a housing, the housing providing an interior with a forward access opening into the interior, a cover coupled to the housing for vertical movement between a cover closed position in which the dispenser is operative for dispensing fluid and a cover open position in which access is provided to an interior of the housing, a cover actuator member coupled to the housing for guided movement between an actuator closed position and a actuator open position guided by the housing including pivoting of the cover actuator member about at least one horizontal pivot axis relative the housing, with the cover actuator member in the guided movement relative the housing engaging the cover to move the cover between the cover open position and the cover closed position relative the housing, a bottle and/or a pump mechanism within the interior of the housing with insertion into and removal of the bottle and/or the pump mechanism permitted through the forward access opening into when the cover is in the cover open position and prevented when the cover is in the cover closed position, the cover actuator member in the actuator closed position covering one of an upper portion and a lower portion of the forward access opening to prevent removal of the bottle and/or the pump mechanism from the interior of the housing and the cover in the cover closed position covering the other of the upper portion and the lower portion of the forward access opening into the interior of the housing that is not covered by the cover actuator member.

As a 54$^{th}$ feature, the present invention provides a fluid dispenser as in the 53$^{rd}$ features wherein with the cover actuator member in the actuator closed position and the cover in the cover closed position, a viewing opening is provided between the upper portion of the forward access opening and the lower portion of the forward access opening.

As a 55$^{th}$ feature, the present invention provides a fluid dispenser having a housing, the housing having an interior defined between a right side wall and a left side wall, a support ledge member removably coupled to the housing spanning between the right side wall and the left side wall to support a bottle located thereon in the interior of the housing.

As a 56$^{th}$ feature, the present invention provides a fluid dispenser as in the 55$^{th}$ feature wherein the support ledge member when coupled to the housing is securely coupled to each of the right side wall and the left side wall increasing the structural integrity of the housing.

As a 57$^{th}$ feature, the present invention provides a fluid dispenser as in the 55$^{th}$ feature wherein the support ledge member when coupled to the housing engages and is securely coupled to a rear wall of the housing forming a triangular connection of the right side wall, the left side wall and the rear wall increasing the structural integrity of the housing.

As a 58$^{th}$ feature, the present invention provides a fluid dispenser as in any one of the 55$^{th}$ to 57$^{th}$ features wherein each of the right side wall and the left side wall are resilient so as to deflect to permit the distance between the first right spigot on right wall and the first left spigot on the left wall to be increased for coupling and removal of the support ledge member from the housing.

As a 59$^{th}$ feature, the present invention provides a fluid dispenser having a housing, the housing having a right side wall, a left side wall, and a back wall, the right side wall and a left side wall coupled together spaced laterally from each other by the back wall defining there between an interior of the housing, a first right opening provided in the right side wall disposed about an first opening axis, a first left opening provided in the left side wall disposed about a primary opening axis coincident with the first opening axis, and a first latch opening in the back wall, a support ledge member removably coupled to the housing for removal and replacement, the support ledge member having a right spigot extending laterally to the right along a pivot axis, a left spigot extending laterally to the left along the pivot axis and a rear latch member extending radially relative the pivot axis, each of the right side wall and the left side wall being resilient so as to deflect to permit the distance between the first right opening on right wall and the first left opening on the left wall to be increased for axial insertion and removal of the right spigot in the first right opening and axial insertion and removal of the left spigot engaged in the first left opening, the right spigot axially insertable into and axially removable from the first right opening when the support ledge member is disposed with the pivot axis coaxial with the first opening axis, the left spigot axially insertable into and axially removable from the first left opening when the support ledge member is disposed with the pivot axis coaxial with the first opening axis, with the right spigot in the first right opening and the left spigot the first left opening, the support ledge member is pivotable relative the housing about the pivot axis to place the first rear latch member in the first latch opening in the back wall preventing further pivoting of the support ledge member relative the housing about the pivot axis, wherein with the right spigot in the first right opening, the left spigot in the first left opening, the support ledge member and the first rear latch member in the first latch opening, the support ledge member and the housing are latched engagement with the support ledge member provides an upwardly directed support surface for supporting a bottle located thereon in the interior of the housing.

As a $60^{th}$ feature, the present invention provides a fluid dispenser as in the $59^{th}$ feature wherein:

the right spigot axially insertable into, and axially removable from, the first right opening when (a) the support ledge member is disposed with the pivot axis coaxial with the first opening axis and the first right spigot is disposed rotated about the pivot axis at a first insertion angle relative the housing, and the left spigot axially insertable into, and axially removable from, the first left opening when (b) the support ledge member is disposed with the pivot axis coaxial with the first opening axis and (c) the left spigot is disposed rotated about the pivot axis at the first insertion angle relative the housing.

As a $61^{st}$ feature, the present invention provides a fluid dispenser as in any one of the $59^{th}$ to $60^{th}$ features wherein each of the right side wall and the left side wall are resilient so as to deflect to permit the distance between the first right spigot on right wall and the first left spigot on the left wall to be increased for coupling and removal of the support ledge member from the housing.

As a $62^{nd}$ feature, the present invention provides a fluid dispenser as in any one of the $59^{th}$ to $61^{st}$ features including: a second right opening provided in the right side wall disposed about a second opening axis, a second left opening provided in the left side wall disposed about a secondary opening axis coincident with the second opening axis, and a second latch opening in the back wall, each of the right side wall and the left side wall being resilient so as to deflect to permit the distance between the second right opening on right wall and the second left opening on the left wall to be increased for axial insertion and removal of the right spigot in the second right opening and axial insertion and removal of the left spigot in the secondary left opening, the right spigot axially insertable into, and axially removable from, the second right opening when the support ledge member is disposed with the pivot axis coaxial with the second opening axis, the left spigot axially insertable into, and axially removable from, the second left opening when the support ledge member is disposed with the pivot axis coaxial with the second opening axis, with the right spigot in the second right opening and the left spigot the second left opening the support ledge member is pivotable relative the housing about the pivot axis to place the rear latch member in the second latch opening in the back wall preventing further pivoting of the support ledge member relative the housing about the pivot axis, wherein with the right spigot in the second right opening, the left spigot the second left opening the support ledge member and the second rear latch member in the second latch opening the support ledge member and the housing are in latched engagement and the support ledge member provides an upwardly directed support surface for supporting a bottle located thereon in the interior of the housing.

As a $63^{rd}$ feature, the present invention provides a fluid dispenser as in the $62^{nd}$ feature wherein the right spigot axially insertable into, and axially removable from, the second right opening when (a) the support ledge member is disposed with the pivot axis coaxial with the second opening axis and the right spigot is disposed rotated about the pivot axis at a second insertion angle relative the housing, and the left spigot axially insertable into, and axially removable from, the second left opening when (b) the support ledge member is disposed with the pivot axis coaxial with the second opening axis, and (c) the left spigot is disposed rotated about the pivot axis at the second insertion angle relative the housing.

As a $64^{th}$ feature, the present invention provides a fluid dispenser as in any one of the $59^{th}$ to $62^{nd}$ features wherein the housing having a forwardly open upper portion via which access is provided to an interior of the housing, the bottle and a pump mechanism are provided within the interior of the housing.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
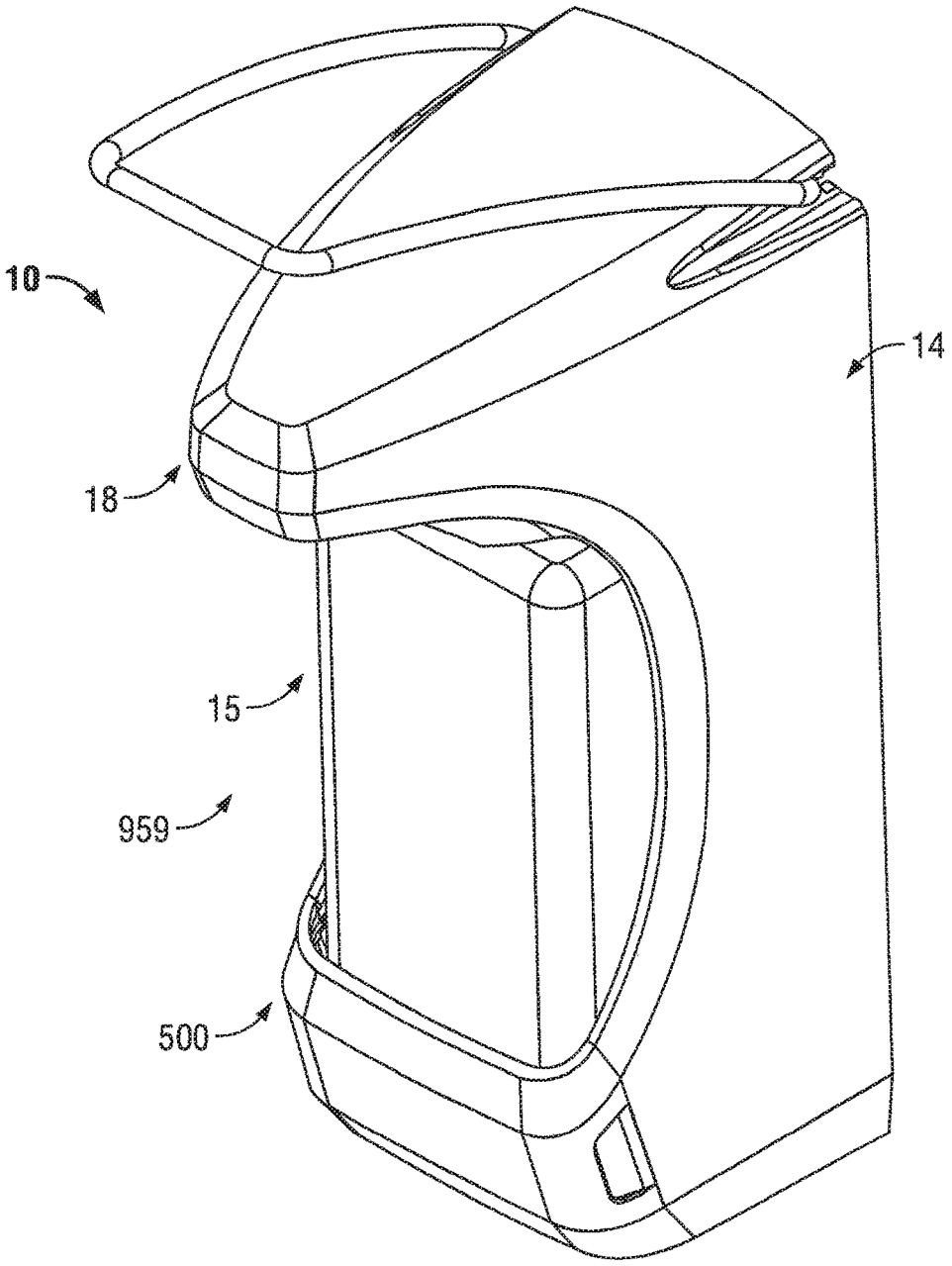
FIG. 1 is a pictorial view of a fluid dispenser assembly in accordance with a first embodiment of the present invention in an operative position.
Figure 2:
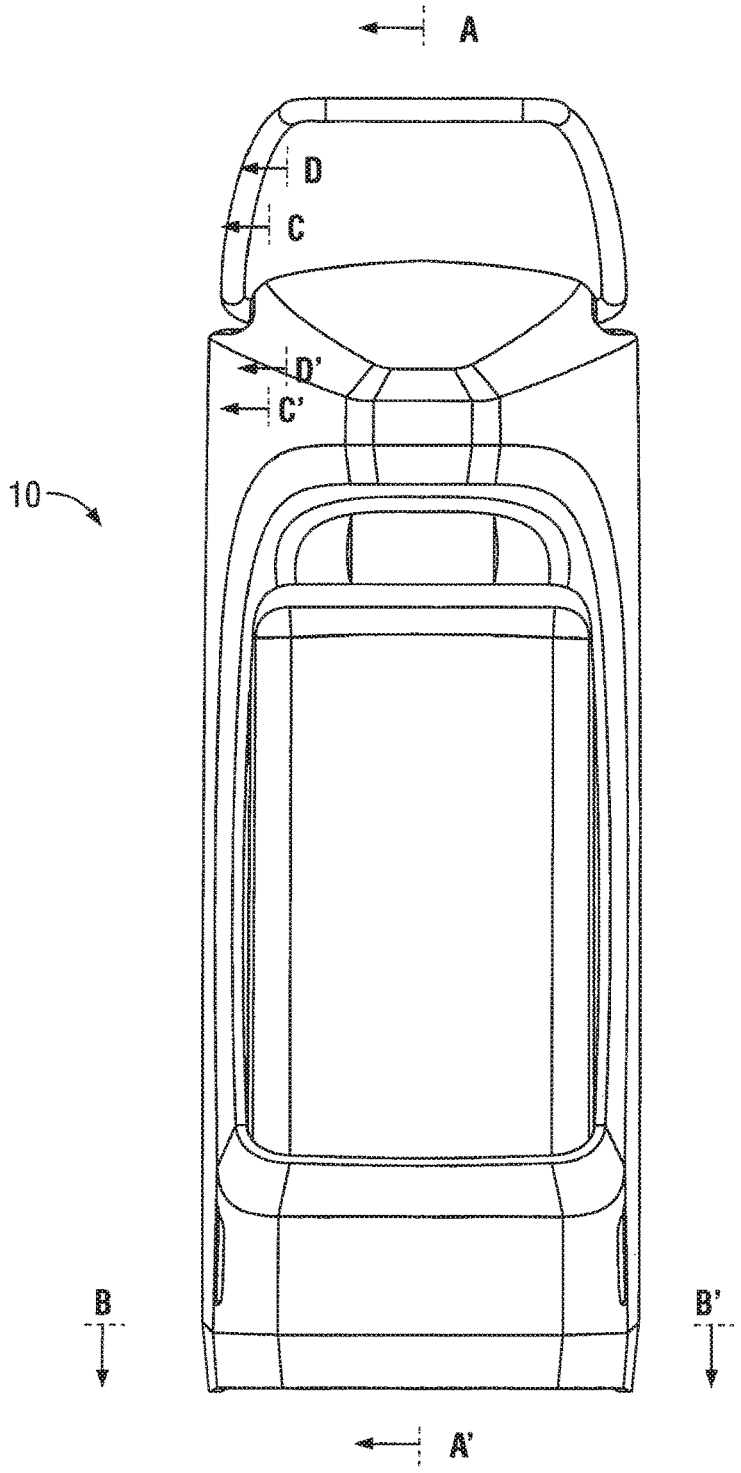
FIGS. 2 and 3 are, respectively, a front view and a right side view of the dispenser assembly of FIG. 1.
Figure 3:
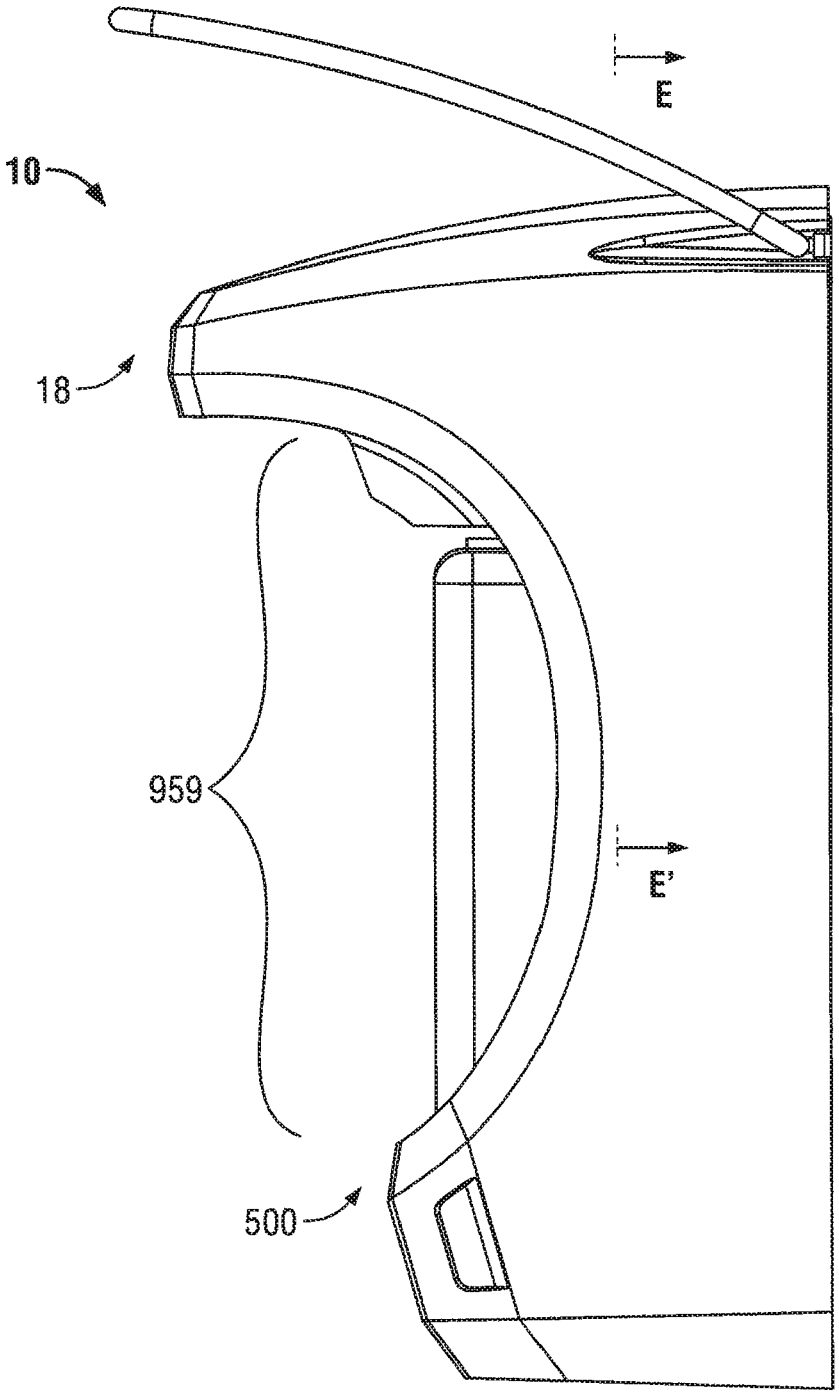

Reference is made to FIGS. 1 to 3 which illustrate a dispenser assembly 10 adapted to be secured such as onto support structure such as to a wall or a stand as by a back plate, not shown.

Figure 4:
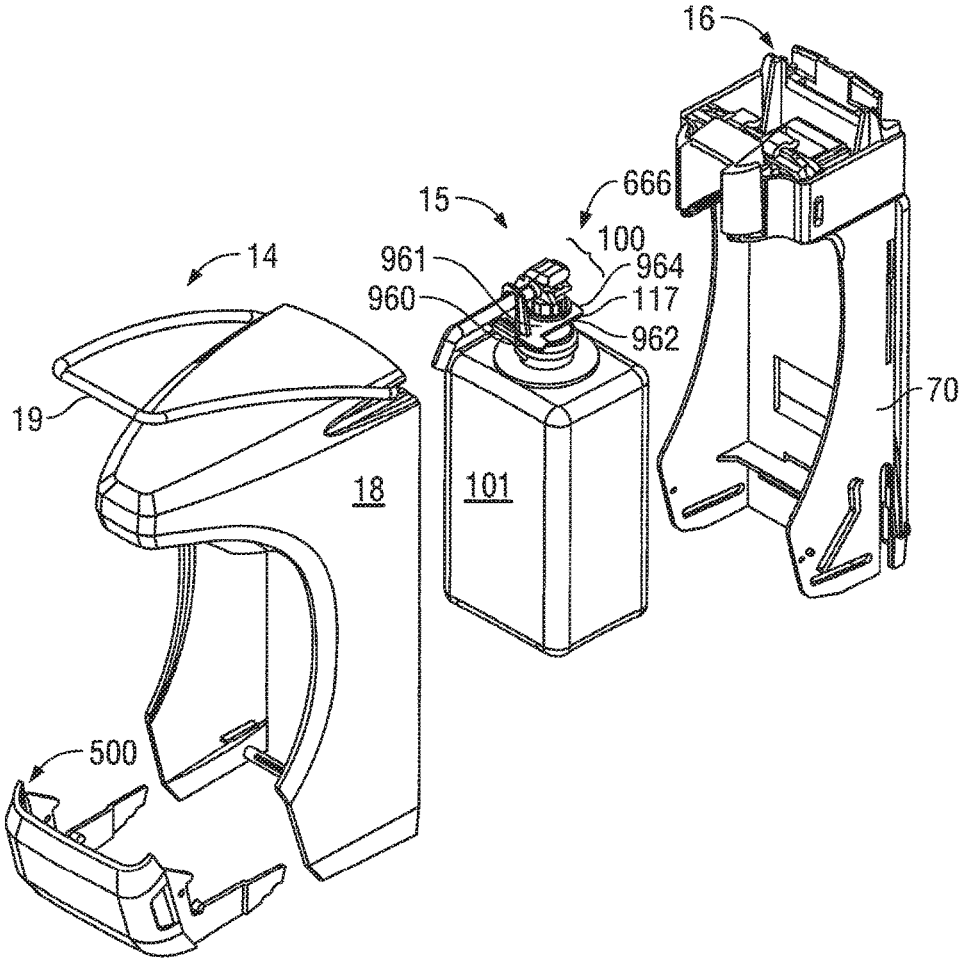
FIG. 4 is a partially exploded pictorial view of the dispenser assembly FIG. 1.

As seen in FIG. 4, the dispenser assembly 10 contains four principal components, namely, a cover assembly 14, a cartridge 15, a housing assembly 16 and a lifting or lifter member 500, also referred to as a cover actuator member 500.

Reference is made to FIG. 4 which illustrates a cartridge 15 comprising a pump mechanism 100 and a fluid reservoir also referred to as a containing bottle 101. As illustrated in FIGS. 25 and 26, when the cover assembly 14 is in an upper open position relative to the housing assembly 16, by relative horizontal movement of the cartridge 15, the cartridge 15 may be moved horizontally forwardly and rearwardly between a disengaged uncoupled condition in front of the dispenser assembly 10 as seen in FIG. 26 and to a coupled orientation seen in FIG. 25. With the cartridge 15 in the coupled orientation as in FIG. 25, the cover assembly 14 may be moved relative the housing assembly 16 from the upper open condition of FIG. 25 to a lower closed position of FIG. 24 capturing the cartridge 15 within the dispenser assembly 10 against removal in an operative position for dispensing of fluid from the bottle 101 of the cartridge 15 by activation of the pump mechanism 100 with a lever 19. The cartridge 15 includes the pump mechanism 100 and the fluid containing bottle 101 with the pump mechanism 100 and the fluid containing bottle 101 being removable and insertable together as the cartridge 15 independently. Thus what is referred to as a removable member 666 may comprise the pump mechanism 100 and/or the fluid containing bottle 101.

Figure 23:
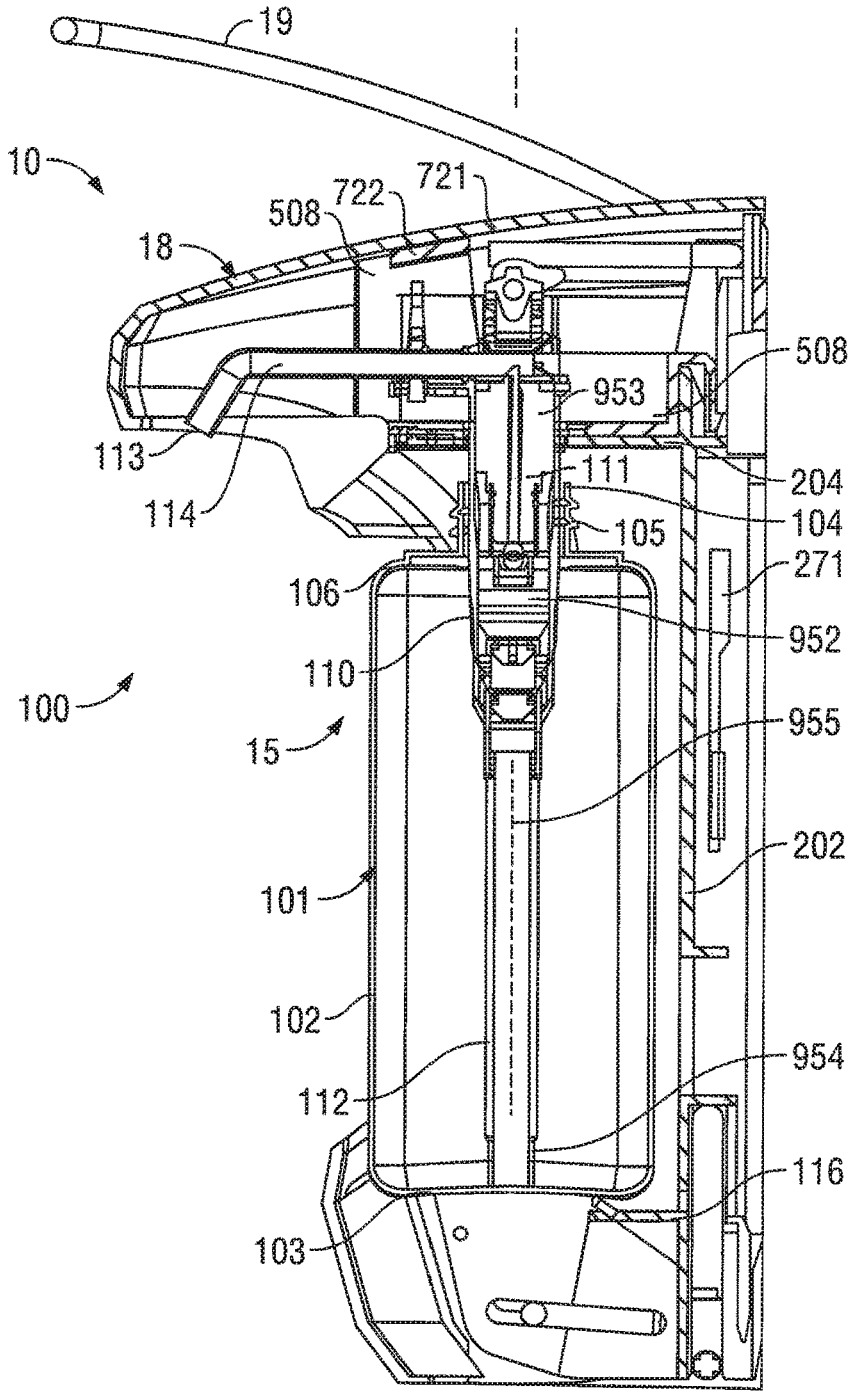
FIG. 23 is a cross-sectional side view of the dispenser assembly of FIG. 1 along section line A-A' in FIG. 2.

Reference is made to FIG. 23 illustrating a cross-sectional view along longitudinal center line A-A' in FIG. 2 showing the cartridge 15 coupled within the dispenser assembly 10 with the cover assembly 14 in the lower closed position relative to the housing assembly 16 in an operative condition ready for operation of the dispenser assembly 10 to dispense fluid.

The bottle 101 is enclosed by four side-by-side side walls 102 and a bottom wall 103 and is open merely at an upper end through an opening 104 at the top of a cylindrical neck 105 extending upwardly from a top wall 106. The pump mechanism 100 includes notably a piston chamber-forming body 110 and a piston-forming element 111. The piston-forming element 111 is coaxially slidable about a vertical axis 955 relative to the piston chamber-forming body 110 to draw fluid from the bottle via a dip tube 112 connected to the piston chamber-forming body 110 and discharge the fluid from a downwardly directed discharge outlet 113 carried at the front end of a forwardly extending discharge tube 114 that extends forwardly from and is carried by the piston-forming element 111.

The piston chamber-forming body 110 defines a fluid chamber 952 herein coaxially about the axis 955 open at an open upper end and with a lower open end in communication with fluid in the bottle 101 via the dip tube 112 which extends downwardly to a fluid inlet opening 954 open to the fluid in the bottle 101. The piston-forming element 111 has a piston portion 953 received in the fluid chamber 952 with the piston-forming element 111 extending out of the open upper end of fluid chamber 952 to the discharge outlet 113 carried on the piston-forming element 111.

When the cover assembly 14 is in the raised upper position relative the housing assembly 16 as seen in FIGS. 25 and 26, the cartridge 15 is horizontally slidable rearwardly to engage with the housing assembly 16 such that the bottle 101 comes to be received within an interior 46 defined within the housing 70 with the bottom of the bottle 101 engaged and supported by a bottle support flange 116.

The piston chamber-forming body 110 carries a horizontally extending support plate 117 that extends radially relative the axis, preferably normal to the axis 955 as shown, outwardly from piston chamber-forming body 110 laterally to the left and the right. External portions of the piston-forming element 111 extend upwardly from the piston chamber-forming body 110 above the support plate 117. The piston-forming element 111 is vertically slidably engaged within the piston chamber-forming body 110 for coaxial vertical reciprocal sliding about the vertical axis 955 and with an internal spring (not shown) biasing the piston-forming element 111 vertically upward relative to the piston chamber-forming body 110.

Figure 41:
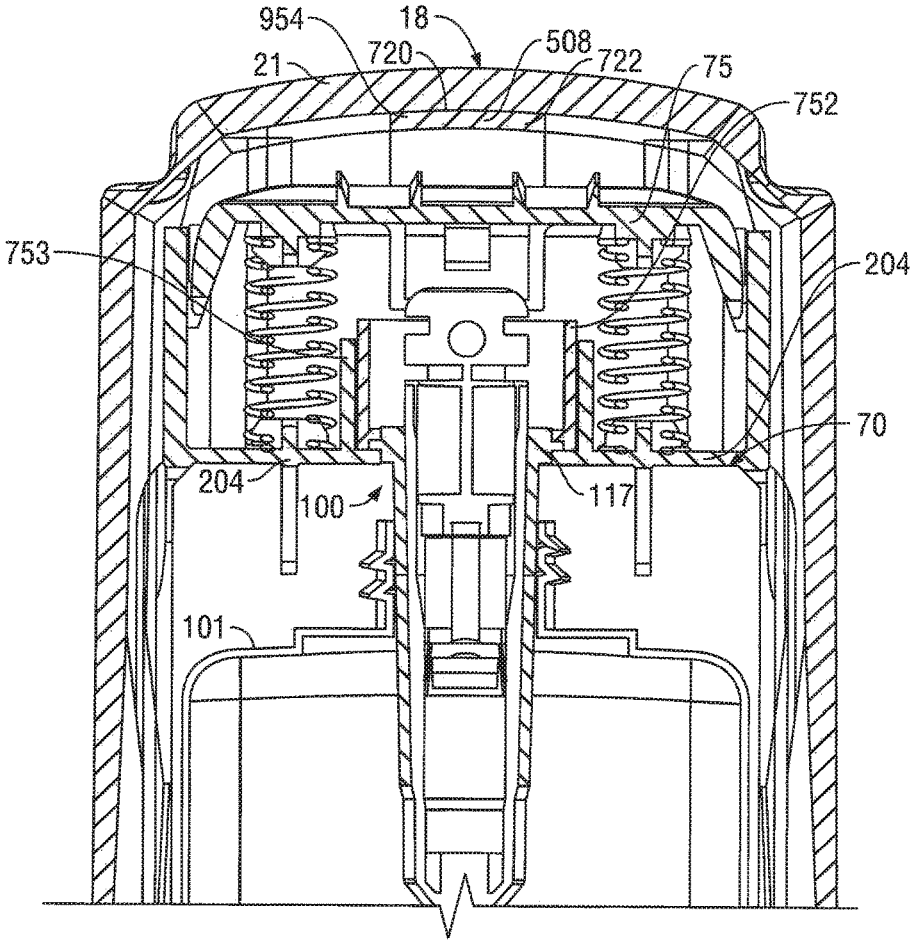
FIG. 41 is a front cross-sectional view of an upper portion of the dispenser assembly of FIG. 2 along section line E-E' on FIG. 3.
Figure 42:
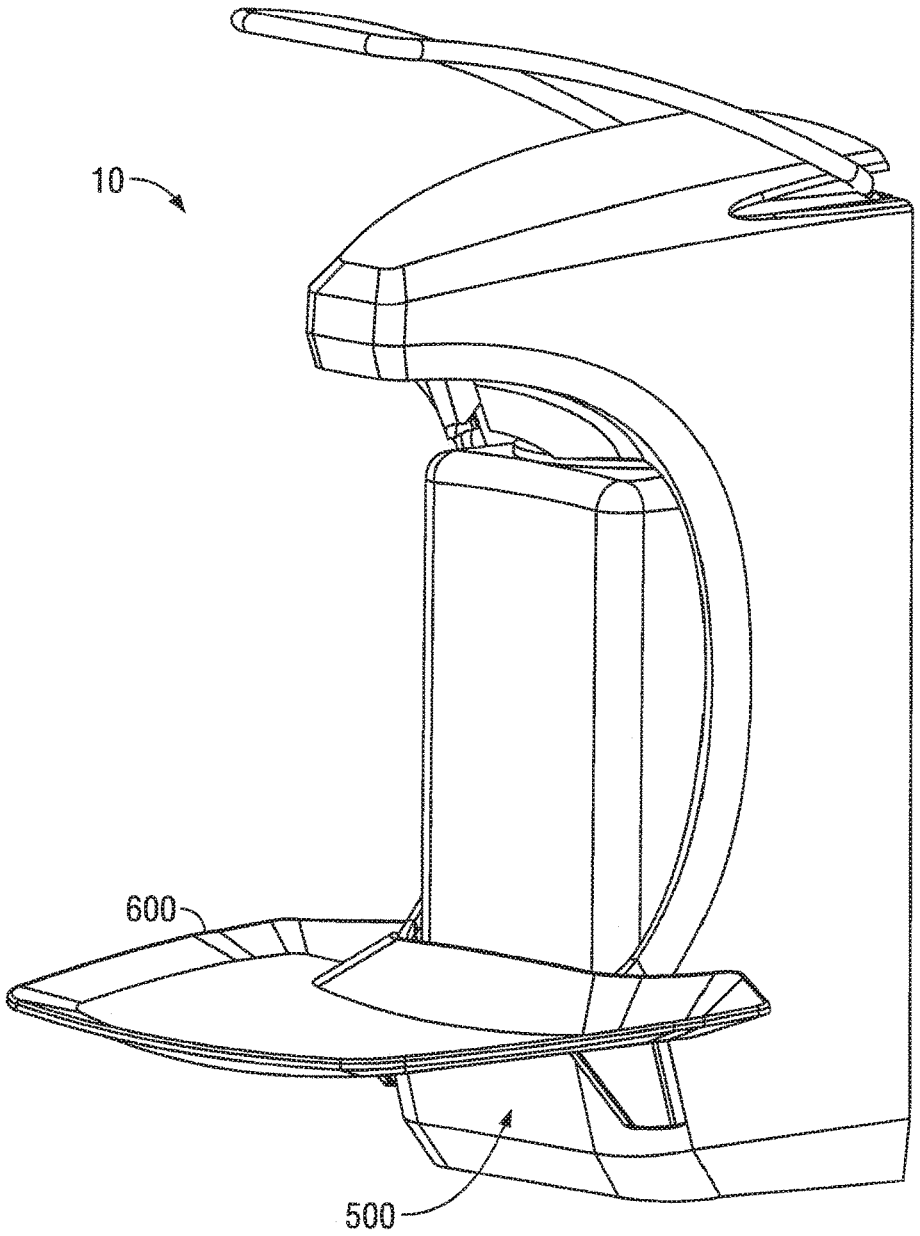
FIG. 42 is a pictorial view of a fluid dispenser assembly in accordance with a second embodiment of the present invention in an operative position.
Figure 43:
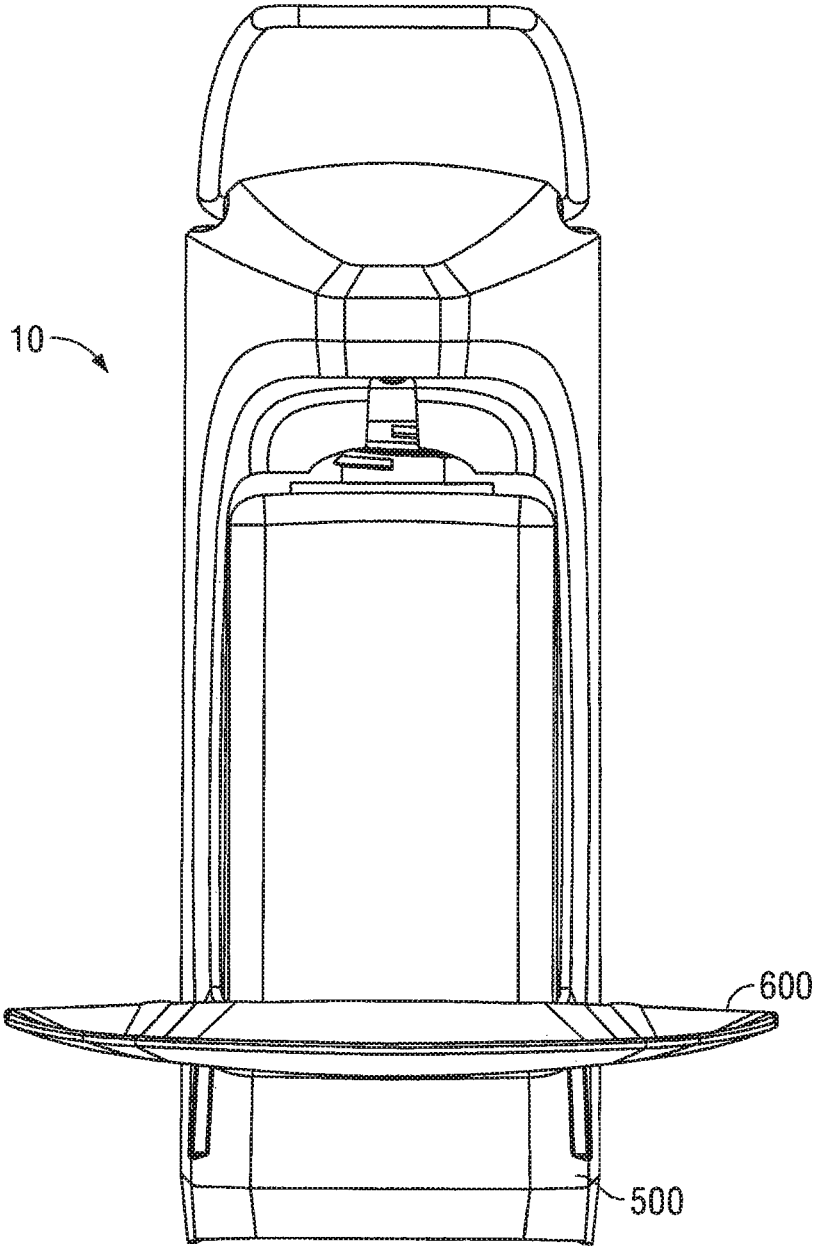
FIGS. 43 and 44 are, respectively, a front view and a right side view of the dispenser assembly of FIG. 43.
Figure 44:
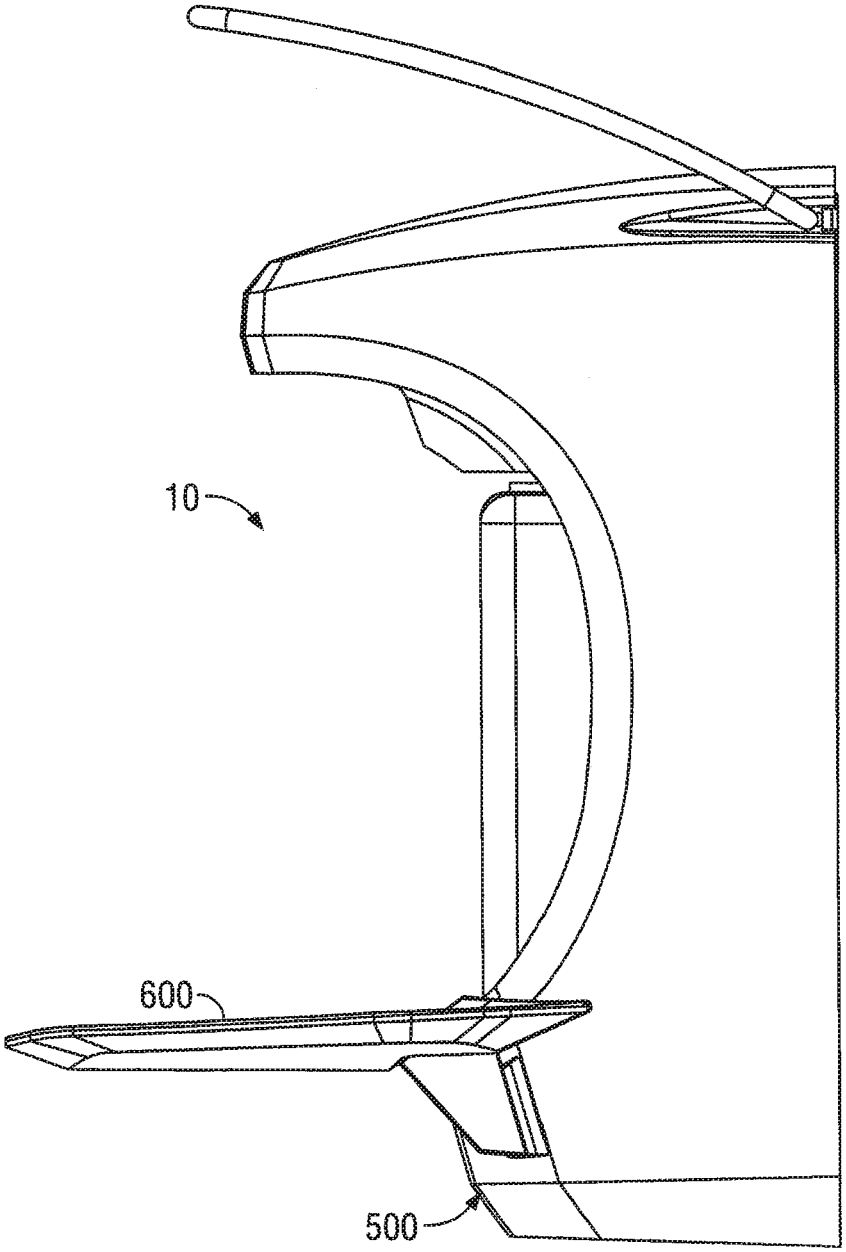
Figure 45:
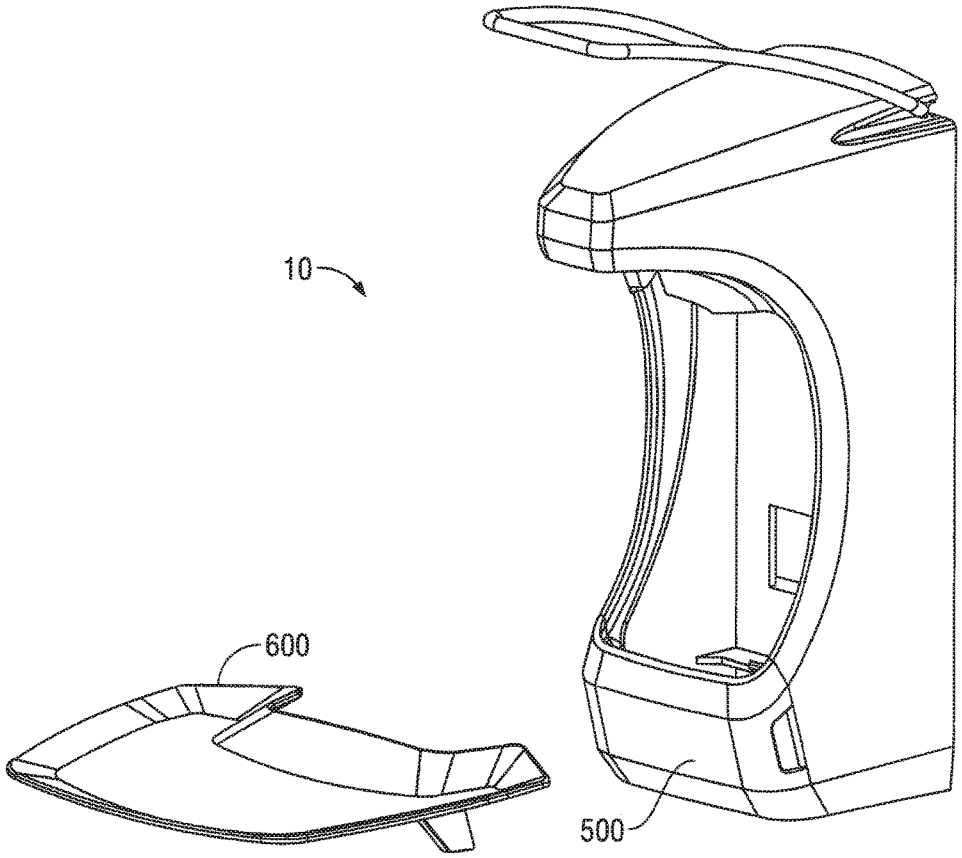
FIG. 45 is a partially exploded pictorial view of the dispenser assembly FIG. 42.
Figure 46:
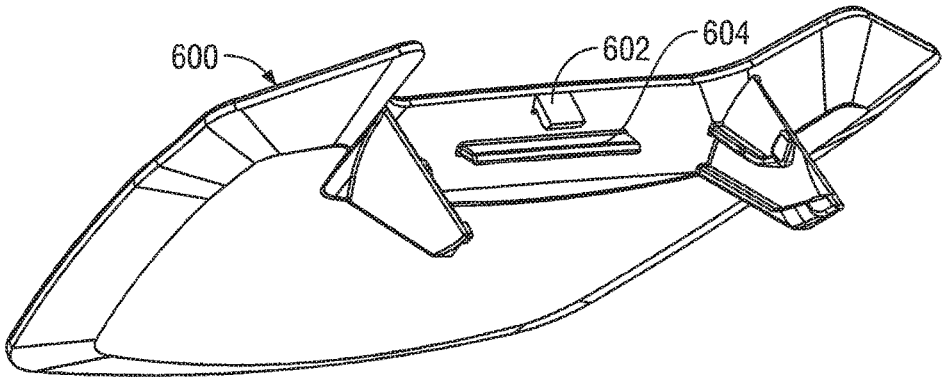
FIG. 46 is a rear pictorial view of the drip tray in FIG. 42.

As seen on FIG. 41, the support plate 117 has a forwardly directed stopping surface 960, an upwardly directed plate surface 961, a downwardly directed plate surface 962 and a rearwardly directed cam surface 964.

Figure 39:
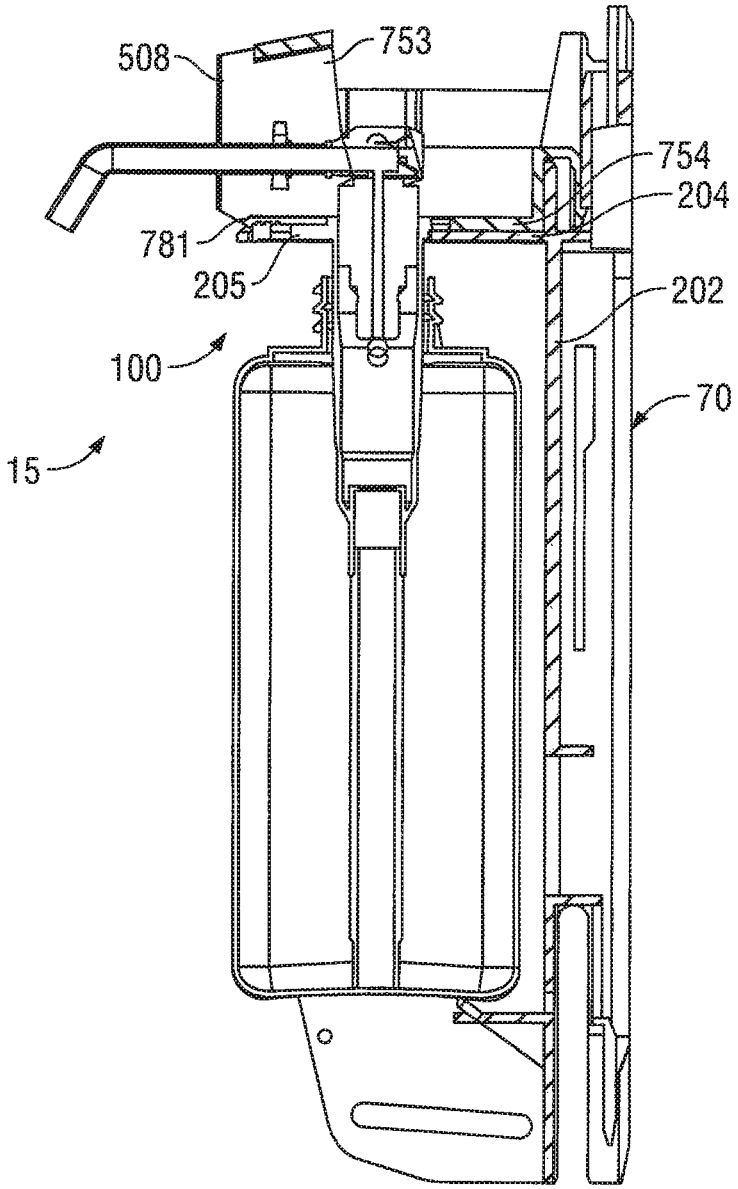
FIG. 39 is a cross-sectional side view along section line A-A' in FIG. 2 showing upper pump holding member on the housing as in FIG. 37, and also showing the cartridge.
Figure 40:
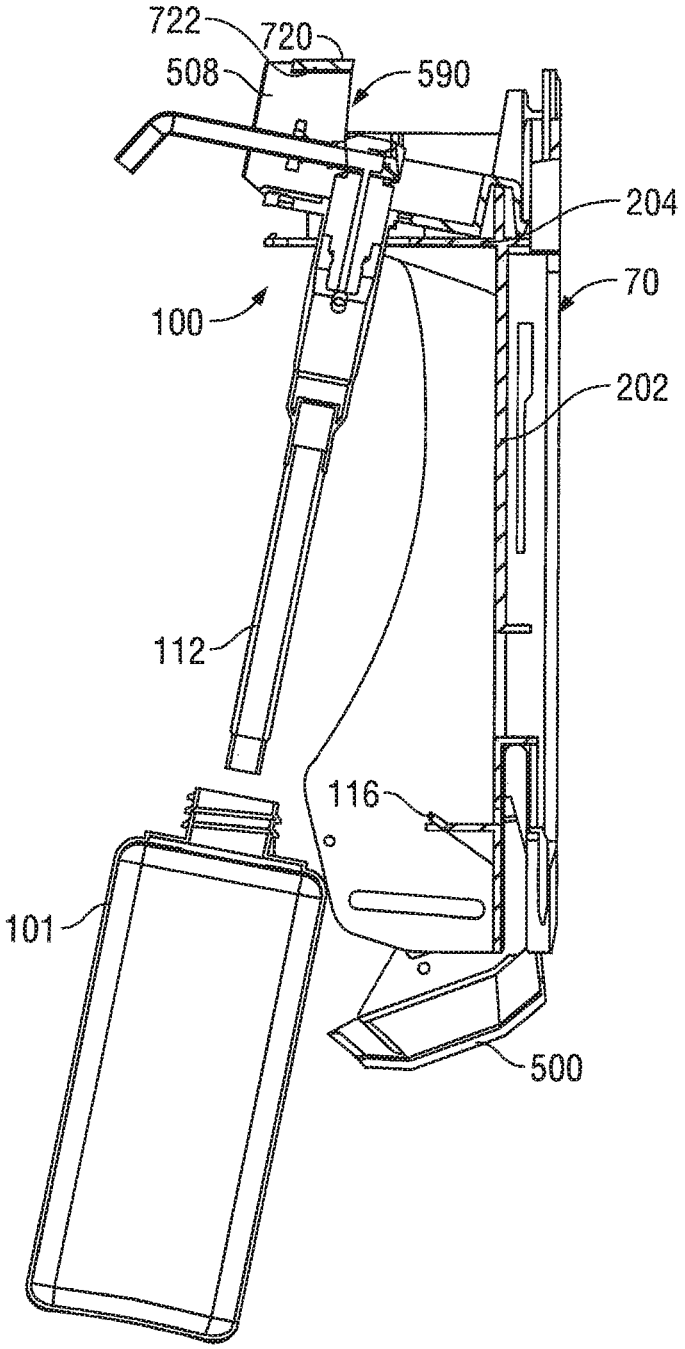
FIG. 40 is a cross-sectional side view the same as FIG. 38 showing upper pump holding member pivoted on the housing as in FIG. 38, and also showing the cartridge with the bottle axially displaced from the pump and the lifting member in an open position.

The cartridge 15 is adapted to be removed and replaced preferably by a new entire cartridge 15 as seen in FIGS. 25 and 26, however, possibly with the bottle 101 being removed from the cartridge 15 and refilled. Removal and replacement of merely the bottle 101 is possible such as illustrated in FIGS. 39 and 40 when the dip tube 112 may be rigid the bottle 101 removed the pump mechanism 100 may be separately removed and replaced. Removal and replacement is carried out with the cover assembly 14 in the upper open opposition relative the housing assembly as seen FIGS. 25 and 26.

Figure 5:
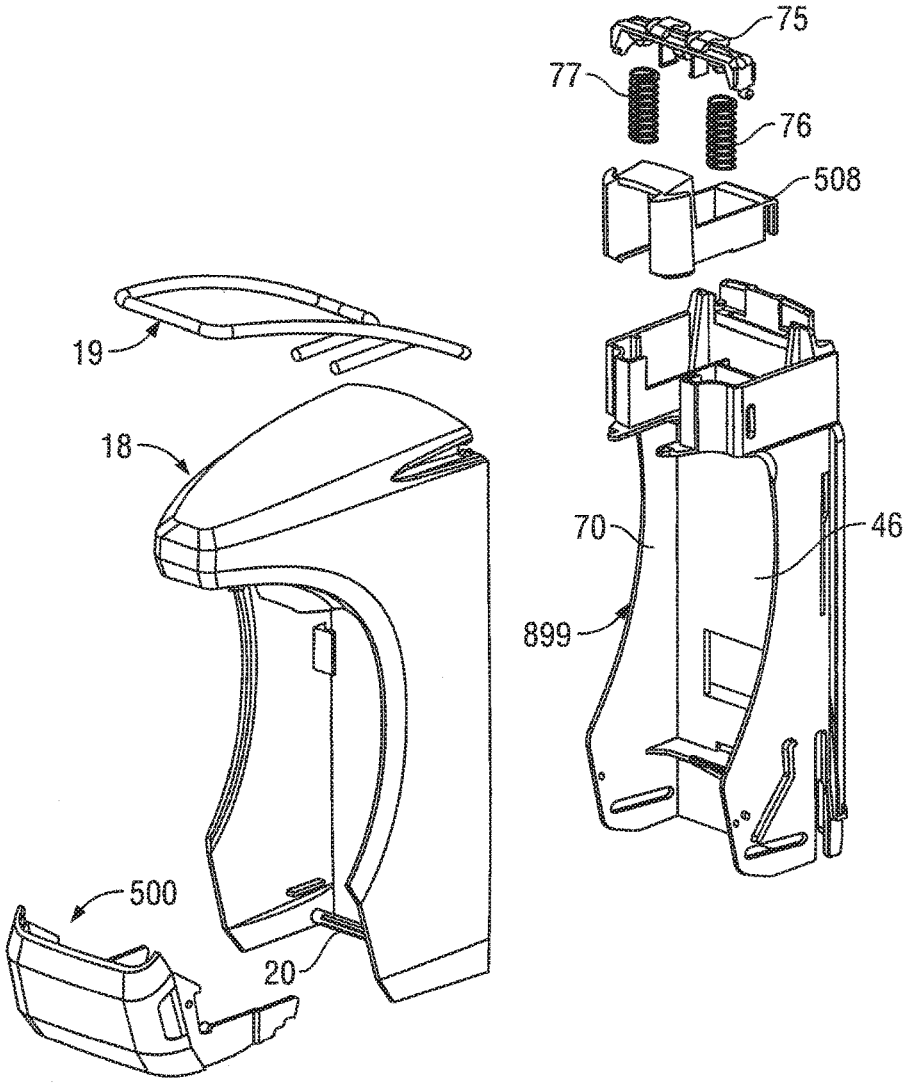
FIG. 5 is a fully exploded pictorial view of the dispenser assembly FIG. 1.
Figure 6:
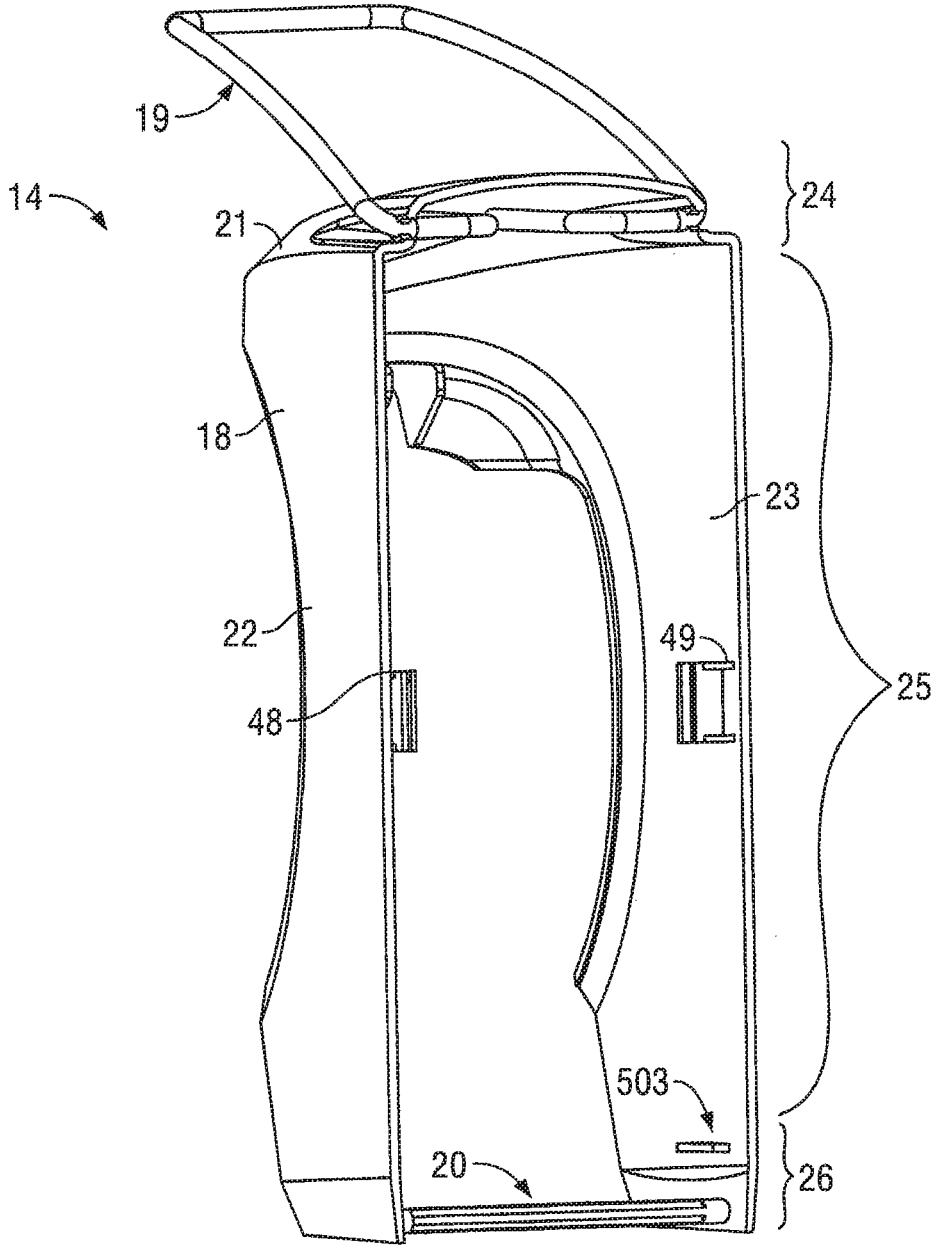
FIG. 6 is a rear pictorial view of the cover assembly in FIG. 4.

As seen in FIGS. 5 and 6, the cover assembly 14 includes a cover 18, the lever 19 and a rod member 20. Referring to FIG. 6, the cover 18 includes a top wall 21, a right cover side wall 22 and a left cover side wall 23. The right cover side wall 22 and the left cover side wall 23 are secured together spaced laterally from each other by being connected at an upper end by the top wall 21 and a lower end by the rod member 20. The rod member 20 is preferably a cylindrical member bridging between the side walls 22 and 23 and each end of the rod member 20 is fixedly secured to a lower portion 26 of each of the side walls 22 and 23. In the preferred embodiment, the cover assembly 14 including the cover 18 and the lever 19 is each symmetrical about a central longitudinal plane along section line A-A' in FIG. 2. Each of the side walls 22 and 23 has a top portion 24 and a lower portion 26 with an intermediate portion 25 bridging between the top portion 24 and the lower portion 26.

Figure 8:
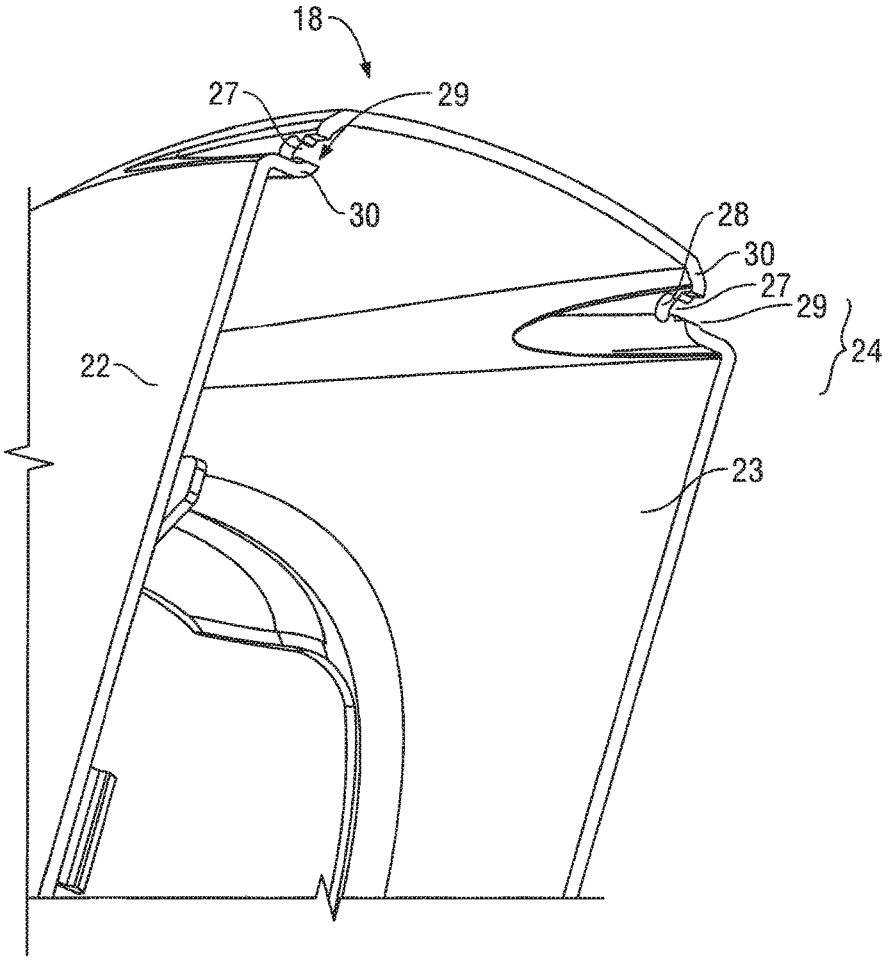
FIG. 8 is a rear pictorial view of an upper rear portion of the cover of FIG. 7.
Figure 9:
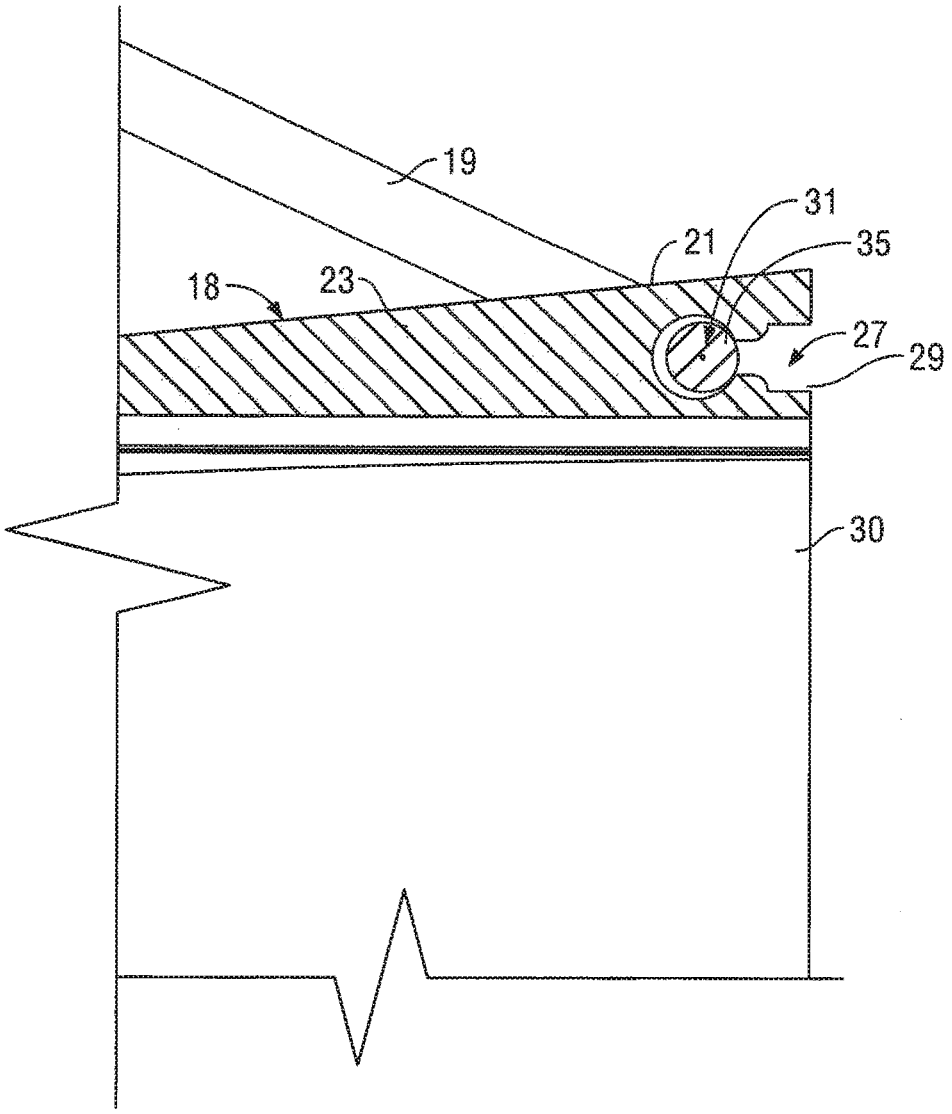
FIG. 9 is a right cross-sectional side view of an upper rear portion of the cover assembly of FIG. 6 along vertical section line C-C' on FIG. 1.

As best seen in FIGS. 8 and 9, in the top portion 24 of each of the side walls 22 and 23, there is provided an identical axle keyway opening 27 that extends laterally through the respective side wall 22 and 23. Each axle keyway opening 27 has an enlarged journaling bore 28 and entry/exit slot 29. Each slot 29 is open into the bore 28, extends from the bore 28 to a rear edge 30 of each of the side walls 22 and 23 where each slot 29 is open through the edge 30.

The cover 18 about each slot 29 is resilient and has an inherent bias to adopt an inherent configuration as shown in FIGS. 8 and 9. The cover 18 about each slot 29 is deflectable from the inherent configuration to deflected conditions in which the slots 29 increase in width to permit the coupling and uncoupling of the lever 19 with the cover 18.

Figure 7:
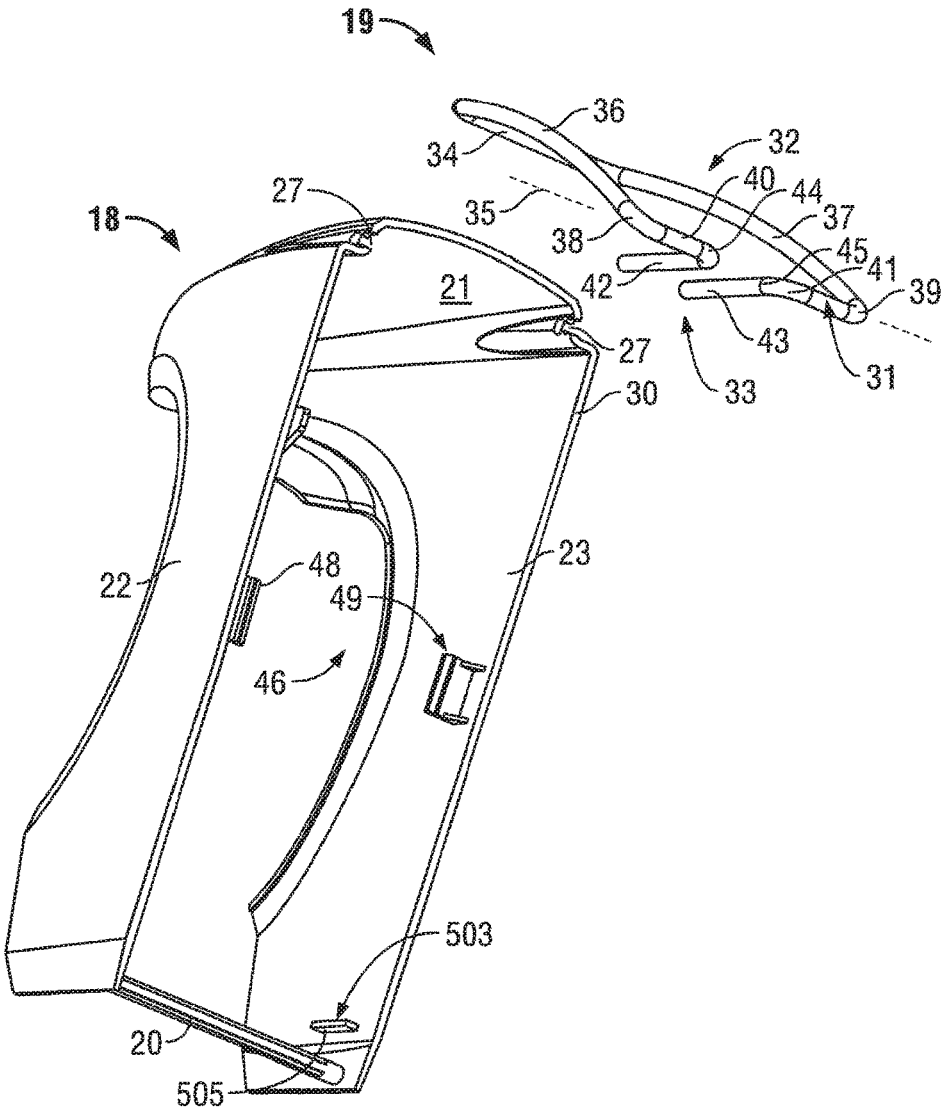
FIG. 7 is a rear exploded pictorial view of a cover and a lever of the cover assembly of FIG. 6.

Referring to FIG. 7, the lever 19 has an exterior handle portion 32, an axle 31 and an interior actuator portion 33. The exterior handle portion 32 comprises a U-shaped member with a forward bight 34 which merges rearwardly into a right arm 36 and a left arm 37. The right arm 36 is connected at its rear to an outer right end 38 of a right segment 40 of the axle 31. The left arm 37 extends rearwardly to join with an outer left end 39 of a left segment 41 of the axle 31. The axle 31 including both the right segment 40 and the left segment 41 is coaxial about an axle axis 35. The interior actuator portion 33 includes a right activator rod 42 which extends forwardly from an inner right end 44 of the right segment 40 of the axle 31. The interior actuator portion 33 includes a left activator rod 43 which extends forwardly from an inner left end 45 of the left segment 41 of the axle 31. The right activator rod 42 and the left activator rod 43 are disposed in the same plane.

The lever 19 is removably coupled to the cover 18 by reason of the axle 31 of the lever 19 being removably coupled within the axle keyway openings 27 in the side walls 22 and 23. The bore 28 of each keyway opening 27 is sized to receive the axle 31 of the lever 19 therein and journal the lever 19 for rotation of the lever 19 about the axle axis 35 relative the cover 18. The right segment 40 of the axle 31 is received within the bore 28 of the keyway opening 27 of the right cover side wall 22 and the left segment 41 of the axle 31 is received within the bore 28 of the keyway opening 27 of the left cover side wall 23.

The axle 31 is removably received within the bores 28 in a snap-fit. The cover 18 about each slot 29 is resilient with its inherent bias adopting the inherent configuration as seen in FIGS. 8 and 9 in which the slot 29 is sized to retain the axle 31 in the bore 29 against removal. The cover 18 about the slot 29 is deflectable from the inherent configuration to deflected conditions which permit passage of the axle 31 through the slot 29 either into or out from the bore 29 for coupling and uncoupling of the lever 19 and the cover 18. The axle 31 is received coaxially within the bores 28 of the keyway openings 27 against removal under forces less than a threshold force required to deflect the cover 18 about each slot 29 from the inherent condition to deflected conditions which permit passage of the axle 31 through each slot 29 for removal of the axle 31 from the keyway openings 27 of the cover 18. The cover assembly 14 is removably coupled to the housing assembly 16 for coupling and uncoupling of the cover assembly 14 to the housing assembly 16 while the lever 19 is coupled to the cover 18. After the cover assembly 14 is uncoupled from the housing assembly 16, the lever 19 and the cover 18 may be disengaged and separated from each other by removing the axle 31 from the keyway openings 27.

The cover 18 defines an interior compartment 46 between the right cover side wall 22 and the left cover side wall 23. When the lever 19 is coupled to the cover 18 with the axle 31 journalled in keyway openings 27, the interior actuator portion 33 is within the interior compartment 46 coupled to the axle 31 and the exterior handle portion 32 extends forwardly exterior of the interior compartment 46. The lever 19 is removable from being coupled with the cover 18 by rearward movement of the lever 19 moving the axle 31 rearwardly out of the keyway openings 27 through the rear edges 30 of the side walls 22 and 23, moving the interior actuator portion 33 rearwardly from within the interior compartment 46 out the open rear of the cover 18. The right arm 36 and the left arm 37 of the exterior handle portion 32 are spaced laterally so as to permit the top wall 21 and top portions 24 of the side walls 22 and 23 of the cover 18 to pass downwardly and forwardly between the right arm 36 and the left arm 37 to assist coupling and uncoupling of the lever 19 with the cover 18. In the preferred embodiment, as shown in FIG. 7, the cover 18 is open at a rear of the cover and the keyway openings 27 are open to the rear edge 30 of the cover 18.

In alternative embodiments, however, the keyway opening 27 may open to an edge of each side wall that constitutes an upwardly directed upper edge.

Figure 10:
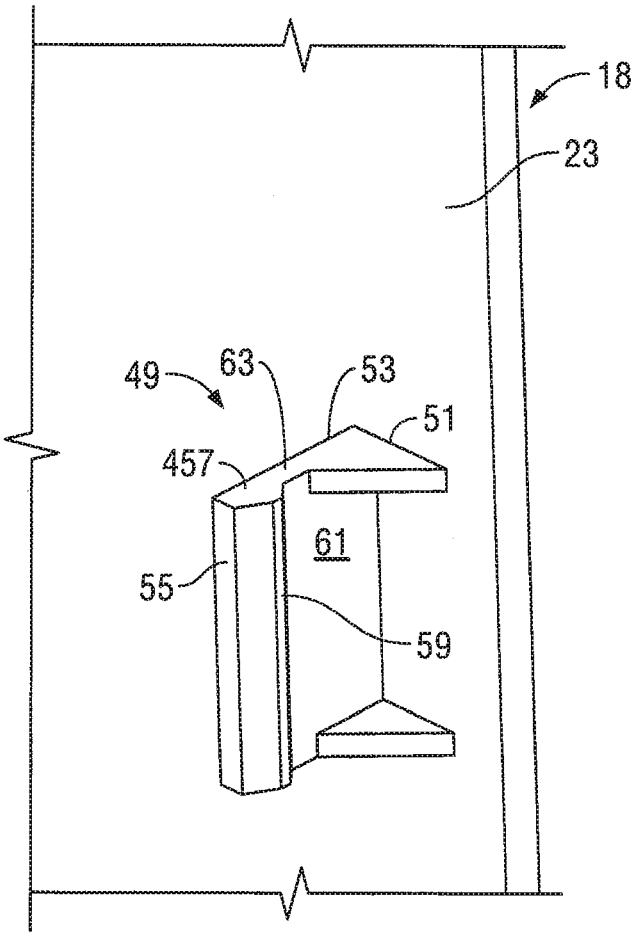
FIG. 10 is a rear pictorial view of a left latch member on a left cover side wall of the cover of FIG. 7 as viewed downwardly and from above.

Referring to FIGS. 7 and 10, on the intermediate portion 25 of the right cover side wall 22, there is provided a right latch member 48 and on the intermediate portion 25 of the left cover side wall 23, there is provided a left latch member 49. Each of these latch members 48 and 49 extend laterally inwardly. The left latch member 49 is fixedly secured at a laterally outer end 51 to the left cover side wall 23 and extends laterally inwardly from the outer end 51 laterally inwardly to a distal inner end 55 formed as an enlarged bulbous portion 57 which presents a laterally outward facing side surface 59 merging into a rearwardly facing latch surface 61. The left latch member 49 has a forward facing latch surface 53. A reduced thickness portion 63 is defined between the forwardly facing latch surface 53 and the rearwardly facing latch surface 61. Similarly, the right latch member 48 is fixedly secured at a laterally outer end to the right cover side wall 22 and extends laterally inwardly from the outer end laterally inwardly to a distal inner end formed as an enlarged bulbous portion which presents a laterally outward facing side surface merging into a rearwardly facing latch surface. The right latch member 48 has a forward facing latch surface. A reduced thickness portion is defined between the forwardly facing latch surface and the rearwardly facing latch surface.

Figure 11:
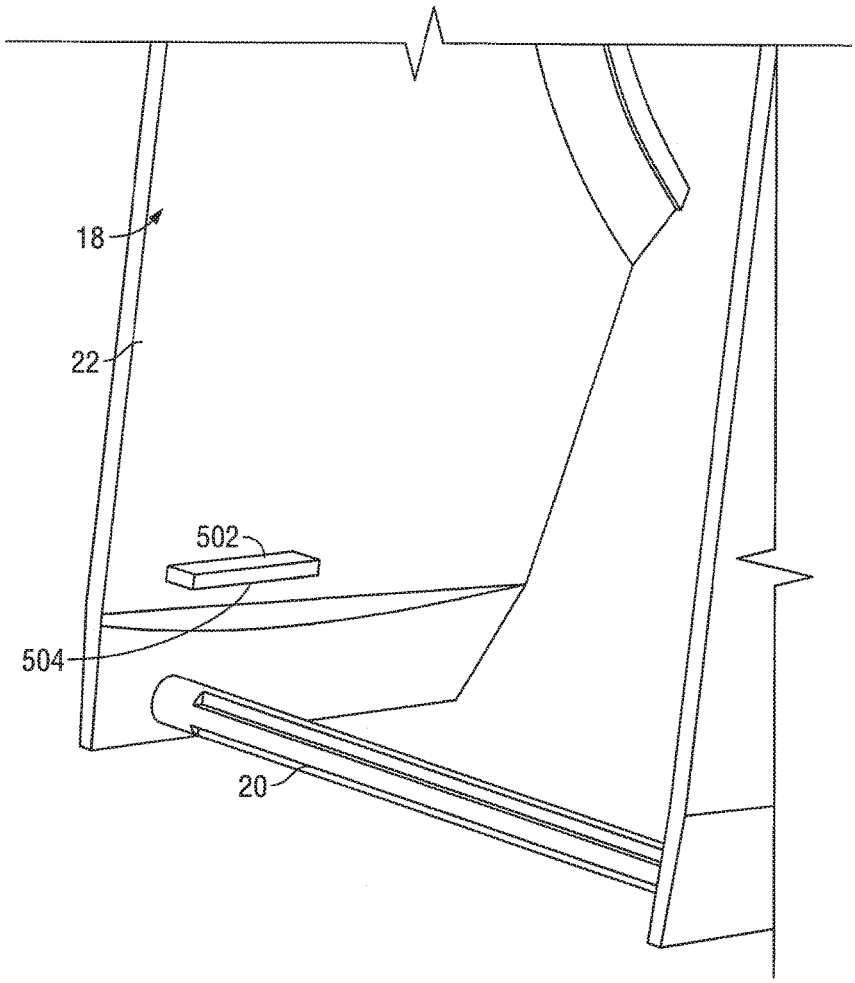
FIG. 11 is a rear pictorial view of a right lift flange on a right cover side wall of the cover of FIG. 7 as viewed downwardly and from above.

Referring to FIG. 11, on the lower portion 26 of the right cover side wall 22, there is provided a right lifter flange 502 and on FIG. 7 on the lower portion 26 of the left cover side wall 23, there is provided a left lifter flange 503. Each of these lifter flanges 502 and 503 extend laterally inwardly and each presents a respective downwardly directed lift cam surface 504 and 505, respectively.

Figure 12:
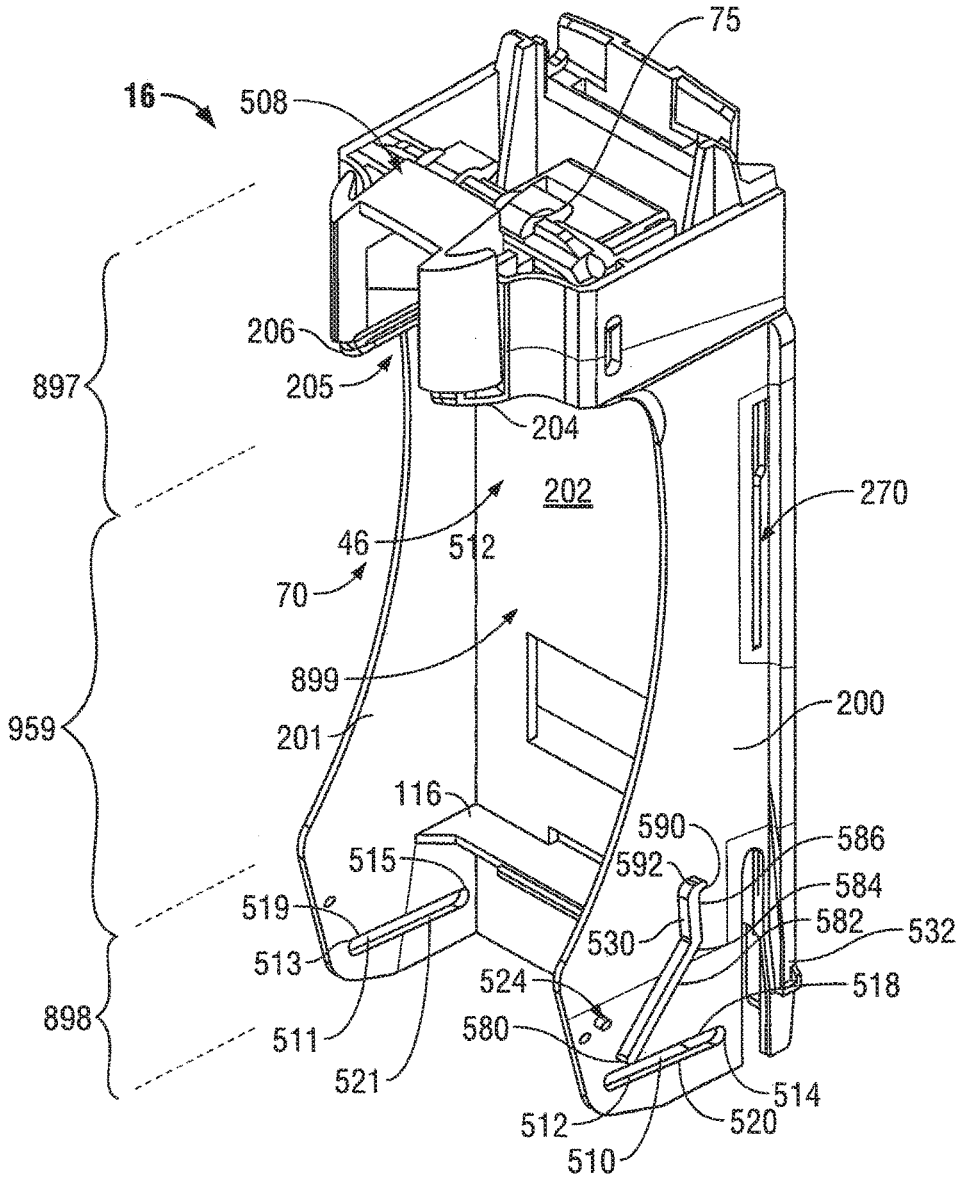
FIG. 12 is a front pictorial view of the housing assembly in FIG. 4.
Figure 13:
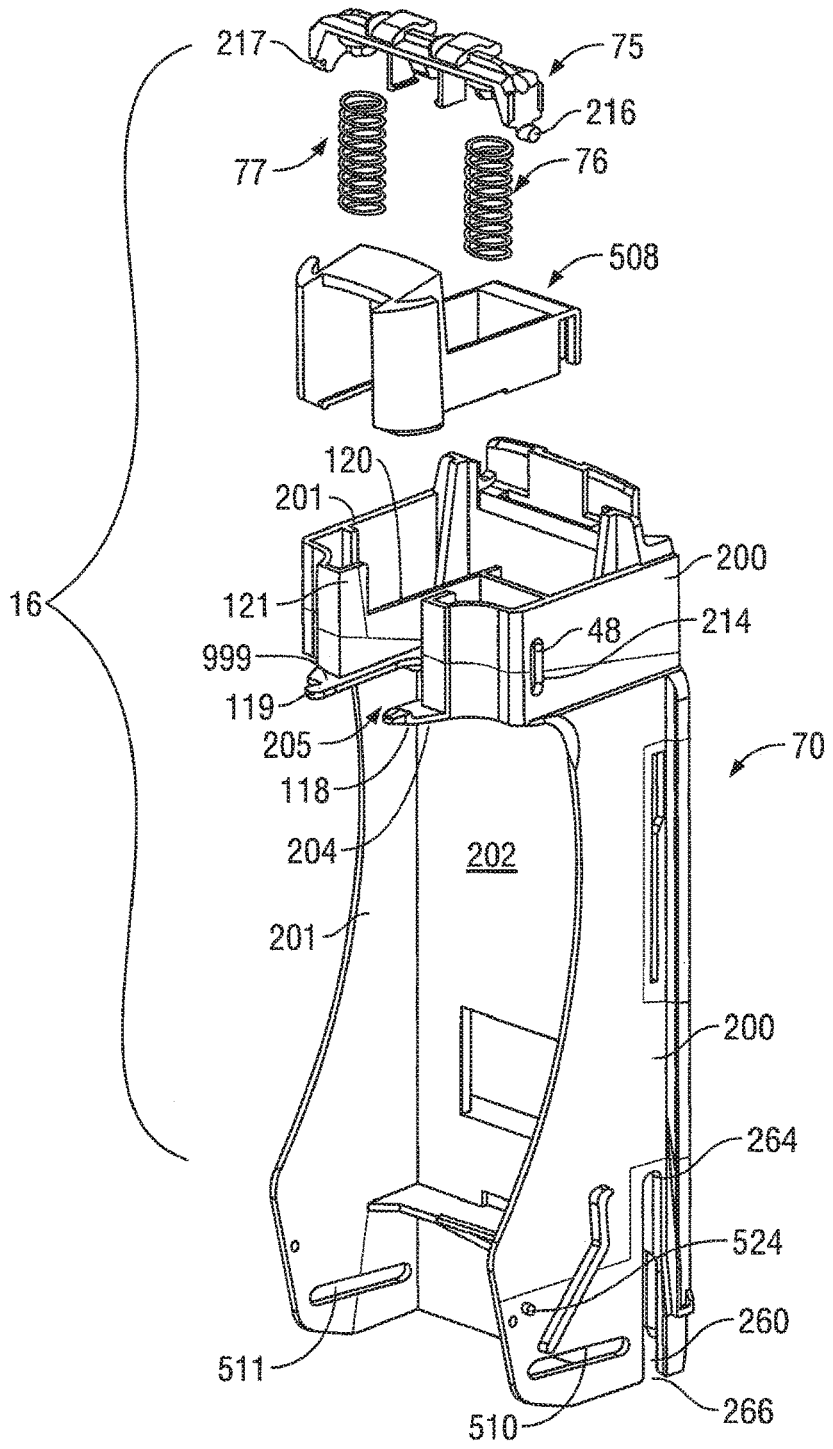
FIG. 13 is an exploded pictorial view of the housing assembly of FIG. 12 as viewed looking rearwardly and downwardly from the right.
Figure 14:
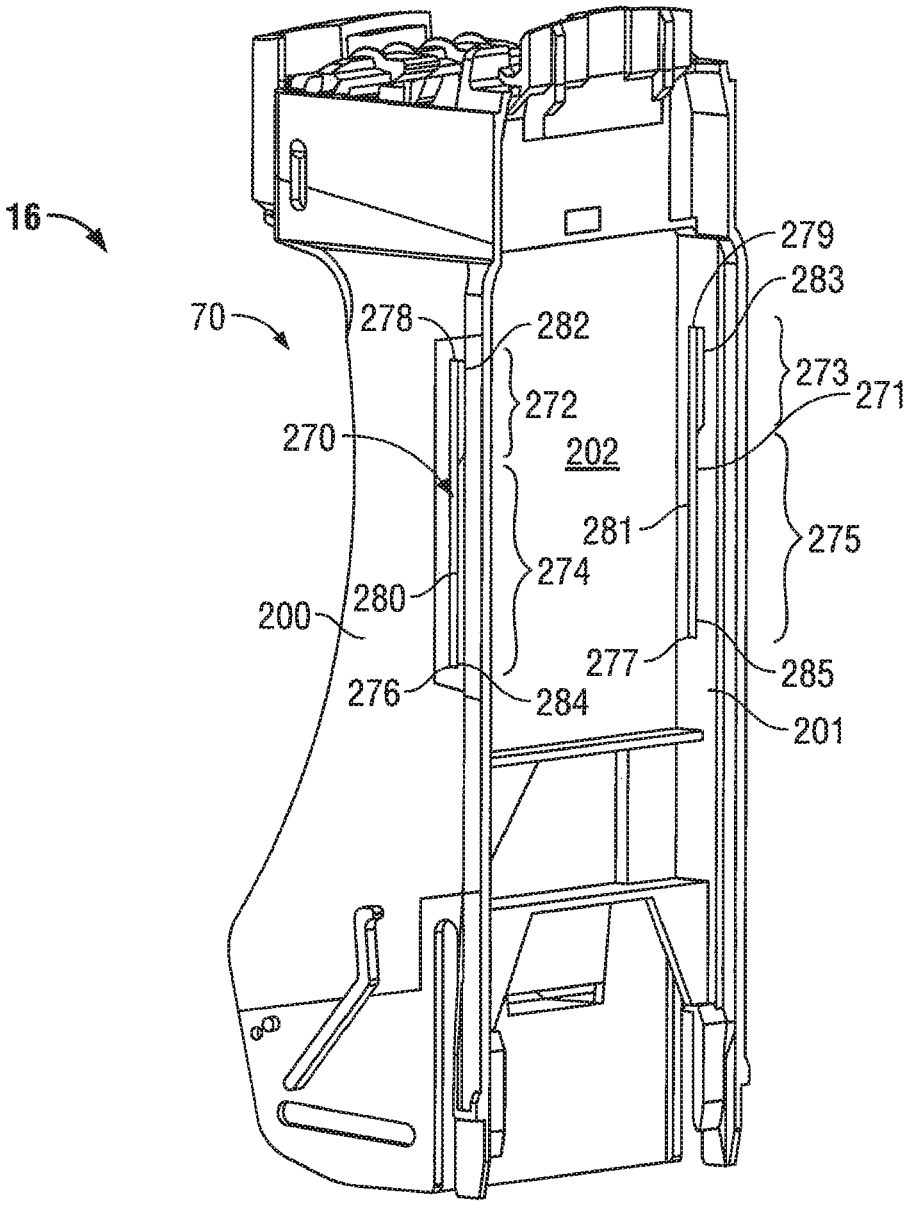
FIG. 14 is a rear pictorial view of the housing assembly in FIG. 12 as seen from the right.
Figure 15:
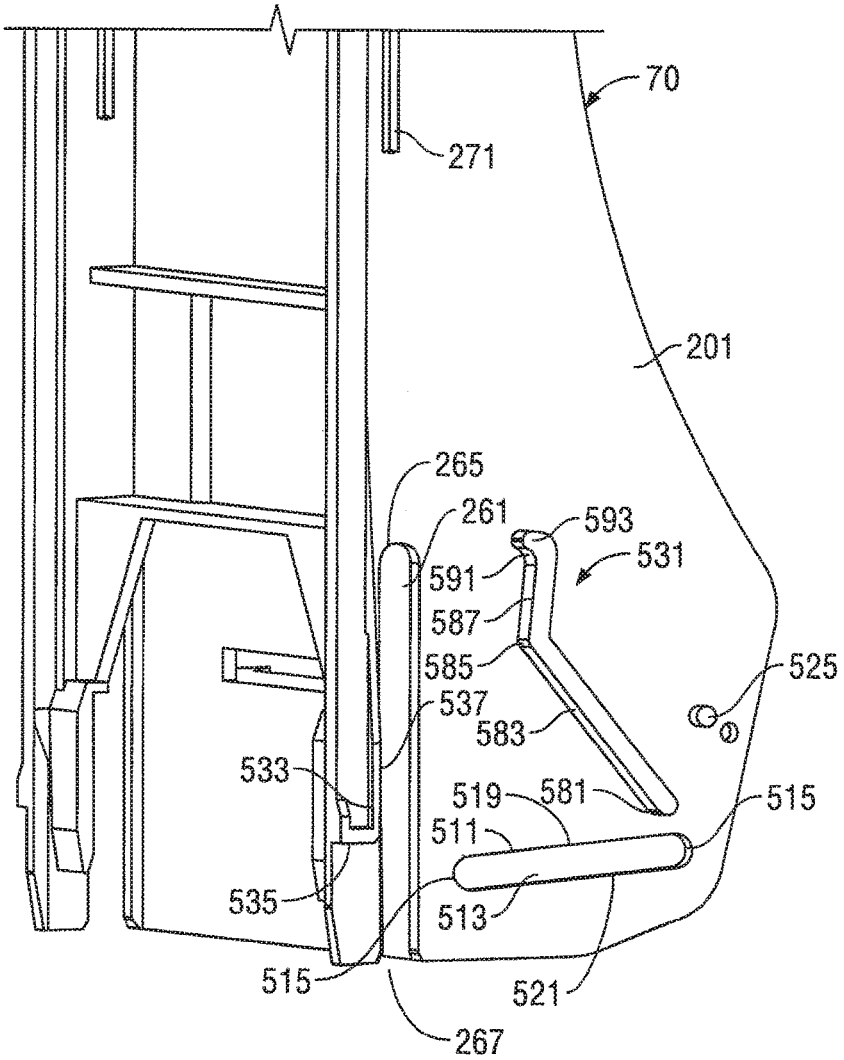
FIG. 15 is an enlarged rear pictorial view of a lower portion of the housing shown in FIG. 12 as seen from the left.

Reference is made to FIGS. 12 to 18. FIG. 12 shows the housing assembly 16 in an assembled condition. FIG. 13 shows the housing assembly 16 in an exploded condition. As seen in FIG. 13, the housing assembly 16 includes a housing 70, a pump actuator plate 75, a pair of right and left plate springs 76 and 77 and an upper pump holding member 508.

The housing 70 has a housing right side wall 200 and a housing left side wall 201 which are fixedly secured together joined by a back wall 202 which bridges between the housing side walls 200 and 201. Proximate an upper end of the housing side walls, a horizontal support flange 204 extends horizontally between the housing side walls and is secured to the back wall 202. The support flange 204 has an upwardly directed support surface 999 as best seen on FIG. 37. A slot 205 extends from an opening in a front edge 206 of the support flange 204 rearwardly to a blind rear end 207 seen in FIG. 37. A pair of left and right vertical guide walls 120 and 121 extend forwardly from the back wall 202 on either side of the slot 205 and upwardly from the support flange 204 spaced laterally outwardly from their respective lateral side of the slot 205.

Referring to FIG. 13 the upper pump holding member 508 is adapted to be engaged on the housing 70 between the side walls 120 and 121 above the support flange 204 so as to sandwich a support plate 117 of the piston chamber-forming body 110 of the pump mechanism 100 shown on FIG. 4 between the support flange 204 and the upper pump holding member 508.

Figure 37:
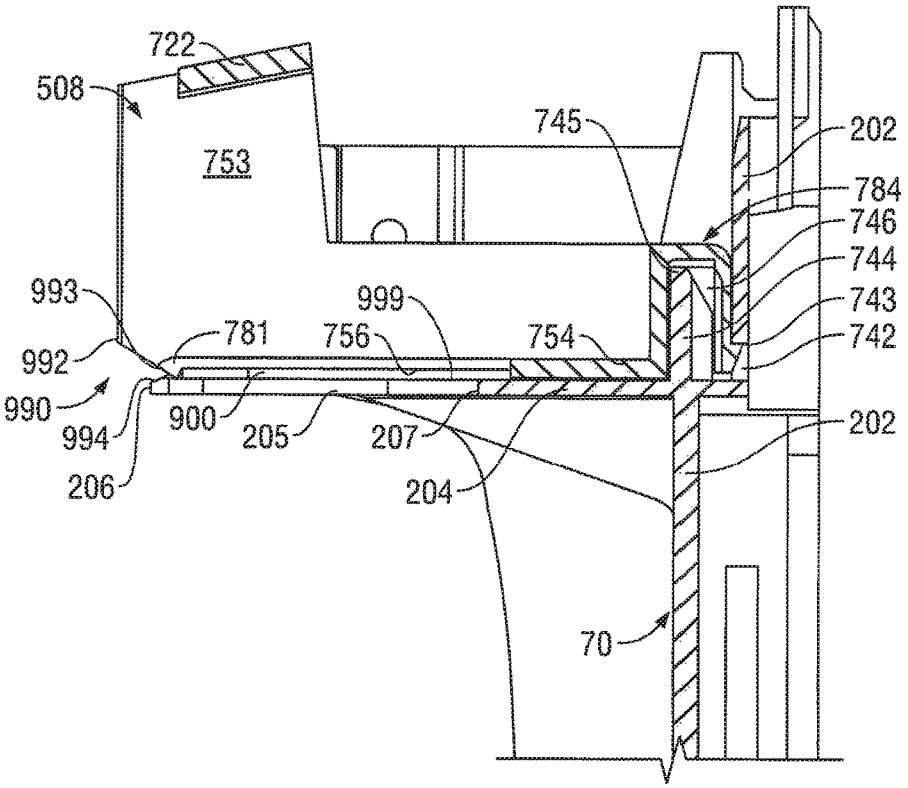
FIG. 37 is a cross-sectional side view along section line A-A' in FIG. 2 showing upper pump holding member on an upper portion of the housing.

Reference is made to FIG. 37 which shows a cross-sectional side view of the housing 70 and the pump holding member 508. The back wall 202 above the support flange extends vertically upwardly from the support flange 204 spaced rearwardly from the back wall 202 below the support flange 204. Above the support flange 204 the back wall 202 is cutaway as a horizontally extending opening 742 providing a downwardly directed shoulder 743. Above the support flange 204 spaced forwardly from the back wall 202 a front wall 744 is provided extending upwardly to an upwardly directed upper end 745. An upwardly opening slotway 746 is provided between the front wall 744 and the back wall 202 and between the guide walls 120 and 121, above the support flange 204.

Figure 34:
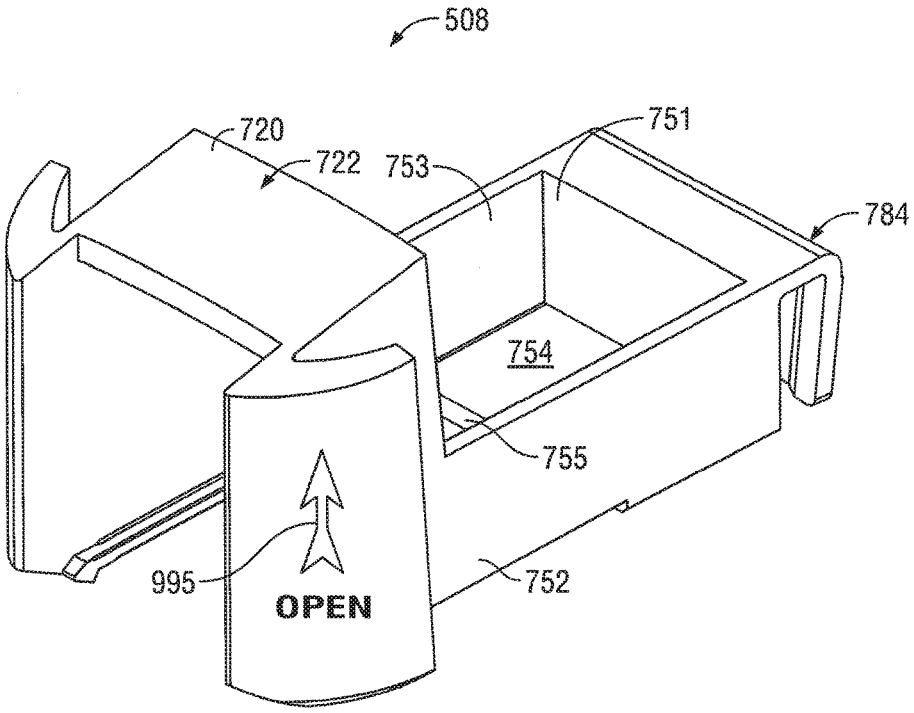
FIG. 34 is a top front pictorial view of the upper pump holding member in FIG. 4.
Figure 35:
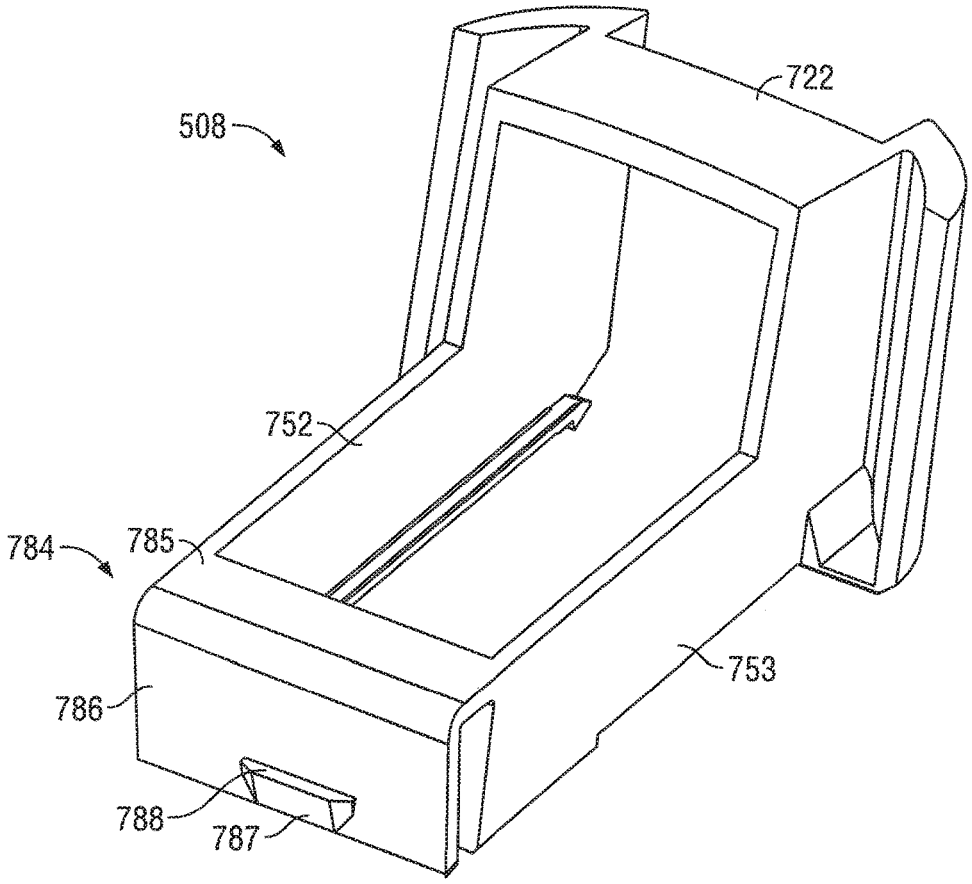
FIG. 35 is a top rear pictorial view of the upper pump holding member in FIG. 34.
Figure 36:
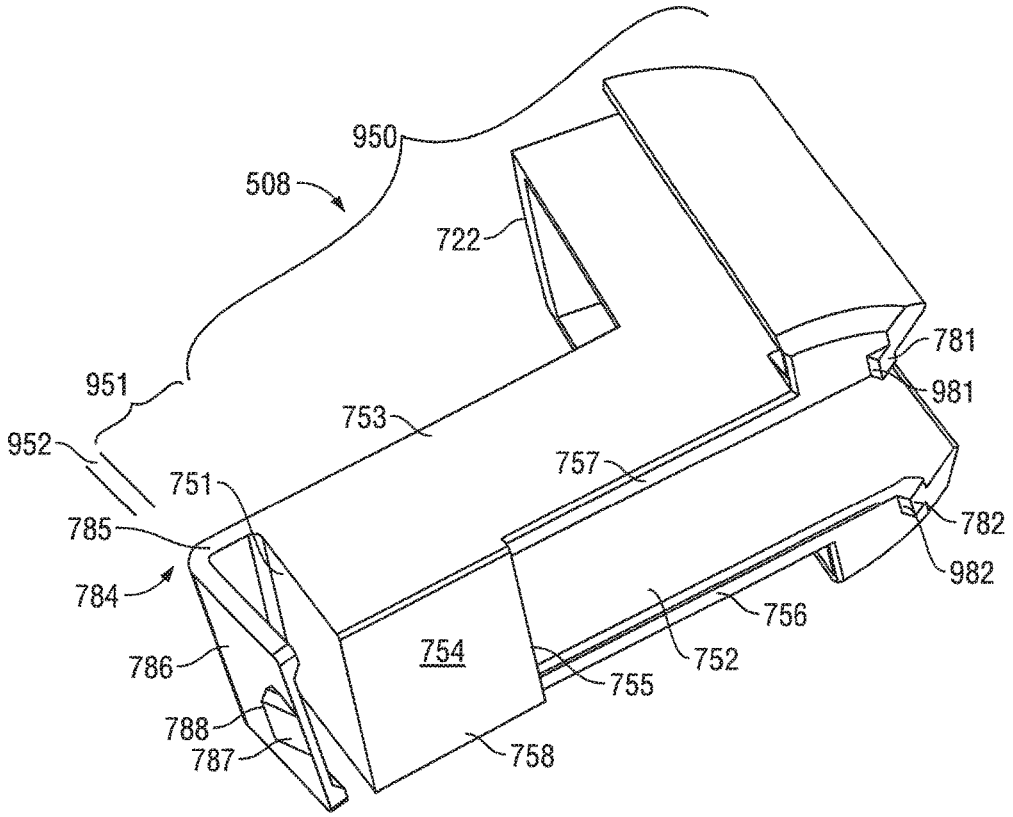
FIG. 36 is a bottom rear pictorial view of the upper pump holding member in FIG. 34.

Reference is made to FIGS. 34 to 36 showing the upper pump holding member 508. The upper pump holding member 508 includes a rear wall 751 joining a right side wall 752 and a left side wall 753. Proximate to the forward ends the left side wall 753 and the right side wall 752 a forward bridge member 720 bridges between upper portions of the walls 572 and 573. The forward bridge member has an upwardly directed upper surface 722. A lower bridging wall 754 bridges between lower rear portions of the left and right side walls 753 and 752 and the lower portion of the rear wall 751. An opening is defined between the left and right side walls 753,752 underneath the forward bridge member 720 open rearward to a forward edge 755 of the lower bridging wall 754. Forward of the lower bridging wall 754, downwardly directed holding surfaces 757 and 756 of the left and right side walls 753 and 752 are disposed in a flat plane raised above the flat plane of a lower surface 758 of the lower bridging wall 754 with the exception of two holding stop members 781 and 782 are provided one on each of the left and right side walls 753 and 752 to extend downwardly to the flat plane of the lower surface 758. Each holding stop member 781 and 782 presents a respective rearwardly directed stop surface 981 and 982

From the rear wall 751, a hook member 784 extends rearward as an upper bight member 785 carrying a catch wall 786. As seen on FIG. 35, the catch wall 786 carries a rearwardly extending catch member 787 carrying an upwardly directed catch surface 788.

As can be seen in FIG. 37, the upper pump holding member 508 is secured to the housing 70 with its hook member 784 having its catch wall 786 disposed in the slotway 746 between the back wall 202 and the front wall 744, with the catch wall 786 biased into engagement with the back wall 202 and with the catch member 787 having its upwardly directed shoulder 788 engaged on the downwardly directed shoulder 743 of the back wall 202 so as to latch the catch member 787 to the back wall 202 against relative movement in a frictional snap-fit relation.

With the catch wall 786 secured to the back wall 202 the upper pump holding member 508 forms a cantilevered arm having as marked on FIG. 36 a rear portion 952 comprising the catch wall 786 fixedly secured to the housing 70, a resilient intermediate portion 951 comprising the upper bight member 785 and a distal forward portion 950 comprising the upper pump holding member 508 forward of the upper bight member 785. The resilient intermediate portion 951 is between the rear portion 952 and the distal forward portion 950 with the resilient intermediate portion 951 being resiliently deflectable for movement of the distal forward portion 950 between the lower position and the upper position relative the rear portion 952 fixed to the housing 70. The distal forward portion 950 carries the downwardly directed holding surfaces 757 and 756 as well as the holding stop members 781 and 782.

The resilient intermediate portion 951 formed by upper bight member 785 has an inherent bias to assume an inherent condition and is deflectable to deflected conditions against the inherent bias such that when the resilient intermediate portion 951 is deflected from the inherent conditions the inherent bias urges the resilient intermediate portion toward the inherent condition. When the rear portion 952 of the upper pump holding member 508 is fixed to the housing 70, the inherent bias of the resilient intermediate portion 951 biases the distal forward portion 950 to the lower position and movement of the distal forward portion 900 toward the upper position results in the resilient intermediate portion 951 being deflected to deflected conditions in which the inherent bias urges the distal forward portion 950 to the lower position.

The upper pump holding member 508 is preferably injection molded from a plastic material as a unitary element with the plastic material suitably selected to provide the resilient intermediate portion 951 as formed by upper bight member 785 with the desired inherent bias. As can be seen on FIGS. 34 to 36, with the upper pump holding member 508 including the intermediate portion 951 as formed upper bight member 785 in its inherent condition, the catch wall 786 extends forwardly towards the rear wall 751 as the catch wall 786 extends downwardly away from the upper bight member 785. However when the rear portion 952 of the upper pump holding member 508 is fixed to the housing 70, as seen in FIG. 37, upper bight member 785 is deflected to a deflected condition in which the catch wall 786 extends parallel the rear wall 751. Thus when the rear portion 952 of the upper pump holding member 508 is fixed to the housing 70, the inherent bias of the resilient intermediate portion 951 biases the distal forward portion 950 toward to the lower position and movement of the distal forward portion 950 toward the upper position results in the resilient intermediate portion 951 being deflected to deflected conditions in which the inherent bias urges the distal forward portion 950 toward the lower position.

In the position of FIG. 37, due to the inherent bias of the upper pump holding member 508 the stop members 781 and 782 are biased downwardly into engagement with the support flange 204. The left and right side walls 753 and 752 of the upper pump holding member 508 are adjacent to vertical guide walls 120 and 121 to permit and guide the relative vertical sliding of left and right side walls 753 and 752 of the upper pump holding member 508 with deflection of the upper pump holding member 508 about the upper bight 785 of the hook member 784. The lower bridging wall 754 is placed in engagement with the upper surface of the support flange 204. As can be best seen in FIG. 37, forward of the lower bridging wall 754 there is defined above the support flange 204 a horizontally extending slot 900 between the support flange 204 and the lower surfaces 757 and 756 of the left and right side walls 753 and 752 of the upper pump holding member 508 sized to receive the support plate 117 of the piston forming body 110 as seen in FIG. 41.

Figure 38:
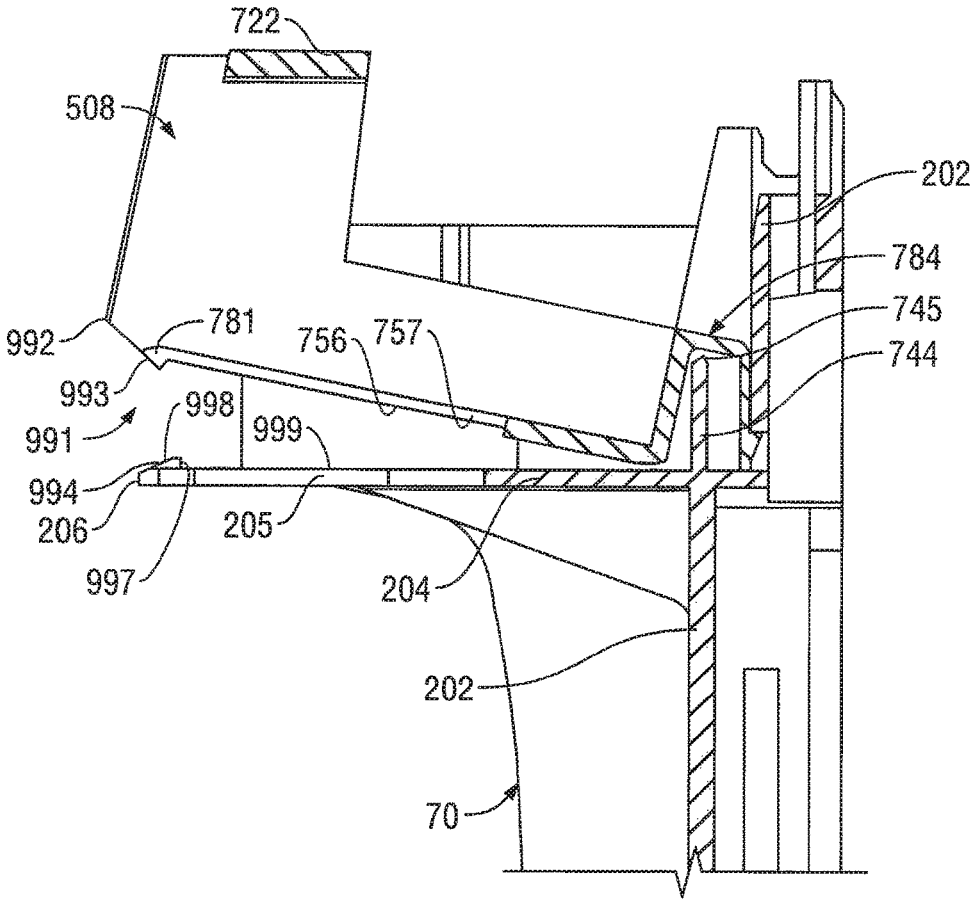
FIG. 38 is a cross-sectional side view the same as in FIG. 37 but with the upper pump holding member pivoted relative the housing.

Reference is made to FIG. 38 which illustrates a raised position to which, from the position of FIG. 37, the upper pump holding member 508 is deflected against its inherent bias raising the distal front portion 950 of the upper pump holding member 508 to be spaced upwardly from the support flange 204 and disposing the lower surfaces 757 and 756 of the left and right side walls 733 and 752 of the upper pump holding member 508 to be disposed tilted forwardly at an angle to the vertical. Such a configuration as is shown in FIG. 38 can occur with the cover 18 in a raised upper position and as seen in FIG. 40 the pump mechanism 100 urged upwardly into the upper pump holding member 508 so that the support plate 117 of the piston chamber-forming body 110 of the pump mechanism 100 is engaged with front portion 950 of the upper pump holding member 508 with the pump mechanism 100 tilted so as to assume the same tilted condition as the forward portion 950 of the upper pump holding member 508. As seen in FIG. 40 with the lifting member 500 in an open position, the axis of the pump mechanism 100 and the dip tube 112 of the pump mechanism 100 each extends forwardly as it extends downwardly and the bottle 101 may be slid coaxially at an angle vertically downwardly and forwardly onto and off of the dip tube 112 without interference with the remainder of the dispenser 10 and notably the support ledge 116. The ability to adopt the forwardly tilted configuration such as shown in FIG. 40 can be of assistance particularly insofar as the dip tube 112 may be rigid metal and cannot be bent. As well, adopting the configuration illustrated in FIG. 40 can also be of assistance in replacing a complete cartridge 15.

Figure 31:
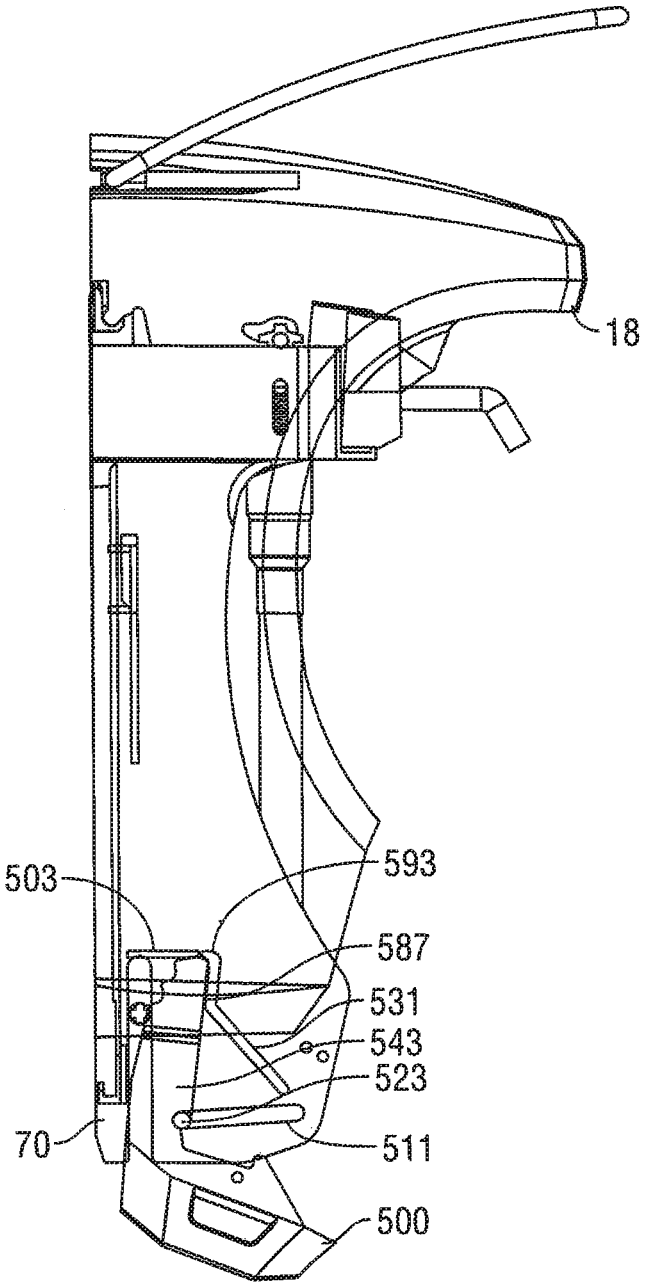
FIG. 31 a left side view of the dispenser assembly of FIG. 1 with the cover assembly in the fully open upper position and the reservoir of the cartridge not shown and each of the lifting member and the cover drawn as being transparent.

When the piston pump mechanism 100 is coupled to the housing 70 with the upper pump holding member 508 in the lower position and the support plate 117 located in between the upwardly directed support surface 999 of the support flange 204 and the downwardly directed holding surfaces 756 and 757 of the upper pump holding member 508, applying upwardly directed forces to the upper pump holding member 508 moves the upper pump holding member 508 to the upper position. In this regard in use of the dispenser 10 with the cover in an open position such as seen in FIG. 31, a user may manually engage and move the forward portion of the upper pump holding member 508 upwardly as indicated to a user by a preferred indicia arrow 995 and the associated word OPEN marked on the forward portion 950 of the upper pump holding member 508 as shown merely on FIG. 34.

When the upper pump holding member 508 is in the upper position, the piston pump mechanism 100 can be coupled to and uncoupled from the housing 70.

As seen in FIG. 38 in the upper position, the downwardly directed holding surfaces 756 and 757 of the upper pump holding member 508 are spaced from the upwardly directed support surface 999 of the support flange 204 by distances greater than distances the downwardly directed holding surfaces 756 and 757 of the upper pump holding member 508 are spaced from the upwardly directed support surface 999 of the support flange 204 in the lower position of FIG. 37.

When as seen in FIG. 39, the piston pump mechanism 100 is coupled to the housing 70 with the upper pump holding member 508 in the lower position and the support plate 117 located in between the upwardly directed support surface 999 of the support flange 204 and the downwardly directed holding surfaces 756 and 757 of the upper pump holding member 508: (a) with the downwardly directed holding surfaces 756 and 757 of the upper pump holding member 508 in engagement with the upwardly directed plate surface 961 of the support plate 117 and (b) with the rearwardly directed stop surfaces 981 and 982 of the holding stop members 781 and 782 engaged with the forwardly directed stopping surface 960 of the support plate 117, applying upwardly directed forces to the piston chamber-forming body 110 moves the upper pump holding member 508 to the upper position maintaining the upwardly directed plate surface 961 of the support plate 117 engaged with the downwardly directed holding surfaces 756 and 757 of the upper pump holding member 508 and the rearwardly directed stop surfaces 981 and 982 of the holding stop member engaged with the forwardly directed stopping surface 960 of the support plate 117, tilts the piston-chamber forming body 110 to having a lower end of the piston-chamber forming body 110 move forwardly while maintaining the piston-chamber forming body 110 to extends through the slot 205 of the support flange 204.

As seen in FIG. 41, with the cover 18 in the closed position a downwardly directed surface 954 of the top wall 21 of the cover 18 engages an upwardly directed surface 720 of the bridge member 722 of the upper pump holding member 508 to prevent upward movement of the upper pump holding member 508. When the cover is in an open position, the cover 18 and the downwardly directed surface 954 of the top wall 21 of the cover 18 is spaced vertically upwardly above the upwardly directed surface 720 of the bridge member 722 of the upper pump holding member 508 that the upper pump holding member 508 may move upwardly to the upper position.

As seen in FIG. 37, the upper pump holding member 508 is carried on the housing 70 above the support flange 204 to present the downwardly directed holding surfaces 757 and 756 of the upper pump holding member 508 in opposition to the upwardly directed support surface 999 of the support flange 204. As seen in FIG. 39, when the piston pump mechanism 100 is coupled to the housing, the piston-chamber forming body 110 extends through the slot 205 of the support flange 204 with the support plate 117 located in between the upwardly directed support surface 999 of the support flange 204 and the downwardly directed holding surfaces 757 and 756 of the upper pump holding member 508. More particularly, when the piston pump mechanism 100 is coupled to the housing 70 with the upper pump holding member 508 in the lower position, the support plate 117 is captured against removal between the upwardly directed support surface 999 of the support flange 204 and the downwardly directed surfaces 756 and 757 of the upper pump holding member 508, with the upwardly directed support surface 999 of the support flange 204 engaging the downwardly directed plate surface 962 of the support plate 117 and the downwardly directed surfaces 756 and 757 of the upper pump holding member 508 engaging the upwardly directed plate surface 961 of the support plate 117, preventing vertical movement of the support plate 117 relative the housing, and locating the pump mechanism 110 in an operative position for engagement of the piston-forming element 111 by the actuator mechanism 19.

As seen on FIG. 39, the rearwardly directed stop surfaces 981 and 982 of the holding stop members 781 and 782 of the upper pump holding member 508 engage with the forwardly directed stopping surface 960 of the support plate 117 when the downwardly directed holding surfaces 756 and 757 of the upper pump holding member 508 are in engagement with the upwardly directed plate surface 999 of the support plate 117 to prevent forward sliding of the support plate 117 relative the upper pump holding member 508.

As seen on FIG. 38, forward of the upwardly directed support surface 999 of the support flange 204, a support stop member 998 is provided with a rearwardly directed stop surface 997 for engagement with the forwardly directed stopping surface 960 of the support plate 117 when the upwardly directed support surface 999 of the support flange 204 is in engagement with the downwardly directed plate surface 962 of the support plate 117 to prevent forward sliding of the support plate 117 relative the support flange 204, as occurs for example in FIG. 39.

As seen in FIG. 38, with the upper pump holding member 508 in the upper position, a forward entrance opening 991 is defined between a forward end 992 of the upper pump holding member 508 and the front edge 206 of the support flange 204. In the upper position of FIG. 39 the piston pump mechanism 100 can be coupled to and uncoupled from the housing 70 with: (a) the piston-chamber forming body 110 moving through the slot 205 of the support flange 204 via the slot opening in the front edge 206 of the support flange 204 and (b) the support plate 117 moving from forward of the upper pump holding member 508 and the support flange 204 through the forward entrance opening 991 to between the upper pump holding member 508 and the support flange 204.

As seen in FIG. 37 with the upper pump holding member 508 in the lower position, the forward entrance opening 991 of FIG. 38 is closed by engagement between the forward end 992 of the upper pump holding member 508 and the front edge 206 of the support flange 204 and a forwardly opening horizontally extending entrance guideway slot 990 is defined forward of the closed forward entrance opening 992 between an upper guideway surface 993 on the forward end 992 of the upper pump holding member 508 directed at least partially downwardly and a lower guideway surface 994 on the front edge 206 of the support flange 204 directed at least partially upwardly. At least one of the upper guideway surface 993 and the lower guideway surface 994 is also being directed at least partially forwardly so that the forwardly opening horizontally extending entrance guideway slot 992 has a vertical height that reduces rearwardly toward the closed forward entrance opening 991. Preferably, as shown on FIG. 38, both the upper guideway surface 993 and the lower guideway surface 994 are also directed at least partially forwardly.

On rearward movement of the cartridge 15 carrying the piston pump mechanism 100 relative to the housing 70, as seen on FIG. 26 with the rearwardly directed cam surface 964 of the support plate 117 disposed horizontally in the forwardly opening horizontally extending entrance guideway slot 990, engagement between the cam surface 964 and the upper guideway surface 993 alone or between the cam surface 964 and the upper guideway surface 993 and the lower guideway surface 994 applies upwardly directed forces to the upper guideway surface 993 which moves the upper pump holding member 508 toward the upper position opening the forward entrance opening 990. The opening of the forward entrance opening 990 permits subsequent rearward movement of the piston-chamber forming body 110 through the slot 205 of the support flange 204 via the slot opening in the front edge 206 of the support flange 204 and subsequent rearward movement of the support plate 117 between the upper pump holding member 508 and the support flange 204.

Preferably, as shown on FIG. 37, the upper guideway surface 993 is directed forwardly and downwardly and the lower guideway surface 994 is directed forwardly and upwardly. With the upper pump holding member 508 biased downwardly toward the lower position relative the support flange 204 by a user merely manipulating the cartridge 15 horizontally in the forwardly opening horizontally extending entrance guideway slot 990, engagement between the cam surface 964 of the support plate 117 and the upper guideway surface 993 and the lower guideway surface 994 permits the support plate 117 to move rearwardly and be captured between the upper pump holding member 508 and the support flange 204 as in FIG. 39.

Figure 22:
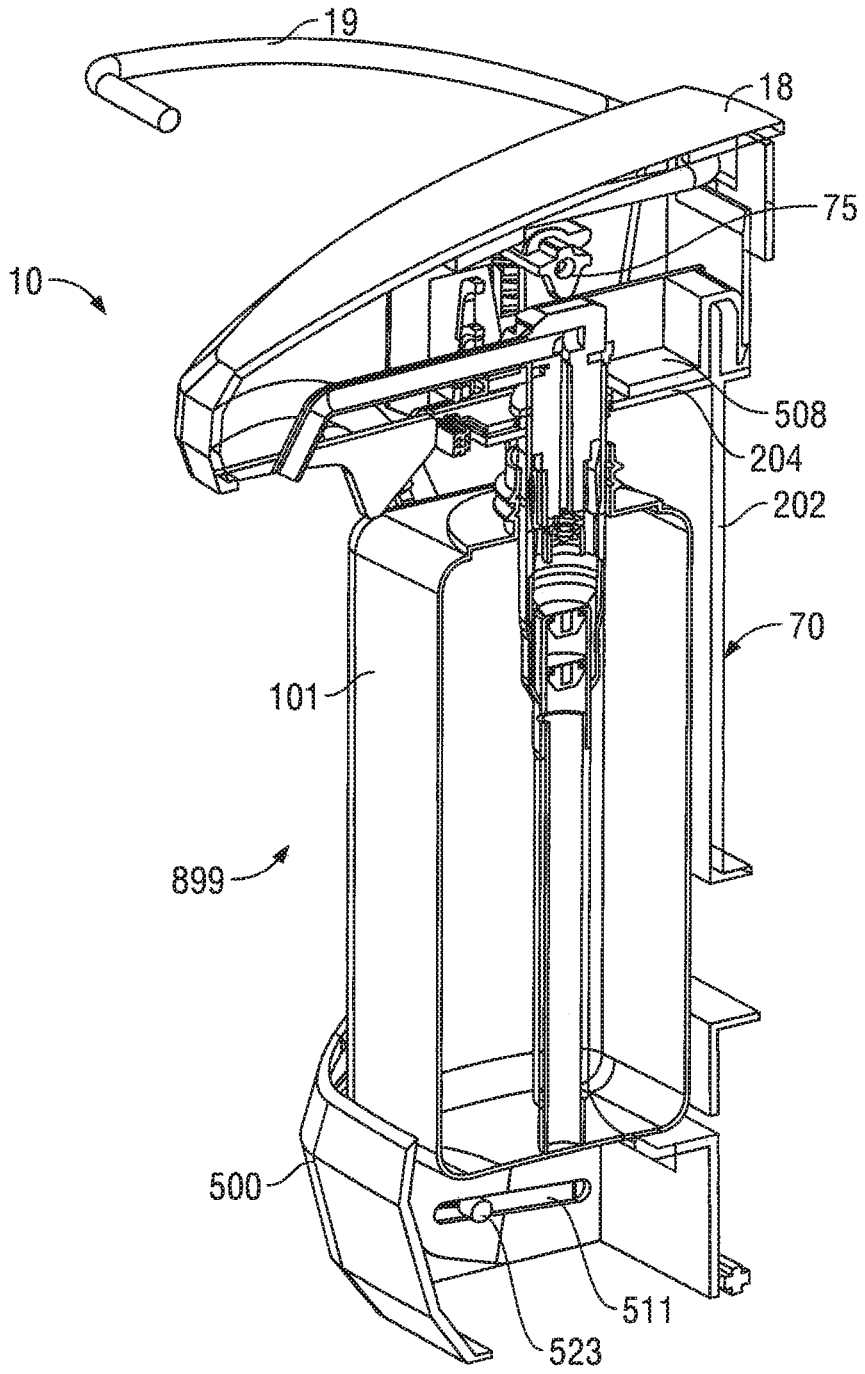
FIG. 22 is a cross-sectional pictorial side view of the dispenser assembly of FIG. 1 along section line A-A' in FIG. 2.

As seen in FIGS. 22 and 23, the cartridge 15 comprising the bottle 101 and the pump mechanism 100 are received within the housing in the interior or interior compartment 46 of the housing 70 and with the lifting member 500 in the closed position and the cover 18 in the closed lower position. As seen on FIG. 12, the housing 70 has a forward opening 899 providing access to the interior 46 of the housing including the interior compartment 46.

The lifting member 500, when in the closed position, covers a lower portion of the forward opening of the housing and, from the closed position, the lifting member 500 moves downwardly relative the housing to the open position in which a lower portion 898 of the forward opening 899 of the housing 70 is not covered by the lifting member 500. The lifting member 500, when in the closed position, covers the lower portion 898 of the forward opening 899 of the housing 70 preventing removal of the cartridge 15 and its removable bottle 101 from the interior 46 of the housing.

When the cover assembly 18 is in the closed lower position, it covers an upper portion 897 of the forward opening 899 of the housing 70 and, from the closed lower position, the cover assembly 18 moves upwardly relative the housing 70 to the open upper position in which the upper portion 897 of the forward opening 899 of the housing 70 is not covered by the cover assembly 18. When the cover assembly 18 is in the closed lower position, the cover assembly 18 covers the upper portion 897 of the forward opening 899 of the housing 70 preventing removal of the pump mechanism 100 from within the interior of the housing 70 through the forwardly open upper portion 897.

With the lifting member 500 in the open position and the cover assembly 18 in the open upper position, the bottle 101 and the pump mechanism 100 are insertable into and removable from the interior of the housing 70 via the forward opening of the housing.

With the lifting member 500 in the closed position and the cover assembly 18 in the closed lower position, the lifting mechanism 500 and the cover assembly 18 together best prevent removal of the bottle 101 and the pump mechanism 100. When the lifting member 500 is in the closed position covering the lower portion 898 of the forward opening 899 of the housing 70 and the cover assembly 18 is in the closed lower position covering the upper portion 897 of the forward opening 899 of the housing 70, a viewing opening 959 as marked on FIGS. 1 and 3 is provided into the interior compartment 46 of the housing 70 between the lifting member 500 and the cover assembly 18 intermediate the lower portion 898 of the forward opening 899 of the housing 70 and the upper portion 897 of the forward opening 899 of the housing 70 as shown on FIG. 12. The viewing opening 959 is useful as for a user to see the presence or absence of a bottle 101 or pump assembly 110 and the contents in the bottle 101.

The provision of the upper pump holding member 508 is a preferred arrangement for providing for tilting or pivoting of the pump mechanism 100 and/or the entire cartridge 15 forwardly relative to the housing 70 as can been advantageous for insertion and removal. Various other arrangements may be provided which on one hand secure the cartridge 15 and/or its pump mechanism 100 to the housing 70 when the cover 18 is closed yet permit the pump mechanism 100 and/or the cartridge 15 to be moved upwardly or pivoted forwardly relative to the housing 70 to render insertion and removable to the cartridge 15, and/or the bottle 101.

The housing right and left side walls 200 and 201 carry vertically extending channels 214 and 215 which are to receive laterally extending left and right slide members 216 and 217 on the pump actuator plate 75 so as to couple the pump actuator plate 75 to the housing 70 for relative vertical sliding. The right and left plate springs 76 and 77 are disposed between the support flange 204 and the pump actuator plate 75 to bias the pump actuator plate 75 to an upper position in the channels 214 and 215 and to permit but resist downward movement of the actuator plate 75 to lower positions within the channels 214 and 215.

FIGS. 22 and 23 illustrate the dispenser assembly 10 in an operative condition ready for use to dispense fluid, however, with the cover 18 in cross-section.

Figure 17:
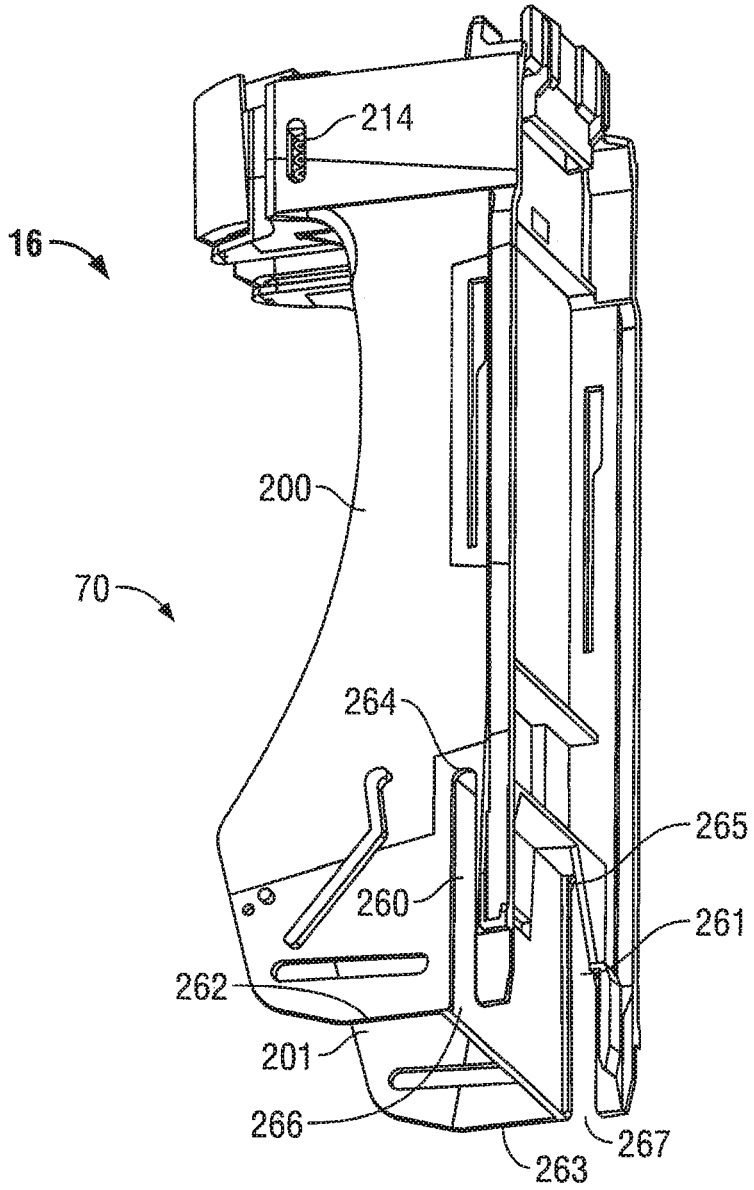
FIG. 17 is a rear pictorial view of the housing assembly of FIG. 14 as seen from the right.
Figure 18:
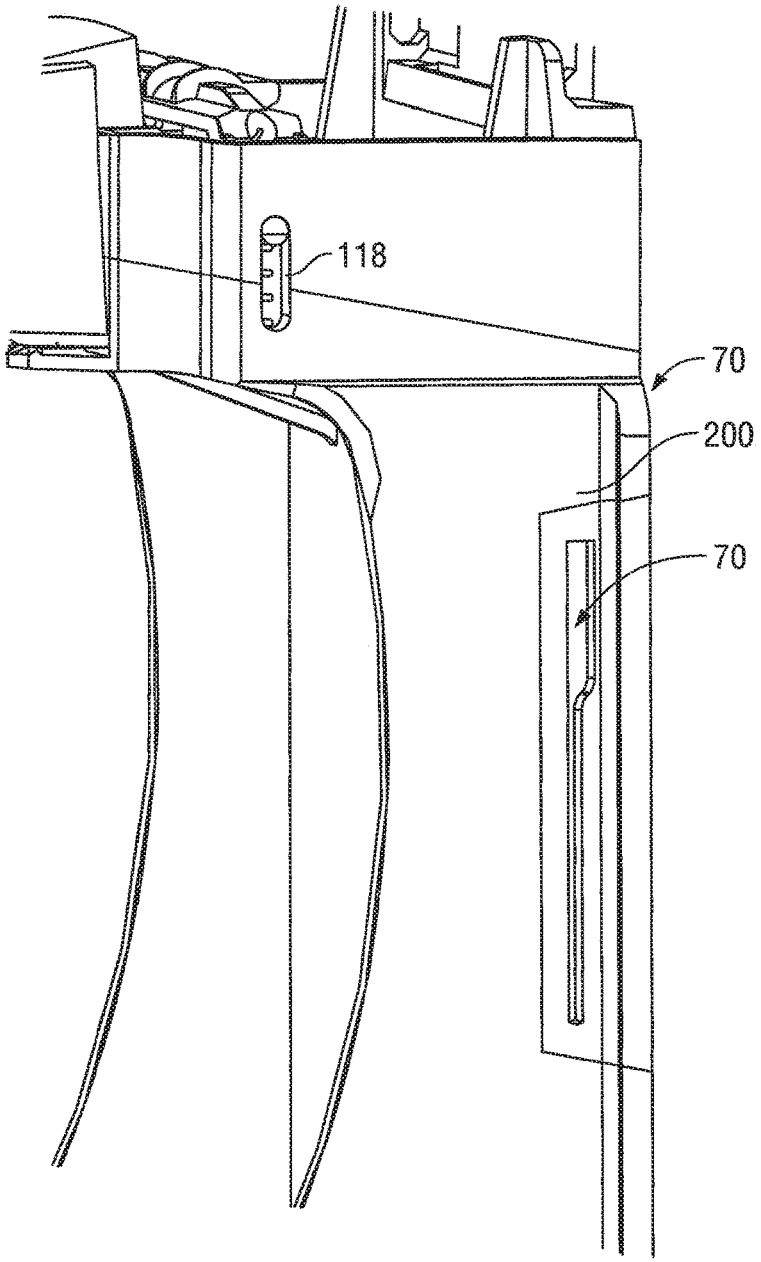
FIG. 18 is a front pictorial view of a portion of the housing assembly of FIG. 14 as seen from the right.

Referring to FIGS. 13 and 17, each of the right and left housing side walls 200 and 201 carry a respective right and left rod receiving slotways 260 and 261 open at open ends 266 and 267 in bottom edges 262 and 263 of the housing side walls 200 and 201 and extending vertically upwardly to respective blind ends 264 and 265. The rod receiving slotways 260 and 261 are sized so as to receive the rod member 20 of the cover 18 therein and locate the right cover side wall 22 laterally to the right outwardly of the housing right side wall 200 and the left cover side wall 23 laterally to the left outwardly of the housing left side wall 201. When the rod member 20 is within the rod receiving slotways 260 and 261, the slotways 260 and 261 engage the rod member 20 and guide relative sliding movement of the rod member 20 relative to the housing 70. The rod member 20 may pass inwardly and outwardly through the open ends 266 and 267 of the slotways 260 and 261 to disengage the rod member 10 from the slotways 260 and 261 or to engage the rod member 20 in the slotways 260 and 261. The housing 70 is symmetrical about the longitudinal central axis A-A' in FIG. 2 with each of the right and left housing side walls 200 and 201 being mirror images of the other.

Referring to FIGS. 12 to 17, each of the left and right housing side walls 200 and 201 carry a respective right and left lifter axle receiving slotway 510 and 511 closed at respective forward ends 512 and 513 and have respective rear ends 514 and 515 with respective upper and lower camming surfaces 518 and 519 and 520 and 521 defining the respective slotways therebetween. As will be described later, the lifter axle receiving slotways 510 and 511 are adapted to receive respective right and left stub axles 522 and 523 of the lifting member 500. Each of the slotways 510 and 511 extend slightly downwardly as each extends rearwardly.

As seen in FIGS. 13 to 17, on the right housing side wall 200, there is provided a rod-like stop button 524 which extends laterally away from the right side wall 200. Also provided on the right housing side wall 200 to extend laterally to the right away from the right housing side wall 200 is a right guide flange 530. The left housing side wall 201 is a mirror image of the right housing side wall 200 and, similarly as seen on FIG. 15, on the left housing side wall 201, there is provided a rod-like stop button 525 which extends laterally away from the left side wall 201 and a left guide flange 531 extending laterally to the left from the left side wall 201 which is an identical mirror image of the right guide flange 530 on the right housing side wall 200.

Figure 16:
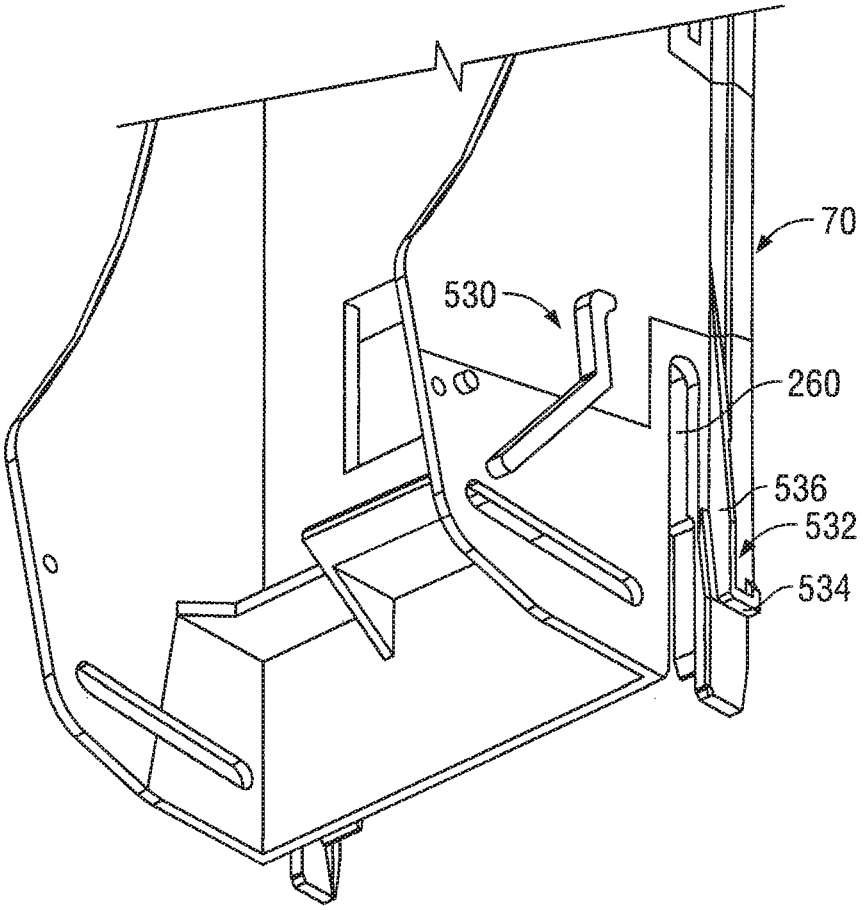
FIG. 16 is an enlarged front pictorial view of a lower portion of the housing shown in FIG. 14 as seen from the right.

Referring to FIG. 16, rearward of the rod receiving slotway 260, the right side wall 200 is provided with a rear guide member 532 which extends laterally to the right of the right side wall 200 so as to present a downwardly directed stop shoulder 534 and a forwardly directed cam shoulder 536. Similarly as seen on FIG. 15, on the left housing side wall 201, there are provided mirror image identical elements, namely a rear guide member 533 which extends laterally to the left of the left side wall 201 so as to present a downwardly directed left stop shoulder 535 and a forwardly directed left cam shoulder 537.

Figure 19:
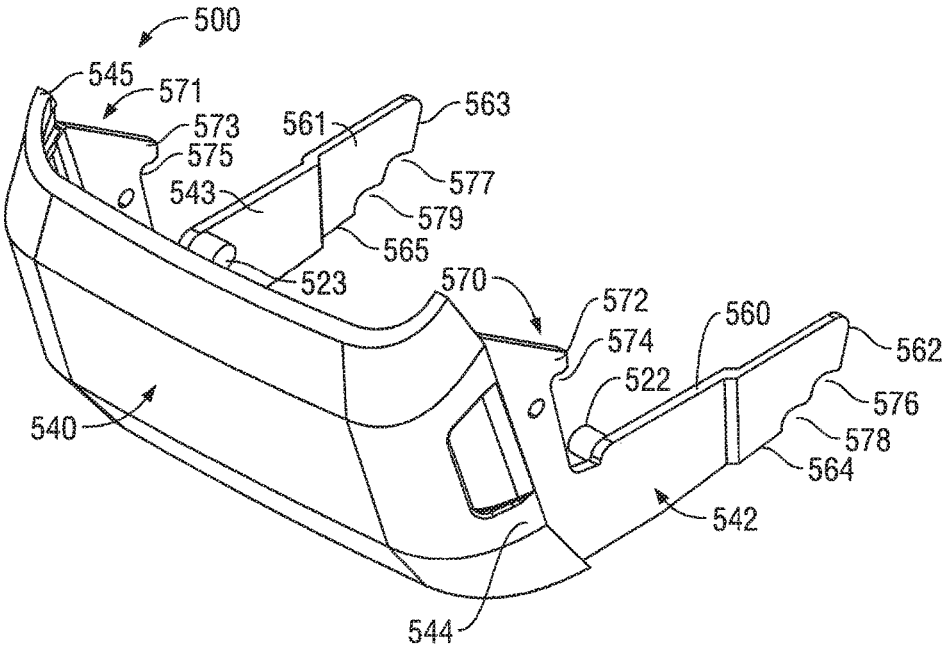
FIG. 19 is a front pictorial view of the cover actuator member or lifting member in FIG. 4.
Figure 20:
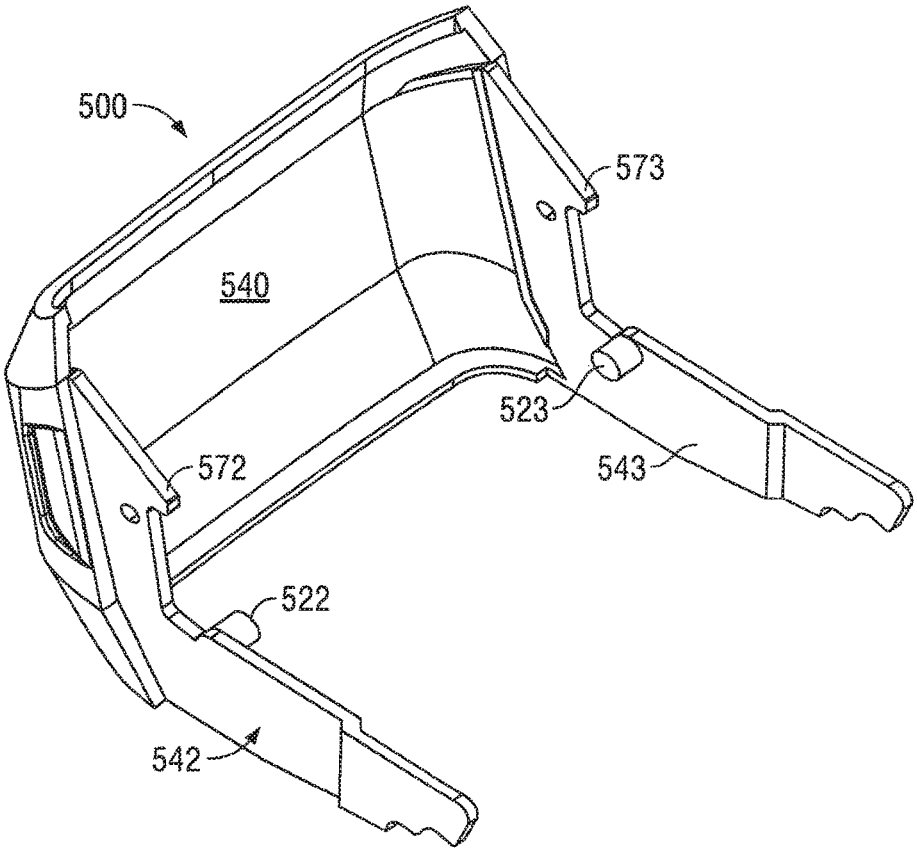
FIG. 20 is a rear pictorial view of the lifting member in FIG. 19 as seen from above.
Figure 21:
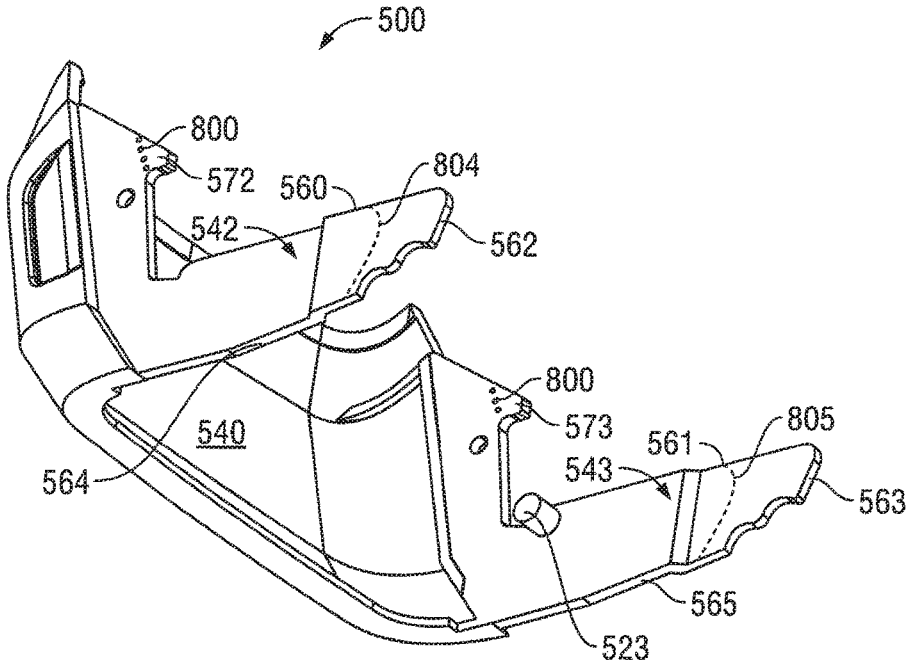
FIG. 21 is a front pictorial view of the lifting member in FIG. 19 as seen from below.

Reference is made to FIGS. 19 to 21 which illustrate the lifting member 500 which is seen to be generally U-shaped having a central forward portion 540 disposed generally vertically on the dispenser assembly 10 in a closed position. The lifting member 500 is symmetrical about the center plane A-A' in FIG. 2 with a right arm 542 disposed in a generally vertical plane extending rearwardly from a right side 544 of the central forward portion 540 and a mirror image left arm 541 extending forward generally vertically from the left side 545 of the central portion 540. The right stub axle 522 extends laterally inwardly towards the left from the right arm 542 and the left stub axle 523 extends laterally inwardly to the right from the left arm 543. The right arm 542 as an upper surface 560, an end surface 562 and a lower surface 564. Similarly, the left arm 543 has an upper lower surface 561, an end surface 563 and a lower surface 565. Proximate the forward end of the right arm 542, a right hook portion 570 extends upwardly defining a rearwardly extending hook member 572 extending rearwardly above a bight 574. The hook portion 570 extends downwardly from the bight 574 to merge with the upper surface 564. Similarly, the left arm 543 includes a hook portion 571 with a hook member 573 and a bight 575.

Reference is made to FIGS. 13, 14, 17 and 18 to describe left and right slide grooves 270 and 271 which extend laterally through the respective left and right housing side walls 200 and 201 rearward of the back wall 202 of the housing 70. Each of the slide grooves 270 and 271 extend vertically from bottom ends 276 and 277 to top ends 278 and 279. Each of the slide grooves 270 and 271 has a rearwardly directed front surface 280 and 281 disposed in the same flat vertical plane. Over upper portions 272 and 273 of each slide groove 270 and 271, respectively, each slide groove has a forwardly directed upper rear surface 282 and 283 which is vertical and spaced rearwardly from the respective front surfaces 280 and 281 by a first distance. Over a lower portion 274 and 275 of each slide groove 270 and 271, respectively, each slide groove has a forwardly directed lower rear surface 284 and 285 spaced rearwardly from the respective front surface 280 and 281 by a second distance less than the first distance. The first distance and the vertical dimension of the upper portions 272 and 273 of the guide grooves 270 and 271 are selected so as to permit the respective right and left latch members 48 and 49 carried on the right and left cover side walls 22 and 23 to slide laterally through the respective upper portions 272 and 273 of the slide grooves 270 and 271 when the right and left locking members 48 and 50 are vertically and horizontally aligned with the upper portions 272 and 273 of the slide grooves 270 and 271 as occurs when the cover assembly 14 is engaged on the housing assembly 16 in the upper open position shown, for example, in FIGS. 27 and 31.

At least the intermediate portion 25 of the right cover side wall 22 of the cover 18 is resilient and has an inherent bias to adopt a right inherent condition as illustrated in all of the Figures showing the cover 18 of the first embodiment. In FIG. 31, the cover assembly 14 is in the upper open position relative the housing assembly 16 and the right cover side wall 22 is laterally to the right of the right housing side wall 200 and the right latch member 48 extends through the right housing side wall 200 via the upper portion 272 of the right guide groove 270. The right cover side wall 22 is deflectable from the right inherent condition as shown in FIG. 31 to right deflected conditions not shown in which the intermediate portion 25 of the right cover side wall 22 is laterally to the right of the right inherent condition. Similarly, at least the intermediate portion 25 of the left cover side wall 23 of the cover 18 is resilient and has an inherent bias to adopt a left inherent condition as illustrated in all of the Figures of the first embodiment. In FIG. 31, the left cover side wall 23 is disposed laterally to the left of the housing left side wall 201 and the left latch member 49 extends through the left housing side wall 201 via the upper portion 273 of the left guide groove 271. The left cover side wall 23 is deflectable from the left inherent condition as shown in FIG. 31 to left deflected conditions not shown in which the intermediate portion 25 of the left cover side wall 23 is laterally to the left of the left inherent condition.

From the condition of FIG. 31, by manually urging the intermediate portions 25 of the left and right cover side walls 22 and 23 laterally outwardly away from each other, the right latch member 48 and the left latch member 49 move laterally away from each other laterally through and out of engagement with the right and left upper portions 272 and 273 of the right and left guide grooves 270 and 271 to assume the deflected conditions, with the rod member 20 of the cover 18 is received in the rod receiving slotways 260 and 261 in the right and left housing side walls 200 and 201such that the cover assembly 14 is merely engaged with the housing assembly 16 by reason of the rod member 20 being received within the slot receiving slotways 260 and 261. While maintaining the right and left cover side walls 22 and 23 in deflected positions, the cover assembly 16 may be pivoted about the rod member 20 within the rod receiving slotways 260 and 261 to pivot an upper end of the cover assembly 14 forwardly until the right and left latch members 48 and 49 are forward of the right and left housing side walls 200 and 201. The right and left side walls 22 and 23 may then be released and permitted to return under their inherent bias to the right and left inherent positions. The cover assembly 14 is manipulated such that the rod member 20 is slid downwardly in the rod receiving slotways 260 and 261 and out the open ends 266 and 267 to totally disengage the cover assembly 14 from housing assembly 16 and assume a disengaged condition.

The first distance separating the front surfaces 280 and 281 from the upper rear surfaces 282 and 283 is sufficient to permit the enlarged bulbous portions 56 and 57 at the distal inner ends 54 and 55 of the right and left latch members 48 and 49 to be slid laterally outwardly through the upper portions 272 and 273 of the slide grooves 270 and 271.

From the upper open position of FIG. 25, the cover assembly 14 is slidable relative to the housing assembly 16 to the lower closed position as illustrated in FIG. 26 with the right and left latch members 48 and 49 on the cover side walls 22 and 23 to slid downwardly from the upper portions 272 and 273 of the slide grooves 270 and 271 into the lower portions 274 and 275 of the slide grooves 270 and 271. In the lower portions 274 and 275, the second distance between the front surfaces 280 and 281 and the lower rear surfaces 284 and 285 is selected to be marginally greater than the thickness of the reduced thickness portions 62 and 63 of the right and left latch members 48 and 49 and less than the front to rear dimension of the bulbous portions 56 and 57 at the distal inner ends 54 and 55 of the right and left latch members 48 and 49. Thus when in the lower closed position, the left and right latch members 48 and 49 are prevented from being moved laterally outwardly through the lower portions 272 and 273 of the guide grooves 270 and 271.

Coupling of the cover assembly 14 to the housing assembly 16 is a reversal of the steps of removal described above. From a condition in which the cover assembly 14 is separate, disengaged and uncoupled from the housing assembly 16, the cover assembly 14 is manually moved so as to move the rod member 20 upwardly into the opening ends 266 and 267 of the rod receiving slotways 260 and 261 and to then, with the upper end of the cover assembly 14, tilted upwardly and forwardly from the rod member 20, slide the rod member 20 upwardly in the rod receiving slotways 260 and 261 until the rod member engages the upper blind ends 264 and 265 of the rod receiving slotways 260 and 261with each of the right and left cover side walls 22 and 23 disposed laterally outwardly of the right and left housing side walls 200 and 201. Once the rod member 20 engages with the blind ends 264 and 265 of the rod receiving slotways 260 and 261, the cover assembly 14 is pivoted about the rod member 20 rearwardly at the same time that deflecting forces are applied to each of the right and left cover side walls 22 and 23 to urge them laterally outwardly away from each other to adopt the deflected condition such that with pivoting of the cover assembly 14 about the rod member 20, the right and left latch members 48 and 49 pass laterally outwardly of the right and left housing side walls 200 and 201 to a position in which the right and left latch members 48 and 49 are laterally aligned with the right and left upper portions 272 and 273 of the right and left guide grooves 270 and 271. When so aligned, the deflecting forces applied to the right and left cover side walls 22 and 23 are released. Due to the inherent resiliency of each of the cover side walls 22 and 23, on release of the deflecting forces, the right and left cover side walls 22 and 23 move from the deflected condition to the inherent condition with the right and left latch members 48 and 49 to pass laterally inwardly into the upper portions 272 and 273 of the slide grooves 270 and 271 and assume the position shown in FIG. 25 with the cover assembly 14 is coupled to the housing assembly 16 in the upper open.

Figure 24:
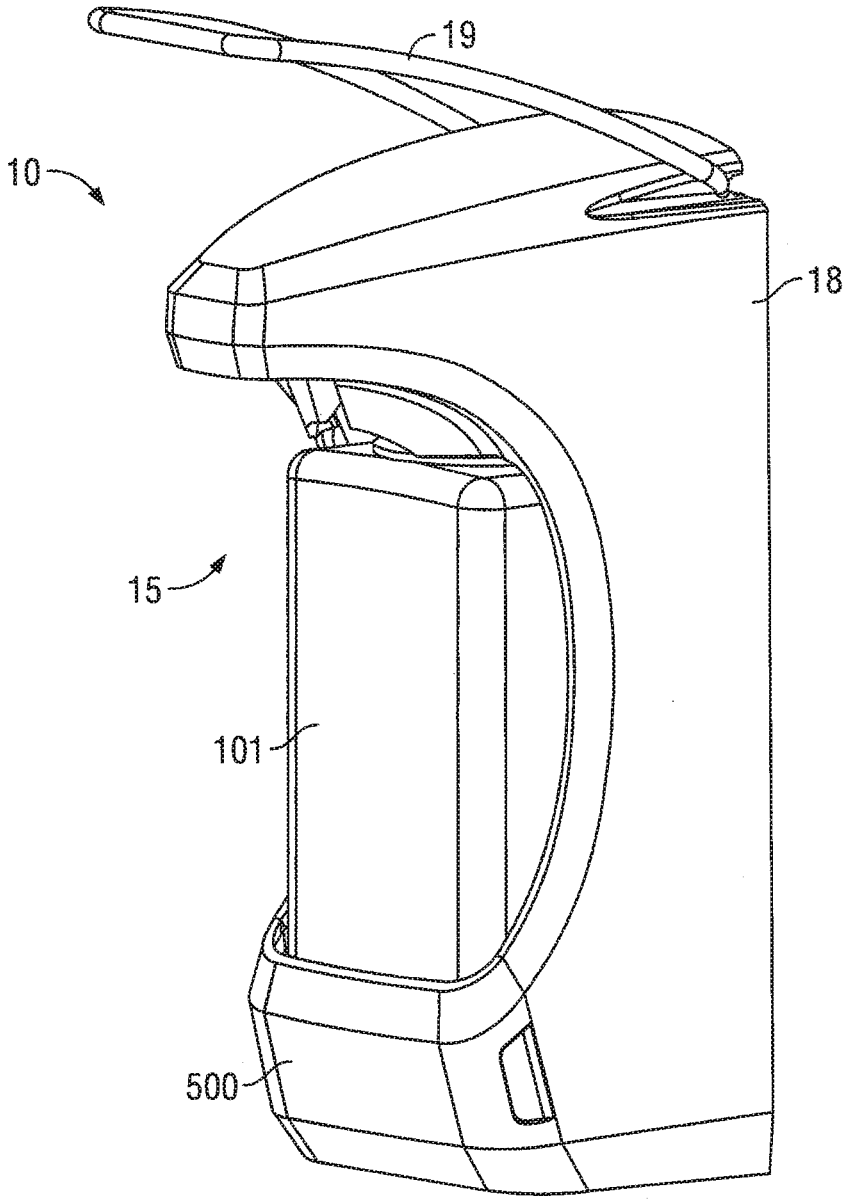
FIG. 24 is a pictorial view of the dispenser assembly of FIG. 1 in an operative position ready to dispense fluid with the cover assembly in a lower closed position and a latched condition.
Figure 25:
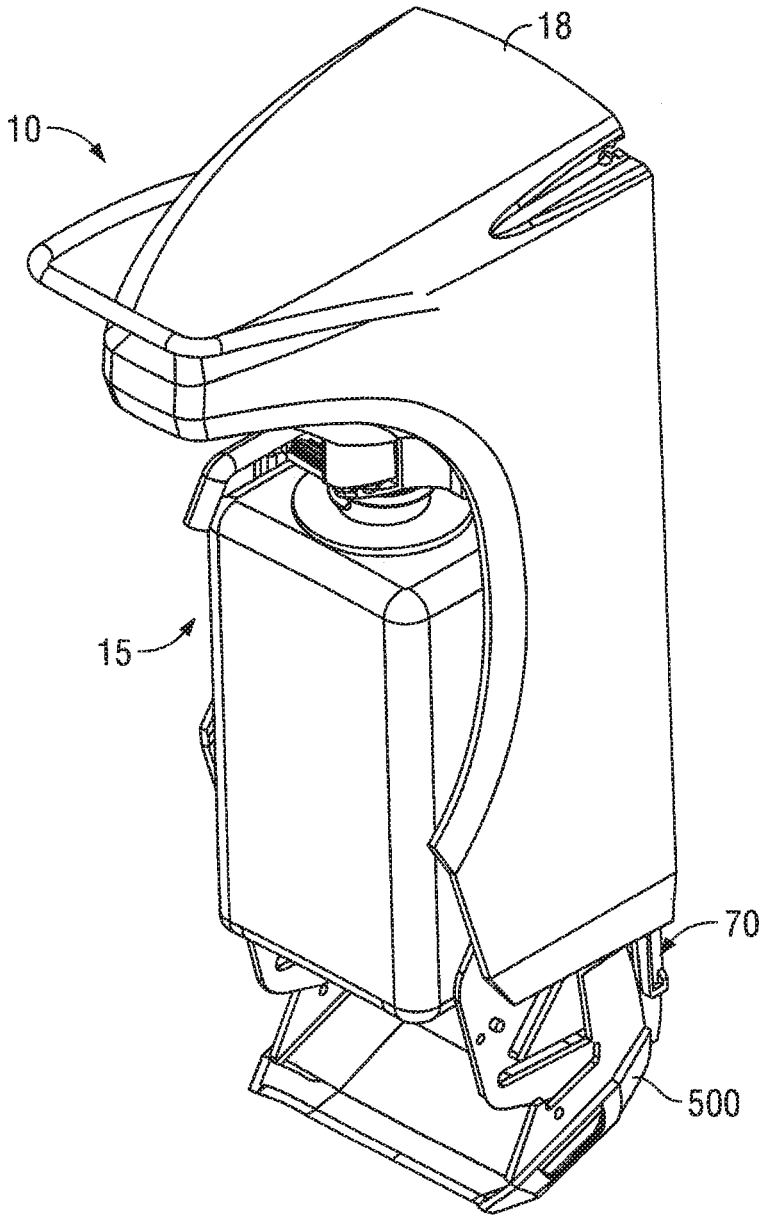
FIG. 25 is a pictorial view of the dispenser assembly of FIG. 1 but with the cover assembly in an upper fully open position with a cartridge coupled to the dispenser.
Figure 26:
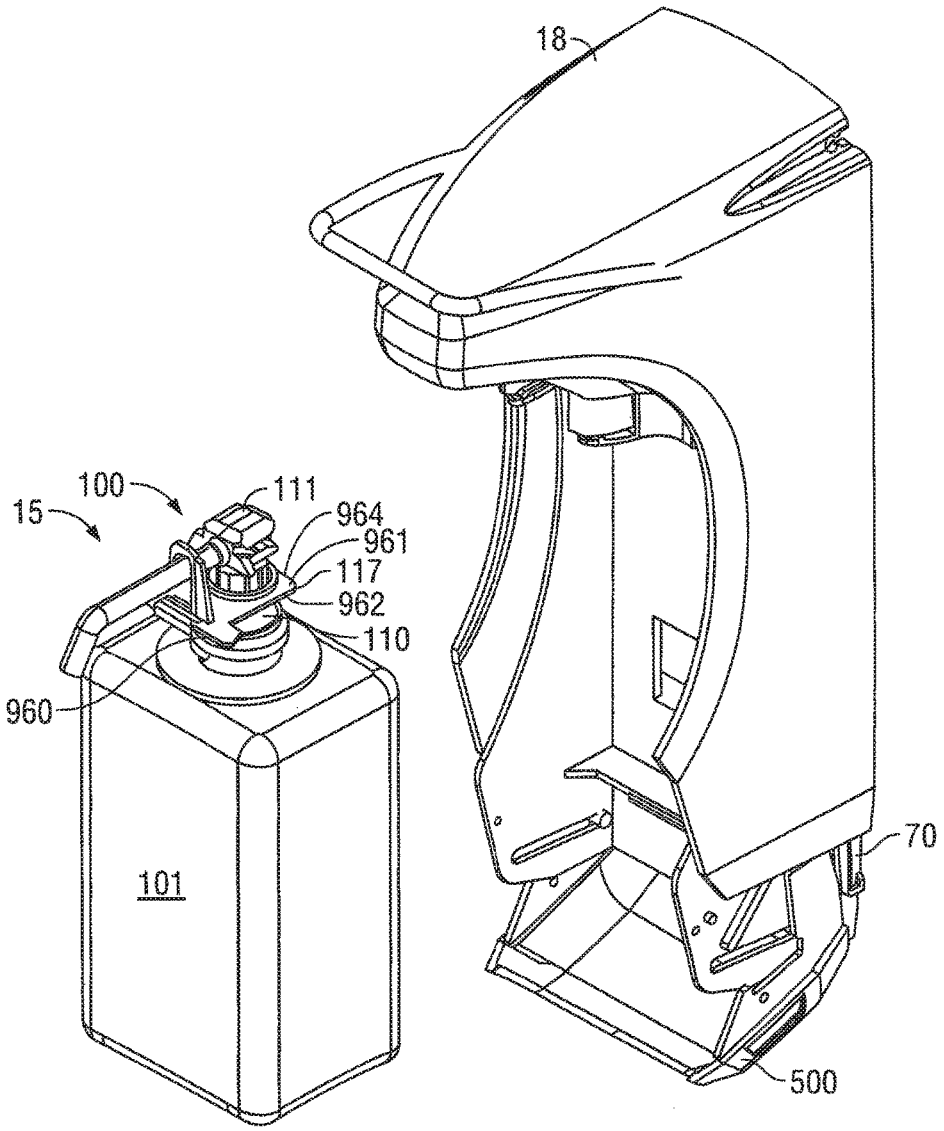
FIG. 26 is a pictorial view of the dispenser assembly of FIG. 25 in which the cartridge has been slid horizontally forwardly to a position to which and from which the cartridge may be slid horizontally, forwardly and rearwardly for respective coupling and uncoupling of the cartridge to the dispenser housing assembly.
Figure 27:
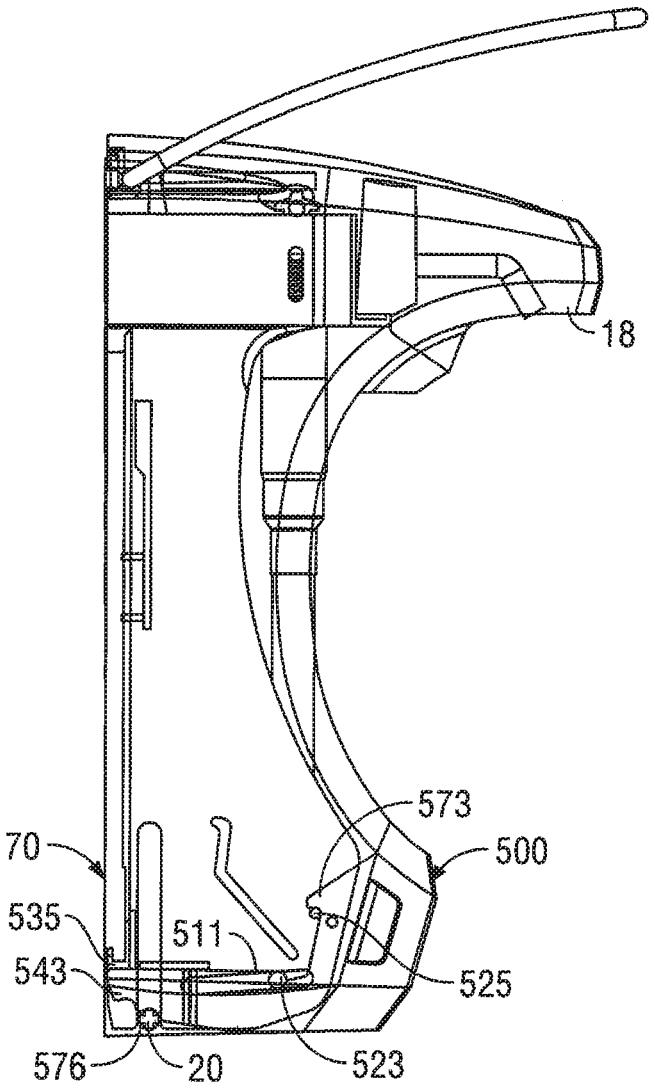
FIG. 27 is a schematic left side view of the dispenser assembly of FIG. 24 with the cover assembly in the lower closed position and the latched condition, and with the reservoir of the cartridge not shown and each of the lifting member and the cover drawn as being transparent.

With the cover assembly 14 coupled to the housing assembly 16, the cover assembly 14 is vertically slidable relative the housing assembly 16 from the upper open position of FIGS. 25 and 31 to the lower closed position shown in FIGS. 24 and 27. The cover assembly 14 is shown coupled to the housing assembly 16 in the lower closed position in FIGS. 24 and 27 as well, for example, in FIG. 1. In moving between the lower closed position of FIG. 27 and the upper open position of FIG. 31, the cover assembly 14 is slidably guided relative to the housing assembly 16 by reason of: (a) the rod member 20 on the lower portions 26 of the cover side walls 22 and 23 being guided within the rod receiving slotways 260 and 261 in the housing side walls 200 and 201 concurrently with (b) the left and right latch members 48 and 49 on the intermediate portions 25 of the cover side walls 22 and 23 being guided within the slide grooves 270 and 271 of the housing side walls 200 and 201.

In the lower position of FIG. 24, the cover assembly 14 is retained in a latched manner in the lower closed position against upward movement of the cover assembly 14 relative to the housing assembly 16.

To move the cover assembly 14 relative to the housing assembly 16 between the lower closed position of FIG. 24 and the upper open position of FIG. 25, the user manually engages the lifter member 500 and moves the lifter member.

Thus, as explained above, the cover assembly 14 is coupled to the housing assembly 16 for movement between the lower position and an open upper position. The housing assembly 16 has a releasable cover latching mechanism to latch the cover 18 to the housing 70 against vertical movement formed notably by the lifter member 500 and its interaction with the housing 70 and the cover 18, and as well the housing assembly 16 has a lifting mechanism to raise and lower the cover 18 relative the housing 70 formed notably by the lifter member 500 and its interaction as in the manner of a lever mechanism, preferably a cammed lever with a multiple pivot points, with the housing 70 and the cover 18.

Figure 28:
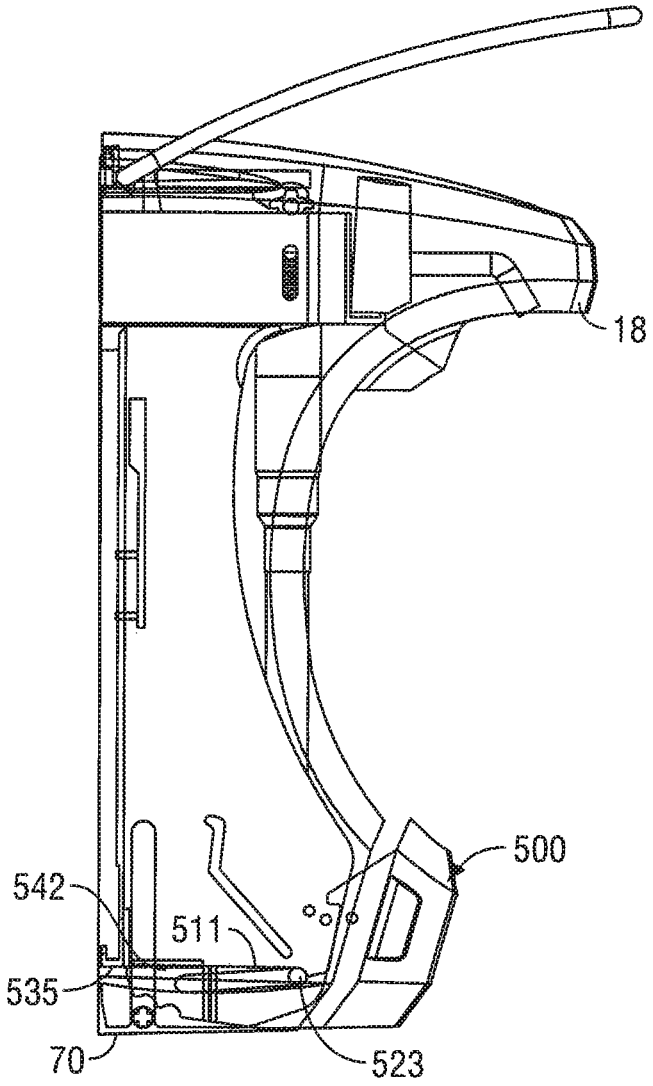
FIG. 28 a schematic left side view of the dispenser assembly of FIG. 1 with the cover assembly in the lower closed position and an unlatched condition, and the reservoir of the cartridge not shown and each of the lifting member and the cover drawn as being transparent.

Reference is made to FIGS. 27 to 31, each of which is a schematic left side view of the dispenser assembly of FIG. 4 in different positions of the cover assembly between a lower closed position, as seen in FIG. 27 and FIG. 28, and a fully open upper position as shown in FIG. 31. In each of FIGS. 27 to 31, the bottle reservoir 101 of the cartridge 15 is not shown. The pump assembly 100 is, however, shown. In each of FIGS. 27 to 31, each of the lifting member 500 and the cover 18 are shown as being transparent while the remainder of the components are shown in solid lines. Showing the cover 18 and the lifting member to be transparent assists in understanding, as seen in left side view, the relative juxtaposition of these elements in the different positions and conditions they can assume in movement between the lower closed position and latched condition as shown in FIG. 27 to the lower closed position and unlatched condition in FIG. 28, through the first partially open position of FIG. 29, through the second partially open position of FIG. 30 and to the fully open upper position of FIG. 31. In both FIGS. 27 and 28, the cover 18 remains in a lower closed position. In moving from FIGS. 28 to 31, the cover is successively moved from the lower closed position of FIGS. 27 and 28 successively to the upper fully open position of FIG. 31. As well, it can be seen that in a comparison of FIGS. 28, 29, 30 and 31, the lifting member 500 is from the position of FIG. 28 successively pushed downward and rearwardly with the lifting member 500 both pivoting about horizontal axes and pivot points as well as having its stub axle 523 slide rearward in the slotway 511 of the left housing side wall 201.

Figure 32:
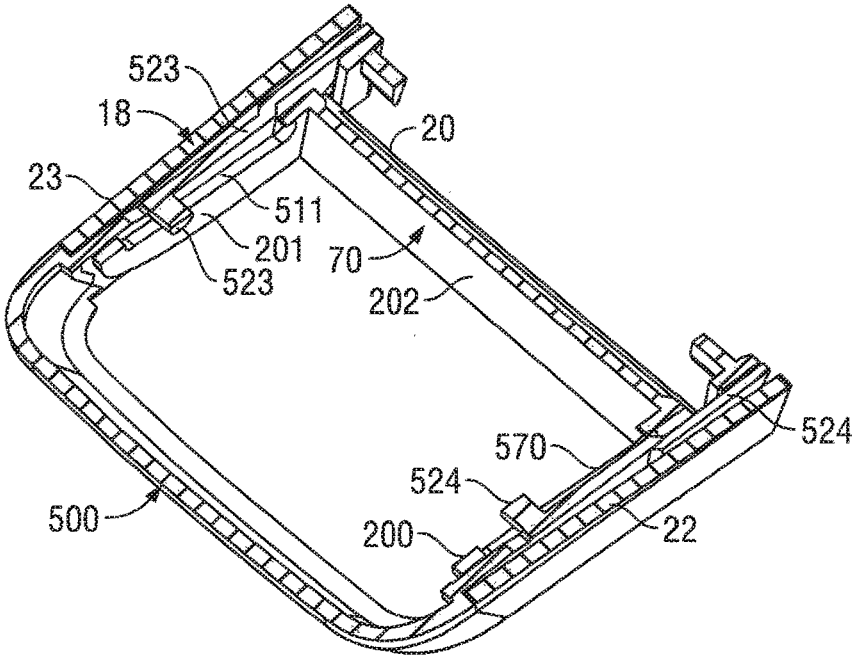
FIG. 32 is a cross-sectional top pictorial view of the dispenser assembly of FIG. 1 along a horizontal section line B-B' on FIG. 2.

In understanding FIGS. 27 to 31, it is useful to understand that as illustrated in the cross-sectional top view of FIG. 32 that the components are being viewed from the left side in which, as can be seen in FIG. 32, the left side wall 23 of the cover 18 is to the left of the left arm 543 of the lifting member 500 which is to the left of the left side wall 201 of the housing 70. Thus, as seen in the top view of FIG. 32, the left arm 541 is in between the left side wall 201 of the housing 70 and the left side wall 23 of the cover 18.

Referring to FIG. 27, FIG. 27 illustrates the cover assembly 14 in the lower closed position and a latched condition. Absent the lifting member 500, the cover assembly 14 including the cover 18 with its lever 19 and rod member 20 are free to be slid axially upwardly relative to the housing assembly 16 between the lower closed position and upper positions including the fully open upper position of FIG. 31.

In each of FIGS. 27 to 31, the lifting member 500 is coupled to the housing assembly 16 with the stub axles 522 and 523 of the lifting member 500 slidably received within the slotways 510 and 511 of the housing 70. As seen in FIG. 27, the left stub axle 523 is spaced rearwardly from the front end of the left slotway 511 and a rear end of the left arm 543 is located underneath the left downwardly directed stop shoulder 535 of the left rear guide member 533. The left arm 541 overlies the rod member 20 with the rod member 20 engaged in a downwardly directed forward concave recess 579 of the lower surface 565 of the left arm 543. In the position of FIG. 27, the lifting member 500 is considered to be latching the cover 18 against upward movement and thus providing a latched condition to the dispenser assembly 10.

In moving from the position of FIG. 27 to the position of FIG. 28, a user manually pulls the lifting member 500 forwardly as shown by the arrow. As a result, the left stub axle 523 slides forwardly in the slotway 511 to proximate the forward end 513 of the slotway 511 and, in so doing, the rear end 563 of the left arm 543 is moved forwardly of the left rear guide member 533. In the position of FIGS. 27 and 28, the lower surface 505 of the left lifting flange 503 on the left side wall 23 of the cover 18 rests on top of the upper surface 561 of the left arm 543.

Figure 29:
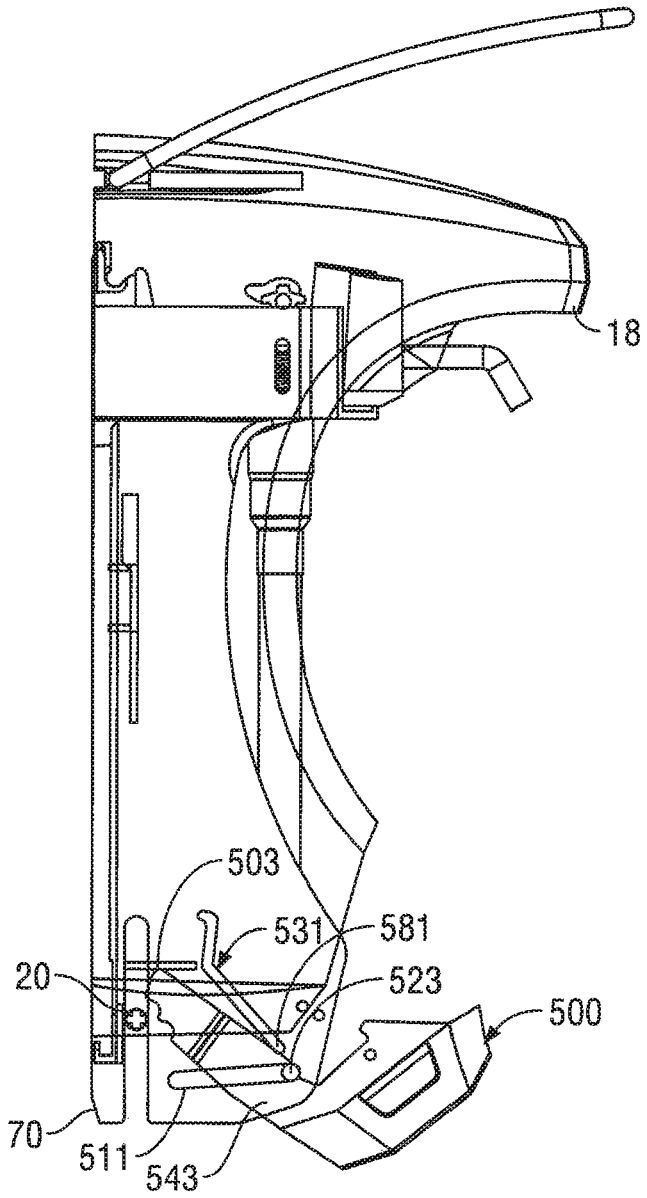
FIG. 29 a schematic left side view of the dispenser assembly of FIG. 1 with the cover assembly in a first partially open position, and the reservoir of the cartridge not shown and each of the lifting member and the cover drawn as being transparent.

In moving from the position of FIG. 28 to the position of FIG. 29, the lifting member 500 is pushed downwardly and rearwardly by a user indicated by the arrow. The lifting member 500 pivots about its left stub axle 523 within the left slotway 511. Proximate the rear end 563 of the left arm 543, the upper surface 561 engages the left lifting flange 503 to slide the cover 18 vertically upwardly relative to the housing 70. The lifting member 500 pivots about its stub axle 523 within the front end 513 of the left slotway 511 until the upper surface 561 engages a lower end 581 of the left guide flange 531 as seen in FIG. 29. In moving from the position of FIG. 29 to the position of FIG. 30, with the lifting member 500 being pushed downward and rearward in the direction of the arrow, the lifting member 500 pivots about the lower end 581 of the left guide flange 531 until the upper surface 561 of the left arm 543 is flush with the long straight section 583 of the left guide flange 531 at which point the left stub axle 523 is ready to move forwardly in the left slotway 511. The engagement of the end surface 563 of the left arm 543 with the left lifting flange 503 moves the cover 18 vertically upwardly from the position of FIG. 29.

Figure 30:
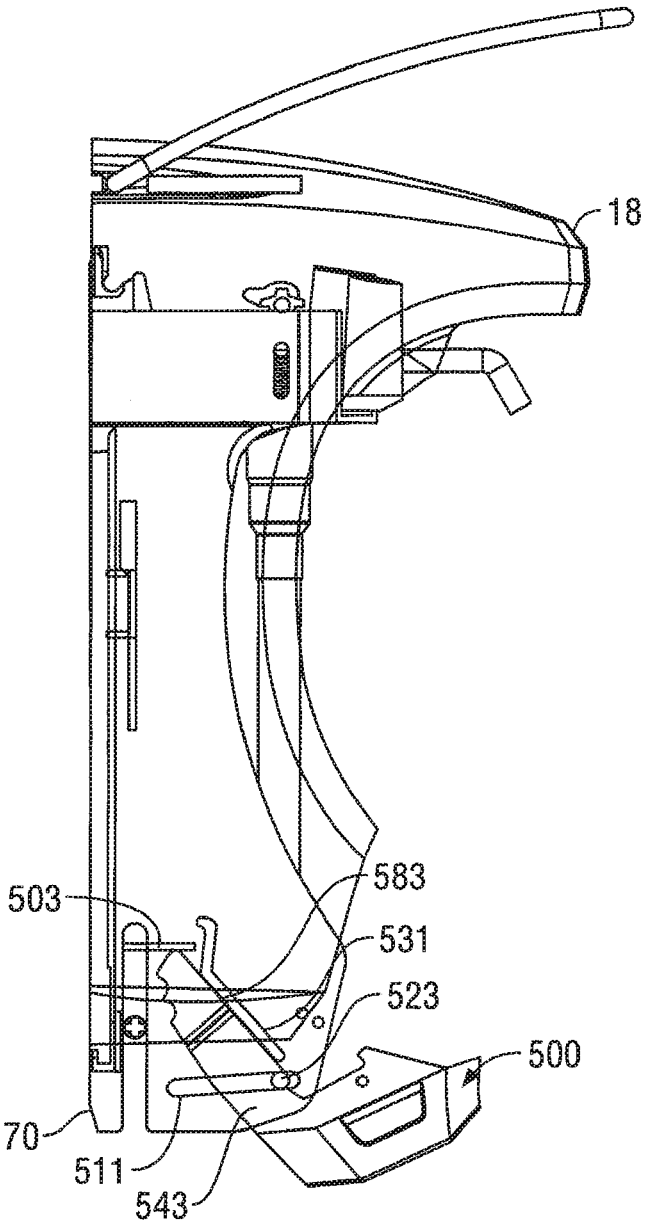
FIG. 30 a schematic left side view of the dispenser assembly of FIG. 1 with the cover assembly in a second partially open position, and the reservoir of the cartridge not shown and each of the lifting member and the cover drawn as being transparent.

In moving from the position of FIG. 30 to the position of FIG. 31, the lifting member 500 is pushed downwardly and rearwardly as indicated by the arrow. The left stub axle 523 slides rearwardly in the left slotway 511 as the upper surface 561 of the left arm 543 pivots about a pivot point at the corner 585 intermediate the long straight section 583 and the short straight section 587 of the left guide flange 531. The end surface 563 of the left arm 543 engages the left lifting flange 503 of the cover 18 to move the cover 18 upwardly from the position of FIG. 29. The left stub axle 523 moves in the slotway 511 to the rear end 515 of the slotway 511 at a time when the upper surface 561 of the left arm 543 comes to lie flush with the short straight section 587 of the guide flange 531 and into a bight 591 formed between the short straight section 587 of the guide flange 531 and a horizontal end portion 593 of the guide flange 531. The upper end 561 of the left arm 543 engages the lifting flange 503 to move the cover 18 upwardly to the open position shown in FIG. 31. The lower surface 565 of the left arm 543 may engage the forwardly directed rear guide member 533 to prevent further rearward movement of the lifting member 500.

In the condition shown in FIG. 31, the rear end 563 of the left arm 541 engages the lifting flange 503 at an engagement portion vertically forward of the stub axle 523. In this position, the weight of the cover 18 acting vertically downward attempts to rotate the lifting member 500 clockwise about the stub axle 523, that is, in a direction away from a direction that the lifting member 500 must move and rotate to permit movement of the cover 18 from the position of FIG. 31 to the position of FIG. 30.

Moving of the dispenser assembly 10 from an open position as shown in FIG. 31 towards the closed and unlatched position of FIG. 28 is accomplished by a user pulling the front portion 540 of the lifting member 500 upwardly and forwardly. The motion of the lifting member 500 in moving from the position of FIG. 31 to the position of FIG. 29 does not necessarily precisely duplicate the relative motion that occurs as described above in moving from the position of FIG. 28 to the position of FIG. 31. However, in movement from the position of FIG. 31 to the position of FIG. 28, the left arm 543 is maintained above the rod member 20 and constrained to have its end surface 563 forward of the forwardly directed rear guide member 533 at least by engagement with the rear guide member 533. The lower surface 565 of the left arm 543 will be maintained at least proximate its end surface 563 above the rod member 20. In a case where the cover assembly 14 may become stuck and may not under its own weight slide downwardly relative the housing 70, the downwardly directed rear arcuate portion 577 of the lower surface 561 proximate the end surface 563 of the left arm 543 will come to engage the upper surface of the rod member 20 and urge the rod member 20 downwardly thus moving the rod member 20 and hence the cover assembly 14 downwardly.

Reference is made to FIG. 23 illustrating a cross-sectional view along longitudinal center line A-A' in FIG. 2 showing the cartridge 15 coupled within the dispenser assembly 10 with the cover assembly 14 in the lower closed position relative to the housing assembly 16 in an operative condition ready for operation of the dispenser assembly 10 to dispense fluid.

When the cover assembly 14 is in the raised upper position relative the housing assembly 16 as seen in FIGS. 25 and 26, the cartridge 15 is horizontally slidable rearwardly to engage with the housing assembly 16 such that the bottle 101 comes to be received within the interior compartment 46 defined within the housing 70 intermediate the housing left and right side walls 200 and 201, forwardly of the back wall 202 and between the horizontal support flange 202 and the bottle support flange 116 that bridges between the housing side walls 200 and 201 with the bottom of the bottle 101 engaged and supported by a bottle support flange 116. The pump mechanism 100 is slid rearwardly into engagement with the support flange 202 of the housing 70 into the slot 205 of the support flange 202 with the support plate 117 of the piston chamber-forming body 110 above the support flange 202 between the horizontal support flange 204 and the right and left vertical guide walls 120 and 121, and below the upper pump holding member 508. On moving the cover 18 to the closed position, the piston chamber-forming body 110 is fixedly secured to the housing 70 between the support flange 202 and the upper pump holding member 508 against vertical movement, and suitably located relative the pump actuator plate 75.

As shown in FIG. 23, the piston-forming element 111 is disposed vertically below the pump actuator plate 75. To dispense fluid with the dispenser assembly 10 in the orientation shown in FIG. 23, a user engages the exterior handle portion 32 of the lever 19 and moves the exterior handle portion 32 of the lever 19 downwardly pivoting the lever 19 relative to the housing 70 about the axle axis 35 which moves the forward ends of the right and left actuator rods 42 and 43 of the interior actuator portion 33 of the lever 19 downwardly causing the actuator plate 75 to slide vertically downwardly against the bias of the left and right plate springs 76 and 77 and move the piston-forming element 111 vertically downwardly relative to the piston chamber-forming body 10, dispensing fluid from the bottle 101 out the discharge outlet 113 onto a user's hand disposed underneath the outlet 113. On release of the lever 19 by the user, under the bias of the left and right plate springs 76 and 77, the pump actuator plate 75 returns to the raised position and pivots the lever 19 to return to the position shown in FIG. 22. The pump spring biases the piston-forming element 111 to return to a raised position as shown in FIG. 17.

The cartridge 15 is adapted to be removed and replaced preferably by a new entire cartridge 15 as seen in FIGS. 25 and 26, however, possibly with the bottle 101 being removed from the cartridge 15 and refilled. Removal and replacement of merely the bottle 101 is possible such as illustrated in FIGS. 39 and 40 when the dip tube may be rigid the bottle 101 removed the pump mechanism 100 may be separately removed and replaced. Removal and replacement is carried out with the cover assembly 14 in the upper open opposition relative the housing assembly as seen FIGS. 25 and 26.

After use of the dispenser assembly 10 for periods of time, portions of the dispenser assembly 10 which may be engaged by users may become contaminated as with pathogens and the like. Preferably, from time to time, the cover assembly 14 is removed from the housing assembly 16 and the cover assembly may then be suitably cleaned as preferably by being placed in an autoclave or washing machine. The cover assembly 14 when cleaned may then be reattached to the housing assembly 16. Alternatively, a new or different cover assembly 14 and a new or different lever 19 may be applied. Coupling to or removal of the cover assembly 14 from the housing assembly 16 is accomplished with the cover 18 and the lever 19 coupled together. After removal of the cover assembly 14 from the housing assembly 16, the lever 19 can be removed from the cover 18 for separate washing and/or replacement. Separate washing of the cover 18 and lever 19 is advantageous to clean the surfaces where the axle keyhole openings 27 engage the axle 31.

Figure 47:
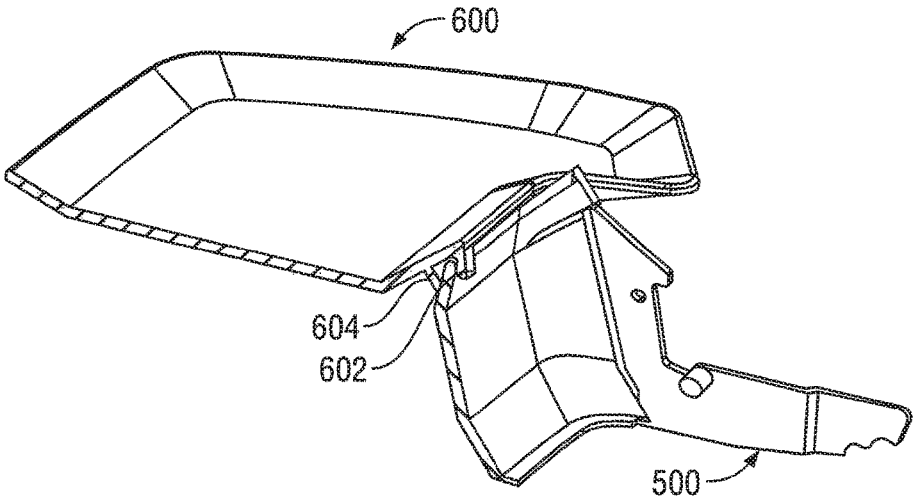
FIG. 47 is a pictorial cross-sectional side view of the drip tray and a lifter member in FIG. 42.

Reference is made to FIGS. 42 to 48 showing a dispenser assembly 10 identical to that illustrated in FIGS. 1 to 41, however, additionally including a drip tray 600. The drip tray 600 is removably secured to the lifting member 500 in a snap-fit manner as best seen in the cross-sectional side view of FIG. 47 showing the upper edge of the forward portion 540 of the lifting member 500 engaged in a snap-fit between a rear tab 602 and a forward flange 604 carried on the underside of the drip tray 600.

The drip tray 600 is provided so as to catch excess fluid or overspray of fluid that might be discharged from the dispenser assembly 10 or that might drop from the pump outlet when the pump is not in use. The drip tray 600 is configured such that when coupled to the lifting member 500, the drip tray 600 and the lifting member 500 may be moved through the positions of FIGS. 27 to 31 without interference with the remainder of the dispenser assembly 10. The drip tray 600 is configured to be snap-fit onto the lifting member 500 such that in the event excess forces are attempted by a user to be applied to the lifting member 500 by a user engaging the drip tray 600, the drip tray 600 will come to disengage from the lifting member 500. The drip tray 600 is advantageously removable and replaceable from the dispenser assembly 10 as can be of assistance in reducing the volume of a dispenser assembly 10 when shipped.

Figure 33:
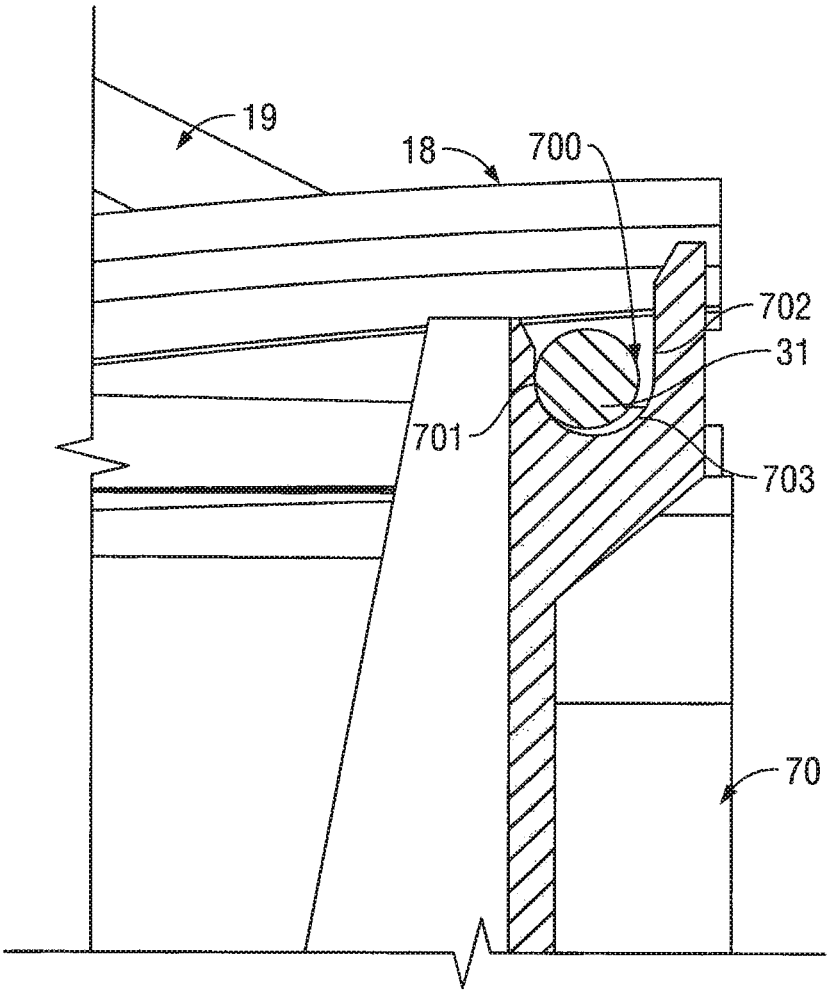
FIG. 33 is a cross-sectional right view of an upper portion of the dispenser assembly of FIG. 1 along a vertical section line D-D' on FIG. 2.

Reference is made to FIG. 33 which illustrates that at the upper rear of the housing 70, an axle opening 700 is provided defined to open vertically upwardly between a vertical front wall 701 and a vertical rear wall 702 closed by a bottom wall 703. As can be seen in FIG. 33, the axle 31 of the lever 19 is removably coupled within the upwardly opening axle opening 700 with the axle 31 becoming engaged with and removed from this axle opening 700 with vertical sliding of the cover assembly 14 relative to the housing 70. As seen in FIG. 9, the lever 19 is removably coupled to the cover 18 within the axle keyway opening 27 which opens horizontally rearwardly. The cover 18 and the axle keyway openings 27 are also shown in FIG. 33. From FIG. 33, it can be seen that when the cover 18 is in a closed position on the housing 70 that the axle 31 is captured within the horizontally opening axle keyway openings 27 and the vertically opening axle opening 700 against removal.

In the preferred first embodiment of the invention, the lifting member 500 needs to move forwardly from the close unlatched position of FIG. 27 to unlatch the cover 18 such that the cover may be slid upwardly. Such latching is not necessary and the lifting member 500 may be simplified, for example, to merely comprise a lever member. In this regard, the lifting member 500 could be modified as indicated schematically on FIG. 21 to eliminate each of the hooks 572 and 573 by cutting them off along the dotted lines 800 and by reducing the rearward length of each of the arms 542 and 543 to have a length indicated by the dashed line 804 and 805. The housing 70 can be modified so as to replace the slots 510 and 511 each by circular opening approximate the forward end of each of the slotways 510 and 511. With such a configuration, the lifting member 500 would merely pivot about a fixed horizontal axis through the stub axial 522 and 523 in each circular opening on the housing 70 with the reduced length rear ends of the arms 542 and 543 to engage the lifting flanges 502 and 503 and move the cover 18 upwardly relative to the housing 70 between closed and opened positions. With such simplified lever arrangement, or separate latching arrangement could be provided to latch the cover 18 in the closed position.

In an arrangement in which the lifting member 500 is merely to pivot about a fixed axial relative to circular openings in the housing 70 then the guide flanges 530 and 531 which would need to be eliminated or alternatively amended such that they may merely provide a function as a stop point stopping the rotation of the left and right arms of the lifting member at a desired fully opened position.

As a modification between an arrangement in which the lifting member 500 is merely rotatable about the stub axials circular openings on the housing 70 an arrangement could be provided in which each of the slotways 510 and 511 are of reduced length from front to rear.

The lifting member 500 in accordance with the first embodiment is arranged such that weight of the cover 18 either biases the lifting member 500 to a fully open position or to a fully closed position. This arises by reason of the relative location that the weight of the cover 16 via the lifting flanges 502 and 503 acts downwardly on the arms 542 and 543 of the lifting member 500 relative to where the stub axials 522 and 523 engage the housing 70. Providing the weight of the cover 18 to be directed downwardly forward of the location of the stub axials, biases the lifting member 500 to remain in the fully open position under the weight of the cover 18. Similarly, in a full opened position, at least when unlatched, the weight of the cover 18 biases the lifting member 500 towards to the fully closed position. With such biasing to the full closed position or the fully opened position is not necessary, however, is preferred and could be incorporated in any other arrangements for coupling of the lifting member 500 to the housing 70 as, for example, in a case that the lifting member 500 is but coupled to the housing member 70 for rotation about a single fixed axis.

The invention of the present application provides a novel combination of cover 18, more preferably of a cover assembly 14, in which lever 19 is carried by the cover 18 for sliding of the cover 18 upwardly and downwardly relative to the housing 70 by the use of a relatively simple lifting member 500 mechanically linked at a lower end of the housing 70 between the housing 70 and the cover 18. The lifting member 500 acts preferably in the manner of a lever in the sense of being pivoted relative the housing about the at least one horizontal axis, and preferably about a plurality of different axis at different positions of the stub axles in the slot ways, some of which axis are centered on the guide flanges as fulcrum or pivot points. Advantageously, when the cover assembly 18 is in the closed position, lever 19 is captured against removal between the cover 18 and the housing 70.

The preferred embodiments illustrate one particular arrangement for a pump mechanism and a bottle for the fluid dispensers. Various other pump arrangements and arrangements of pumps and bottles may be utilized. For example, the pump mechanism and bottle may be removed separately or the pump mechanism and bottle may be provided as an integral unit which is removed as a unit.

The preferred embodiments illustrate the use of a piston pump which has similarities to the piston pump disclosed in U.S. Patent Publication US 2008/0121644 to Ophardt et al, published May 29, 2008. The pump mechanism, however, is not limited to the use of a piston pump mechanism and various other pump mechanisms may be provided which are activated by movement of the lever.

In the preferred embodiment, the axle keyway openings 27 are shown to extend through a rear edge of each of the side walls 22 and 23. Insofar as the side walls may have a portion which extends rearwardly beyond the top wall, then it is possible for the axle keyway openings 27 to open upwardly through an upper edge of each of the side walls.

The manner of coupling the lever 19 to the side wall is illustrated in accordance with the present invention on a cover 18 that is generally open forwardly. The cover 18, however, may be closed on its front face bridging between the side walls. Each axle keyway opening may be provided to extend to a bottom edge of each of the side walls or to a rear edge of each of the side walls at the lower rear edge of the side walls. Thus, the axle keyway openings may be provided through the cover side walls at a convenient location. The advantageous manner of mounting the lever 19 to the cover through the axle keyway openings 27 in the cover can be adapted, for example, to have a lever 19 proximate the lower end of the cover and operative to engage a pump mechanism, for example, disposed in a lower portion of the dispenser assembly.

The preferred embodiment illustrates a preferred arrangement for providing for vertical sliding of the cover 18 relative to the housing assembly with upwardly located right and left latch members engaged within slide grooves in the cover side walls. Alternate configurations for the latch members and the slide grooves may be provided which guide the cover in vertical sliding relative to the housing assembly.

The preferred embodiment illustrates the rod member as also providing for guided sliding of the cover relative to the housing assembly vertically as well as for pivoting about the rod member. Substitute structures may be provided in which the equivalent of the rod member is carried, for example, as stub axles on the housing side walls and slide grooves on the cover side wall.

Reference is made to FIGS. 48 to 53 which illustrate a housing 70 for a dispenser in accordance with a third embodiment the present invention. FIGS. 48 to 53 show a lower portion of the housing 70 in a view similar to that shown in FIG. 12 with the first embodiment. In FIG. 12, the bottle support flange 116 is fixedly secured to bridge between the housing side walls 200 and 201 and the back wall 202. In contrast in FIGS. 48 to 53 a removable bottle support ledge member 116 is provided and each of the right side wall 200, the left side wall 201 and the back wall 202 are provided with coupling openings by which the support ledge member 116 is removably coupled to the housing 70 for removal and replacement. As can be seen in FIGS. 48 to 53, the housing 70 has the right side wall 200, the left side wall 201 and the back wall 202 with the right side wall 200 and the left side wall 201 coupled together spaced laterally from each other by the back wall 202 defining therebetween the interior 46 of the housing 70.

Figure 48:
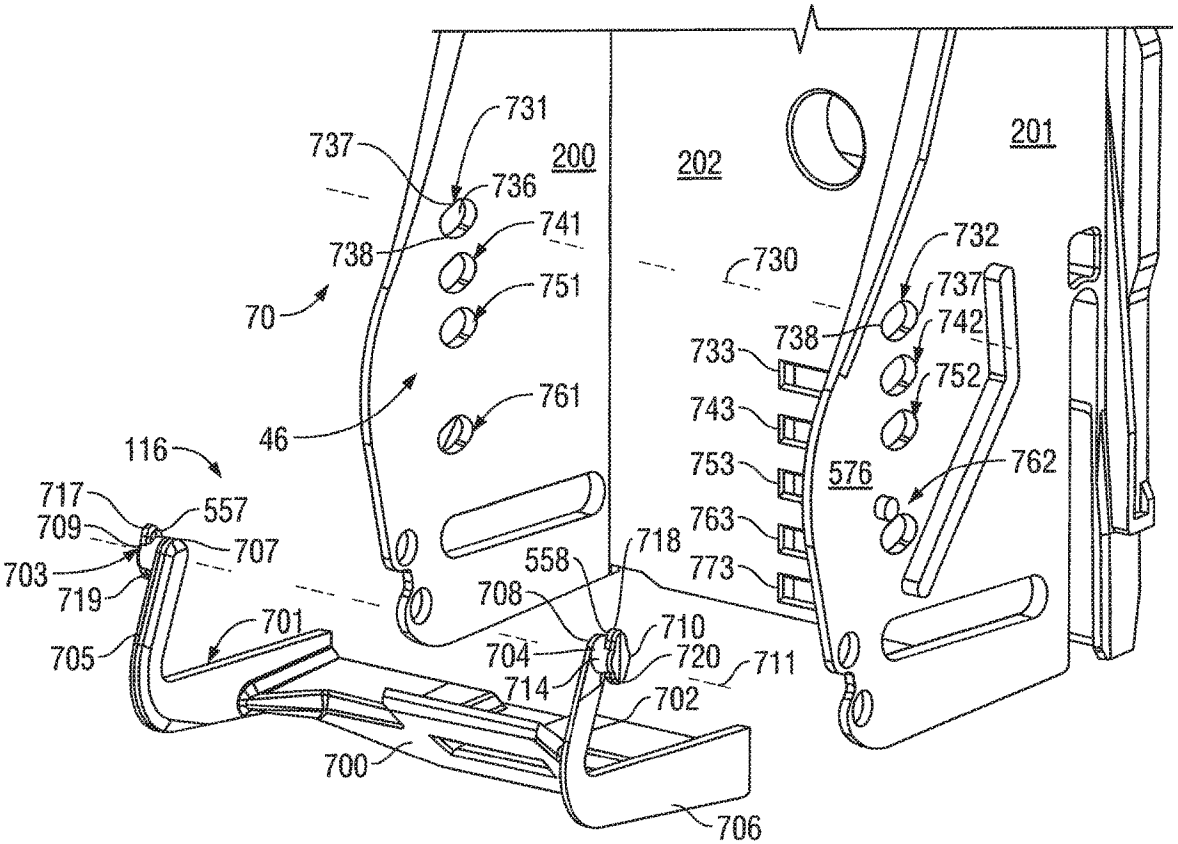
FIG. 48 is an exploded front perspective view of a lower portion of a housing and a removable support ledge member in accordance with a third embodiment of the present invention.

As can be seen in FIG. 48, the support ledge member 116 has a central plate portion 700 carrying a right side arm 701 and a left side arm 702. A right spigot 703 extends laterally to the right of the support ledge member 116 laterally from a lateral outer side 705 of the right side arm 701 proximate a distal end 707 of the right side arm 701. A left spigot 704 extends laterally to the left from the support ledge member 116 from a lateral outer side 706 of the left arm 702 proximate a distal end 708 of the left arm 702. The right spigot 703 extends from the side arm 701 to a distal right spigot end 709. The left spigot 704 extends from the left side arm 702 to a distal left spigot end 710. The right spigot 703 extends laterally to the right of the support ledge member 116 about a pivot axis 711. The left spigot 704 extends laterally to the left along the same pivot axis 711. The right spigot 703 extends from the right side arm 701 as a cylindrical post portion 713 coaxially disposed about the pivot axis 711, however, carrying over an axial locking portion proximate the distal end of the right spigot 703 a pair of diametrically opposed ears 717 and 719 which extend radially outwardly from the pivot axis 711. The left spigot 704 extends from the left side arm 702 as a cylindrical post portion 714 coaxially disposed about the pivot axis 711 however carrying over an axial locking portion proximate the distal end 710 of the left spigot 704 a pair of diametrically opposed ears 718 and 720 which extend radially outwardly from the pivot axis 711.

The central plate portion 700 carries a rear latch member 721 that extends radially relative to the first pivot axis 711.

A first set of openings is provided in the housing 70 comprising a first right opening 731 provided in the right side wall 200 disposed about a first opening axis 730 and a second left opening 732 provided in the left side wall 201 disposed about the same the first opening axis 730 and a first upper latch opening 733 and a first lower latch opening 743 at a central location in the back wall 202. The first upper latch opening 733 and a first lower latch opening 743 are identical horizontal slots spaced vertically from each other. Each of the first right opening 731 and the first left opening 732 comprises a cylindrical bore 736 but for a pair of cut out axially extending channels 737 and 738 extending radially from the bore 736 at diametrically opposed locations diametrically opposed from each other. Each of the first right opening 731 and the first left opening 732 have a shape and size that permits the respective right spigot 703 and the left spigot 704 to be axially slidable through the respective first right opening 731 and the first left 732 when the support ledge member 116 is disposed with the pivot axis 711 coaxial with the first opening axis 730, provided that the respective right spigot 703 and the left spigot 704 spigots are disposed rotated about the pivot axis 711 at an insertion angle relative to the housing 70 that the ears 717 and 719 on the right spigot 703 and the ears 718 and 720 the left spigot 704 axially align with the channels 737 and 738 in the respective first right opening 731 and the first left opening 732 as seen in FIG. 50.

Figure 49:
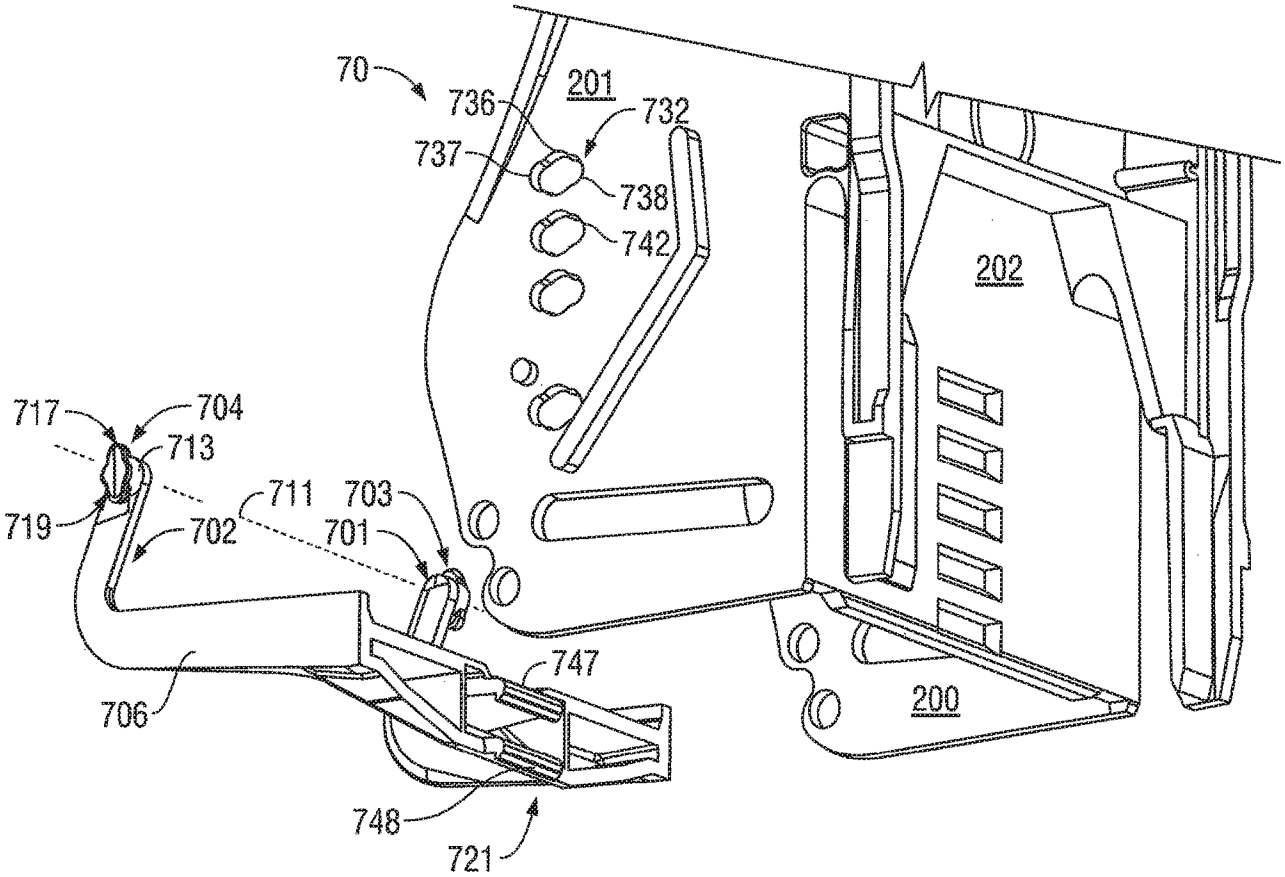
FIG. 49 is an exploded rear perspective view of the lower portion of the housing and the removable support ledge member in FIG. 48.
Figure 50:
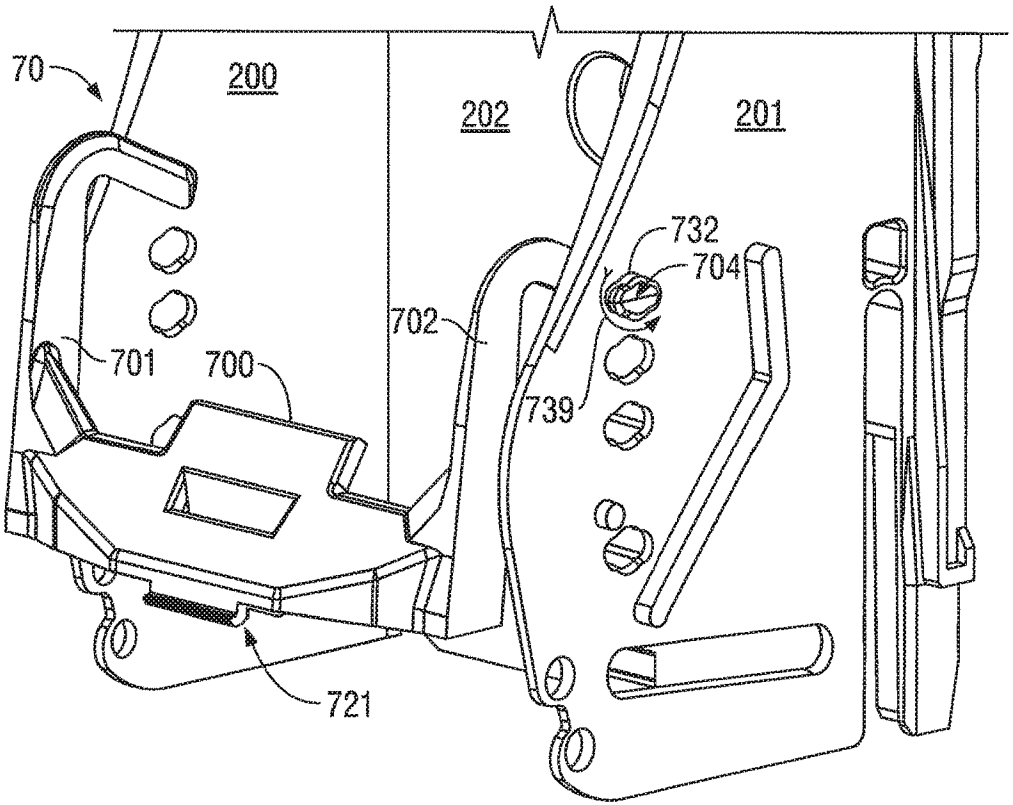
FIG. 50 is a front perspective view of the lower portion of the housing of FIG. 48 with the support ledge member in an unlatched coupled condition relative to the housing.
Figure 51:
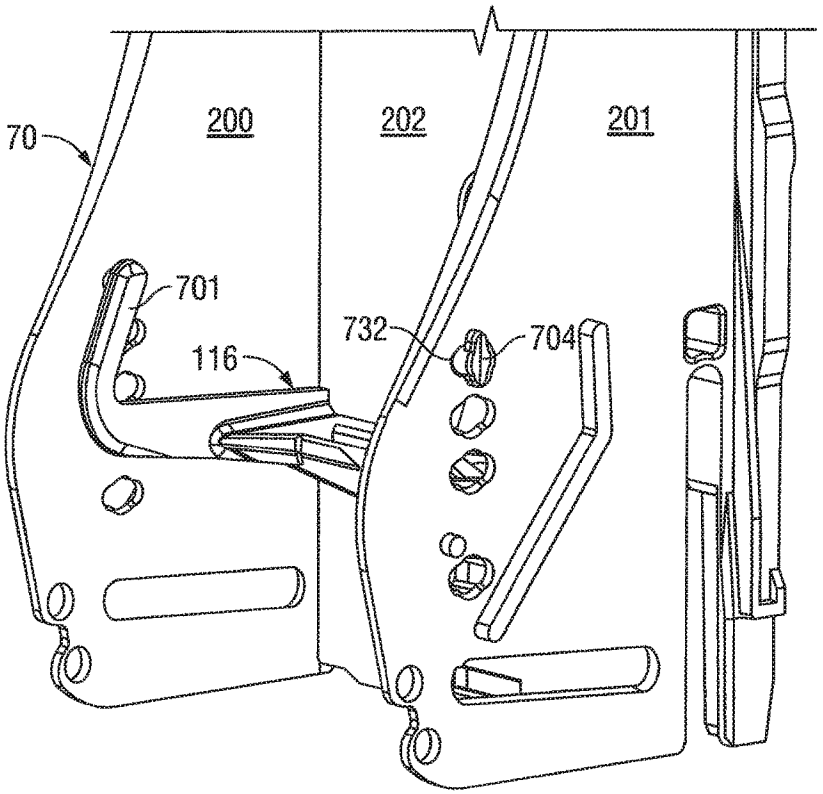
FIG. 51 is a side perspective view of the lower portion of the housing of FIG. 48 with the support ledge member in a latched condition relative to the housing.
Figure 52:
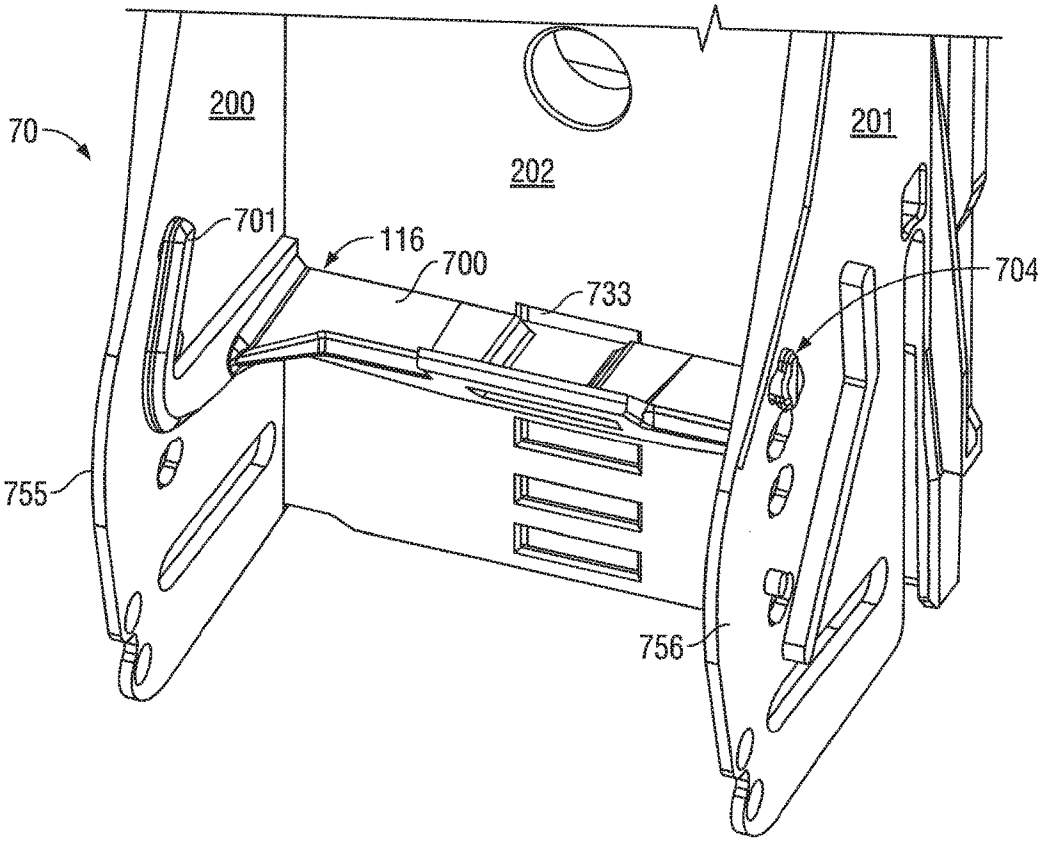
FIG. 52 is a front perspective view of the lower portion of the housing and the support ledge member in the latched condition shown in FIG. 51.
Figure 53:
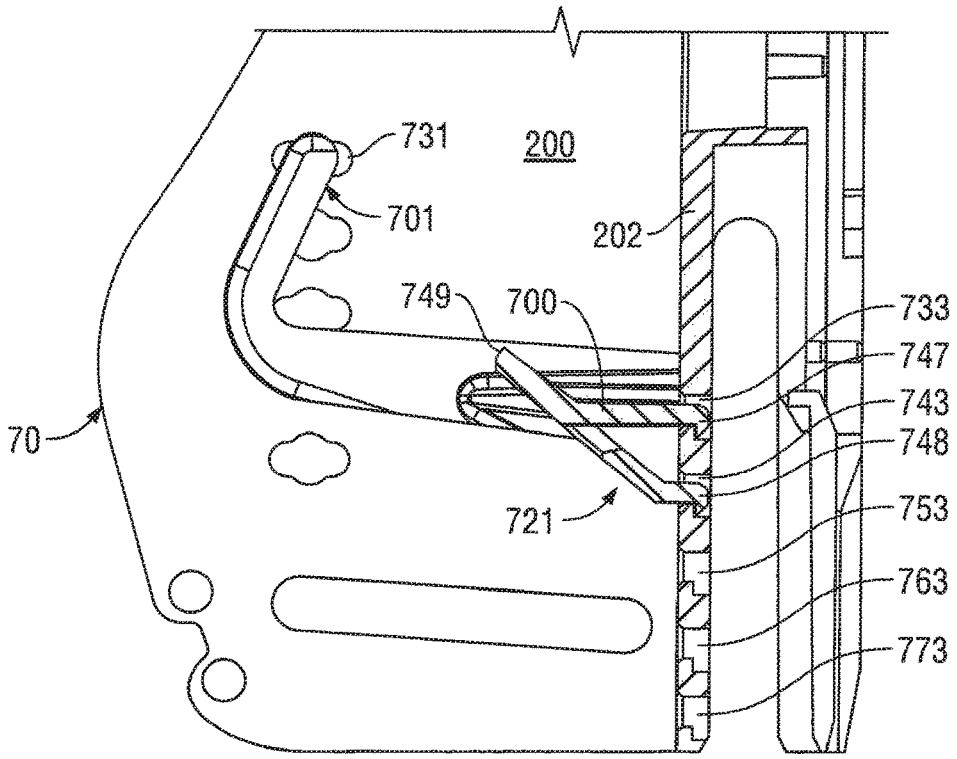
FIG. 53 is a cross-sectional side view centrally through the housing of the lower portion of the housing and the support ledge member in the latched condition shown in FIG. 51.

In the position of FIG. 50, the support ledge member 116 is rotatable about the pivot axis 711 and the coincident opening axis 730 in the direction shown by the arrow 739 on FIG. 50 to place the rear latch member 721 into engagement with the upper latch opening 733 and the lower latch opening 743 of the back wall 202 and assume a latched position as shown in FIG. 53. As can be seen in FIGS. 49 and 53 the rear latch member 721 comprises a pair of horizontally extending resilient tabs 747 and 748 which are resilient and, when the support ledge member 116 is rotated so that the tabs 747 and 748 of the rear latch member 721 becomes engaged in the upper latch opening 733 and the lower latch opening 743. Under an inherent bias of the tabs 747 and 748, the rear latch member 721 become engaged in a friction, snap-fit relation within the upper and lower latch openings resisting removal. In the latched position of FIGS. 51, 52 and 53, the support ledge member 116 provides an upwardly directed support surface 749 for supporting a bottle located thereon in the interior 46 of the housing 70.

In the preferred embodiment shown, each of the right side wall 200 and the left side wall 201 are resilient so as to deflect away from each other to permit the distance between the first right opening 731 on the right wall 200 and the first left opening 732 on the left wall 201 to be increased for insertion and removal of the right spigot 703 in the first right opening 731 and the left spigot 704 in the first left opening 732, with the support ledge member 116 disposed rotated about the first axis 711 at the insertion angle relative to the housing 70 as shown in FIG. 50.

The housing 70 has been described as having a first set of openings 731, 732 and 733/743 to receive the support ledge member 116 at a first location on the housing 70 While merely one set of openings may need be provided so as to permit the support ledge member 116 to be formed as a separate element and be removably coupled to the housing, preferably, a plurality of sets of identical openings are provided to permit the support ledge member 116 to be removably coupled to the housing 70 at different relative heights on the housing 70, for example to accommodate bottles of different heights. In this regard, as best seen on FIG. 50 the housing 70 is provided with: a second set of openings comprises a second right opening 741, a second left opening 742 and latch openings 743/753; a third set of openings comprises a third right opening 751, a third left opening 752 and latch openings 753/763; and a fourth set of openings comprises a fourth right opening 761, a fourth left opening 752 and latch openings 756/773 In the same manner that the support ledge member 116 is removably coupled to the housing via the first set of openings, the support ledge member 116 may also be removably coupled to the housing in any one of the second, third or fourth sets of openings.

In the coupled unlatched position as shown in FIG. 49, the ears 717 and 719 on the right spigot 703 extend laterally through the first right opening 731 to be laterally farther outwardly than a laterally outwardly directed surface 755 of the right side wall 200. On pivoting of the support ledge member 116 from the position of FIG. 50 to the position of FIG. 49, the ears 717 and 719 on the right spigot 703 rotate relative the right side wall 200 to become located laterally outwardly of and overlying the laterally outwardly directed surface 755 of the right side wall 200 with each ears 717 and 719 presenting a laterally inwardly directed shoulder 557 surface in opposition to the laterally outwardly directed surface 755 of the right arm 701 capturing the right side wall 200 between a laterally outwardly directed surface 559 of the right arm 701 and the ears 717 and 719 on the right spigot 703.

Similarly, in the coupled unlatched position as shown in FIG. 49, the ears 718 and 720 on the left spigot 704 extend laterally through the first left opening 732 to be laterally farther outwardly than a laterally outwardly directed surface 756 of the left side wall 201. On pivoting of the support ledge member 116 from the position of FIG. 50 to the position of FIG. 49, the ears 718 and 720 on the left spigot 704 rotate relative the left side wall 201 to become located laterally outwardly of and overlying the laterally outwardly directed surface 756 of the left side wall 201 with each ears 718 and 720 presenting a laterally inwardly directed shoulder surface 558 in opposition to the laterally outwardly directed surface 756 of the left arm 702 capturing the left side wall 201 between a laterally outwardly directed surface 560 of the left arm 702 and the ears 718 and 720 on the left spigot 704.

In the latched position as shown in FIG. 49, the capturing engagement of the right spigot 703 with the right side wall 200 and the left spigot 704 with the left side wall 201 fixes the distance that the side walls 200 and 201 are spaced from each other providing increased rigidity and structural integrity to the housing 70. As well, with the engagement of the rear latch member in the first latch opening in the back wall 202, a triangular connection of the right side wall 200, the left side wall 201 and the back wall 202 is provided also increasing the rigidity and structural integrity of the housing 70.

While not necessary, the laterally inwardly directed shoulder surface 557 of each ear 717 and 719 of the right spigot 703 is preferably beveled relative the axis 711 to be spaced at greater distance parallel the axis 711 from the laterally outwardly directed surface 755 of the right arm 701 at a leading edge of each ear than at a trailing edge, so as to with engagement of the laterally outwardly directed surface 755 of the right side wall 200 draw right side wall 200 laterally toward the right arm 701 preferably into a frictional engagement between right arm 701 and the ears 717 and 719. Similarly, while not necessary, the laterally inwardly directed shoulder surface 558 of each ear 718 and 720 of the left spigot 704 is preferably beveled relative the axis 711 to be spaced at greater distance parallel the axis 711 from the laterally outwardly directed surface 756 of the left arm 702 at a leading edge of each ear than at a trailing edge, so as to with engagement of the laterally outwardly directed surface 756 of the left side wall 201 draw the left side wall 201 laterally toward the left arm 702 preferably into a frictional engagement between left arm 702 and the ears 718 and 720.

In the third embodiment, the right spigot 703 has ears 717 and 719 and the left spigot 70 has ears 718 and 720, however, such ears are not necessary and each spigot 703 and 704 may merely comprise a post member to be removably received in the respective first openings 731 and 732 and permitting movement of the support flange 116 to engage the rear latch member 721 in the first latch opening 733 in the back wall 202 and assume a latched position similar to that shown in FIG. 50.

Figure 54:
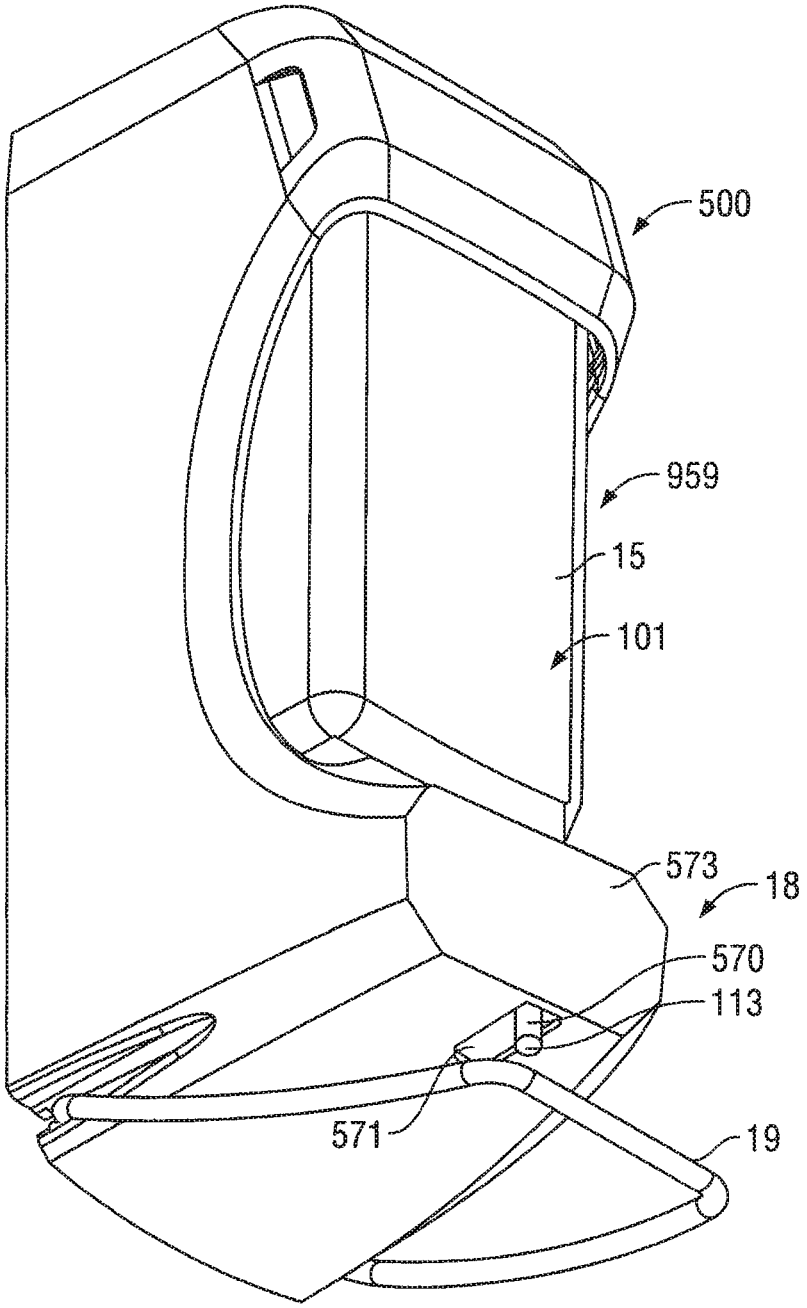
FIG. 54 is a pictorial view of a fluid dispenser assembly in accordance with a fourth embodiment of the present invention in an operative position.
Figure 55:
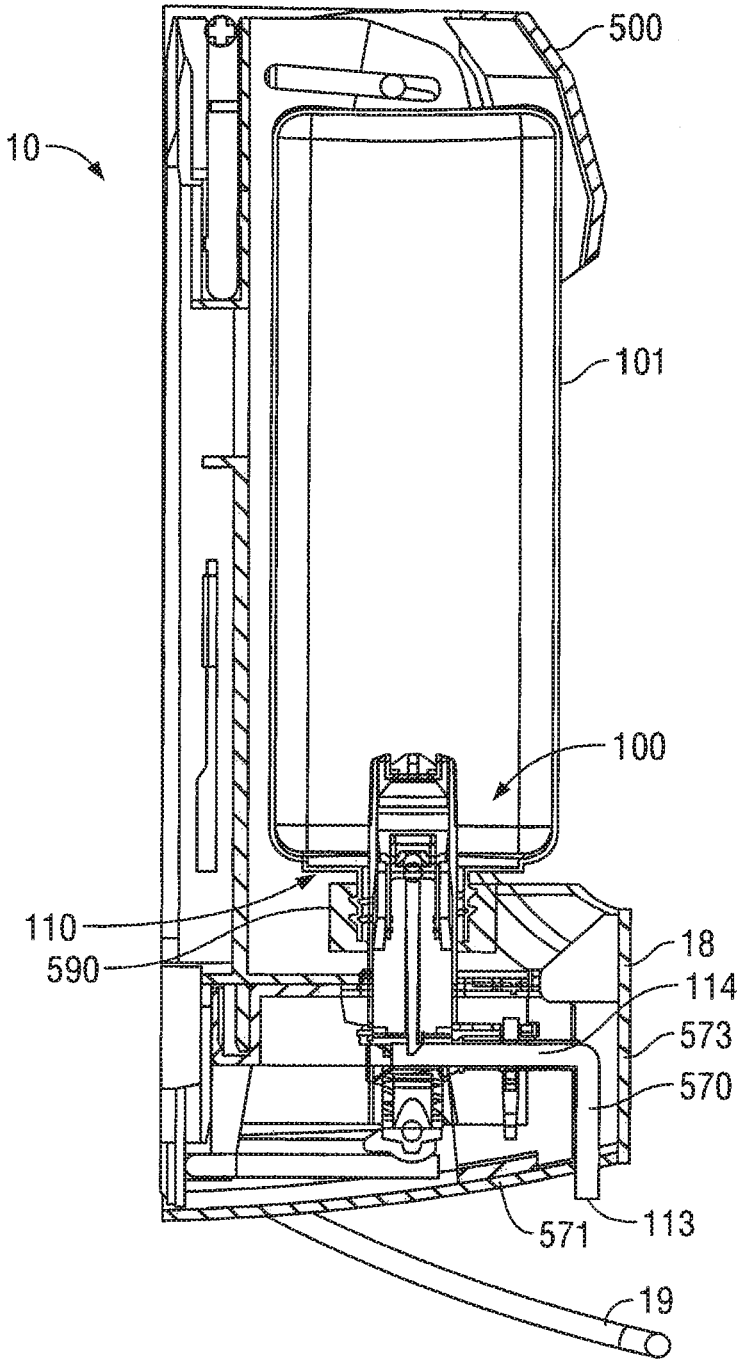
FIG. 55 is a cross-sectional side view of the dispenser assembly of FIG. 52 along central section line.

Reference is made to FIGS. 54 and 55 showing a fourth embodiment of a dispenser 10 in accordance with the present invention which has close similarities to the dispenser of first embodiment, however, inverted such that the dispenser 10 in FIGS. 54 and 55 is adapted for dispensing fluid vertically downwardly from a discharge outlet 113 at a lower end of the dispenser assembly 10.

In the embodiment of FIGS. 54 and 55, the dispenser assembly 10 also contains the same four principal components, namely, a cover assembly 14, a cartridge 15, a housing assembly 16 and a cover actuator member 500 as in the first embodiment. Each of these elements in the embodiments of FIGS. 54 and 55 have equivalent elements in the first embodiment and similar reference numerals are used to refer to similar elements. Differences between the elements in first embodiment and the elements in the second embodiment are merely the following:

1. The provision of a threaded mounting flange 590 on the piston chamber-forming body 110 so as to sealably engage the pump assembly 100 to the bottle 101.
2. Preferably, the provision of providing the bottle 101 to be collapsible.
3. The elimination of the dip tube 112.
4. Elimination of the support ledge member 116.
5. Elongation of the bottle 101 such that it may extend further upwardly inside the housing 70.
6. Modification of the forwardly extending discharge tube 114 to provide a downwardly extending section 570 that leads downwardly away from the bottle 101 to the discharge outlet 113.
7. Truncation of the cover 18 so as to have a blunt front wall 573 not extend as far forward as the front of the cover in the first embodiment.
8. The provision of an elongate opening 571 through the top wall of the cover 18 through which the tubular extension of the discharge tube 114 extends.
9. Reducing the length of the lever 19.

In the embodiment of FIGS. 54 and 55, the cover assembly 14 is vertically slidable relative to the housing assembly between a closed upper position as shown in FIG. 55 and a lower open position, not shown. The cover actuator member 500 operates in the same manner as the lifting member 100 in the first embodiment. In the embodiment of FIGS. 54 and 55, the cover actuator member 500 is in a lower closed position and the cover 18 is in the upper closed position. On movement of the cover actuator member 500 to an upper open position moves the cover assembly 14 to the lower open position.

FIGS. 54 and 55 illustrates a condition in which the dispenser 10 is ready for operation and a user on manually urging the lever 19 downwardly and rearwardly will discharge fluid onto a user's hand and engage with the lever by discharge of the fluid downwardly from the discharge outlet 113.

FIGS. 54 and 55 in order to remove or insert the cartridge 15, the cover actuator member 500 is moved from the lower closed position to an upper open position and, in so doing, the cover assembly 18 is moved to a lower open position in a manner analogous with than described with reference to the first embodiment of FIG. 1, however, inverted. With the cover assembly 18 in the lower open position and the cover actuator member 500 in the upper raised position, the cartridge 15 can be removed and inserted by locating the support flange 117 on the piston chamber-forming body 110 between the pump holding member 508 and the support flange 202 in an analogous manner to that described with the first embodiment albeit inverted. The fourth embodiment of FIGS. 54 and 55 has many of the same advantages as the first embodiment including, for example, providing a viewing window 959 between the upper cover actuator member 500 and the lower cover assembly 118.

The fourth embodiment of FIGS. 52 and 53 illustrate an arrangement similar to that in the first embodiment and may be inverted and be useful with fluid dispensers. The particular nature of the pump mechanism and the bottle and the manner that the pump mechanism and the bottle may become engaged supported on the housing 70 for engagement with and a pump actuator may vary from that illustrated in the present invention and may, for example, adopt various configurations such as shown, for example, in U.S. Pat. No. 8,464,912 to Ophardt et al., issued Jun. 18, 2013, the disclosure of which is incorporated herein by reference.

While the invention has been described with reference to preferred embodiments, many modifications and variations will now occur to persons skilled in the art. For a definition of the invention, reference is made to the accompanying drawings.

We claim:

1. A fluid dispenser having:

a housing having an interior with a forward opening providing access to the interior of the housing, a removable member selected from the group consisting of a fluid reservoir and a pump mechanism, a cover coupled to the housing for movement upwardly and downwardly between a closed position of the cover in which the dispenser is operative for dispensing fluid and an open position of the cover, a cover actuator member coupled to the housing for guided movement between a closed position of the cover actuator member and an open position of the cover actuator member guided by the housing including pivoting of the cover actuator member about at least one horizontal pivot axis relative the housing, the cover actuator member in the guided movement relative the housing engaging the cover to move the cover to between the open position of the cover and the closed position of the cover relative the housing such that with the cover actuator member in the closed position of the cover actuator member, the cover is in the closed position of the cover and with the cover actuator member in the open position of the cover actuator member, the cover is in the open position of the cover, with the cover actuator member in the closed position of the cover actuator member and the cover in the closed position of the cover, the cover covers a first portion of the forward opening of the housing and insertion and removal of the removable member from within the interior of the housing through the forward opening is prevented.

2. A fluid dispenser as claimed in claim 1 wherein the forward opening includes the first portion and a second portion, with the cover actuator member in the closed position of the cover actuator member and the cover in the closed position of the cover, the cover covers the first portion of the forward opening of the housing preventing insertion and removal of the removable member from within the interior of the housing through the forward opening.

3. A fluid dispenser as claimed in claim 1 wherein the forward opening includes the first portion and a second portion, with the cover actuator member in the closed position of the cover actuator member and the cover in the closed position of the cover, the cover actuator member covers the second portion of the forward opening of the housing preventing insertion and removal of the removable member from within the interior of the housing through the forward opening.

4. A fluid dispenser as claimed in claim 1 wherein the forward opening includes the first portion and a second portion, with the cover actuator member in the closed position of the cover actuator member and the cover in the closed position of the cover, the cover covers the first portion of the forward opening of the housing and the cover actuator member covers the second portion of the forward opening of the housing together preventing insertion and removal of the removable member from within the interior of the housing through the forward opening.

5. A fluid dispenser as claimed in claim 4 wherein with the cover actuator member in the open position of the cover actuator member and the cover in the open position of the cover, the first portion of the forward opening of the housing and the second portion of the access opening are open permitting insertion and removal of the removable member from within the interior of the housing through the forward opening.

6. A fluid dispenser as claimed in claim 5 wherein in the cover moving from the closed position of the cover to the open position of the cover, the cover moves vertically away from the cover actuator member to uncover the first portion and, in the cover actuator member moving from the closed position of the cover actuator member to the open position of the cover actuator member, the cover actuator member moves vertically away from the cover to uncover the second portion.

7. A dispenser as claimed in claim 6 wherein when the cover actuator member is in the closed position of the cover actuator member covering the first portion of the forward opening of the housing and the cover is in the closed lower position of the cover covering the second portion of the forward opening of the housing, a viewing opening is provided into the interior of the housing between the cover actuator member and the cover intermediate the lower portion of the forward opening of the housing and the upper portion of the forward opening of the housing.

8. A fluid dispenser as claimed in claim 1 wherein the guided movement includes guided sliding of the lifting member forwardly and rearwardly relative the housing.

9. A fluid dispenser as claimed in claim 8 wherein the housing includes a pair of spaced side walls, the cover actuator member including a pair of spaced arms, with one arm adjacent each of the side walls of the housing, a stub axle member carried by each arm extending horizontally into an opening in an adjacent side wall, the opening selected from a circular opening within which the stub axle is rotatable about a first horizontal axis, and a front to rear extending slotway in which the axle member is slidable between forward and rear positions with the stub axle rotatable within the slotway at each of a plurality of different positions within the slotway about a respective horizontal axis at each of the positions.

10. A fluid dispenser as claimed in claim 9 wherein the cover having a right cover side wall and a left cover side wall secured together spaced laterally from each other, and a top wall bridging between an upper portion of the right cover side wall and an upper portion of left cover side wall.

11. A fluid dispenser as claimed in claim 6 wherein the guided movement includes guided sliding of the cover actuator member forwardly and rearwardly relative the housing, within movement from the closed position to the open position, a front portion of the cover actuator member moving vertically and rearwardly relative to the housing and a rear portion of the cover actuator member in engagement with the cover moving vertically relative the housing.

12. A fluid dispenser as claimed in claim 1 wherein:

the closed position of the cover is upward from the open position of the cover, the closed position of the cover actuator member is downward from the open position of the cover actuator member.

13. A fluid dispenser as claimed in claim 1 wherein:

the closed position of the cover is downward from the open position of the cover, the closed position of the cover actuator member is upward from the open position of the cover actuator member.

14. A fluid dispenser as claimed in claim 13 wherein the removable member comprises the fluid reservoir, the fluid reservoir comprising a bottle supported on the housing within the interior of the housing with a bottom of the bottle within the interior rearward of the second portion and, when the cover actuator member is in the closed position of the cover actuator member, rearward of the cover actuator member.

15. A fluid dispenser as claimed in claim 13 wherein the removable member comprises the pump mechanism, the pump mechanism supported on the housing within the interior of the housing rearward of the first portion and, when the cover is in the closed position of the cover, rearward of the cover.

16. A fluid dispenser as claimed in claim 14 wherein the removable member comprises the pump mechanism, the pump mechanism supported on the housing within the interior of the housing rearward of the first portion and, when the cover is in the closed position of the cover, rearward of the cover.

17. A fluid dispenser as claimed in claim 2 wherein with the cover actuator member in the open position of the cover actuator member and the cover in the open position of the cover, the first portion of the forward opening of the housing and the second portion of the access opening are open permitting insertion and removal of the removable member from within the interior of the housing through the forward opening.

18. A fluid dispenser as claimed in claim 17 wherein in the cover moving from the closed position of the cover to the open position of the cover, the cover moves vertically away from the cover actuator member to uncover the first portion and, in the cover actuator member moving from the closed position of the cover actuator member to the open position of the cover actuator member, the cover actuator member moves vertically away from the cover to uncover the second portion.

19. A dispenser as claimed in claim 18 wherein when the cover actuator member is in the closed position of the cover actuator member covering the first portion of the forward opening of the housing and the cover is in the closed lower position of the cover covering the second portion of the forward opening of the housing, a viewing opening is provided into the interior of the housing between the cover actuator member and the cover intermediate the lower portion of the forward opening of the housing and the upper portion of the forward opening of the housing.

20. A fluid dispenser as claimed in claim 3 wherein with the cover actuator member in the open position of the cover actuator member and the cover in the open position of the cover, the first portion of the forward opening of the housing and the second portion of the access opening are open permitting insertion and removal of the removable member from within the interior of the housing through the forward opening.

* * * * *